US009260882B2

(12) United States Patent
Krishnan et al.

(10) Patent No.: US 9,260,882 B2
(45) Date of Patent: Feb. 16, 2016

(54) UNIVERSAL GLOBAL LATCH SYSTEM

(71) Applicant: Ford Global Technologies, LLC, Dearborn, MI (US)

(72) Inventors: Venkatesh Krishnan, Canton, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 227 days.

(21) Appl. No.: 14/026,527

(22) Filed: Sep. 13, 2013

(65) Prior Publication Data

US 2014/0007404 A1 Jan. 9, 2014

Related U.S. Application Data

(63) Continuation-in-part of application No. 12/402,744, filed on Mar. 12, 2009, now Pat. No. 8,746,755, and a continuation-in-part of application No. 12/402,768, filed on Mar. 12, 2009, now Pat. No. 8,573,657, and a continuation-in-part of application No. 12/402,792, filed on Mar. 12, 2009, now Pat. No. 8,544,901.

(51) Int. Cl.

| | |
|---|---|
| ***E05C 3/06*** | (2006.01) |
| ***E05B 17/00*** | (2006.01) |
| ***E05B 81/14*** | (2014.01) |
| ***E05B 83/36*** | (2014.01) |
| *E05B 77/26* | (2014.01) |
| *E05B 77/28* | (2014.01) |
| *E05B 81/90* | (2014.01) |

(52) U.S. Cl.

CPC ..... *E05B 17/0004* (2013.01); *E05B 81/14* (2013.01); *E05B 83/36* (2013.01); *E05B 77/26* (2013.01); *E05B 77/28* (2013.01); *E05B 81/90* (2013.01); *Y10T 29/49826* (2015.01)

(58) Field of Classification Search

CPC ..... Y10T 292/1047; Y10T 292/1082; Y10T 292/699; E05B 81/14; E05B 81/06; E05B 77/26; E05B 77/28; E05B 83/26; Y10S 292/23; Y10S 292/65; E05C 17/003

USPC ..... 292/201, 216, DIG. 23, 92, DIG. 65

See application file for complete search history.

(56) References Cited

U.S. PATENT DOCUMENTS

| | | | |
|---|---|---|---|
| 3,479,767 | A | 11/1969 | Gardner et al. |
| 4,672,348 | A | 6/1987 | Duve |
| 4,674,781 | A | 6/1987 | Reece et al. |
| 4,702,117 | A | 10/1987 | Tsutsumi et al. |
| 4,848,031 | A | 7/1989 | Yamagishi et al. |
| 4,929,007 | A | 5/1990 | Bartczak et al. |
| 5,618,068 | A | 4/1997 | Mitsui et al. |
| 5,632,515 | A | 5/1997 | Dowling |

(Continued)

*Primary Examiner* — Mark Williams

(74) *Attorney, Agent, or Firm* — Jason Rogers; Price Heneveld LLP

(57) ABSTRACT

A powered latch system for a door of a vehicle including a latch assembly, actuatable inside and outside handles, a powered actuator and a door controller that causes the powered actuator to unlatch the latch assembly upon actuation of the inside and outside door handles. The latch assembly may be mechanically unlatched by a user within a vehicle interior even if the powered actuator does not actuate due to a loss of electrical power or other failure. The controller can be programmed to unlatch the latch assembly according to various criteria as required to meet the specific requirements of different markets.

10 Claims, 37 Drawing Sheets

(56) References Cited

U.S. PATENT DOCUMENTS 5,644,869 A 7/1997 Buchanan, Jr.
5,653,484 A 8/1997 Brackmann et al.
5,802,894 A * 9/1998 Jahrsetz ..... E05B 77/48 292/144
5,896,768 A 4/1999 Cranick et al.
5,901,991 A 5/1999 Hugel et al.
5,921,612 A * 7/1999 Mizuki ..... B60J 5/12 292/341.16
6,000,257 A 12/1999 Thomas
6,050,117 A 4/2000 Weyerstall
6,065,316 A 5/2000 Sato et al.
6,099,048 A 8/2000 Salmon et al.
6,125,583 A 10/2000 Murray et al.
6,256,932 B1 7/2001 Jyawook et al.
6,361,091 B1 3/2002 Weschler
6,441,512 B1 8/2002 Jakel et al.
6,470,719 B1 10/2002 Franz et al.
6,523,376 B2 2/2003 Baukholt et al.
6,550,826 B2 4/2003 Fukushima et al.
6,554,328 B2 4/2003 Cetnar et al.
6,629,711 B1 10/2003 Gleason et al.
6,701,671 B1 3/2004 Fukumoto et al.
6,883,839 B2 4/2005 Belmond et al.
6,988,749 B2 * 1/2006 Hashiba ..... E05B 81/14 292/201
7,070,213 B2 7/2006 Willats et al.
7,097,226 B2 8/2006 Bingle et al.
7,192,076 B2 3/2007 Ottino
7,221,255 B2 5/2007 Johnson et al.
7,222,459 B2 5/2007 Taniyama
7,325,843 B2 * 2/2008 Coleman ..... E05B 81/14 292/201
7,399,010 B2 7/2008 Hunt et al.
8,141,916 B2 3/2012 Tomaszewski et al.
8,376,416 B2 2/2013 Arabia, Jr. et al.
8,451,087 B2 5/2013 Krishnan et al.
2001/0005078 A1 6/2001 Fukushima et al.
2004/0195845 A1 10/2004 Chevalier
2006/0254145 A1 * 11/2006 Langfermann ..... E05B 63/143 49/279
2007/0126243 A1 6/2007 Papanikolaou et al.
2007/0170727 A1 7/2007 Kohlstrand et al.
2008/0203737 A1 8/2008 Tomaszewski et al.
2008/0217956 A1 9/2008 Gschweng et al.
2008/0250718 A1 10/2008 Papanikolaou et al.
2009/0033104 A1 2/2009 Konchan et al.
2009/0160211 A1 6/2009 Krishnan et al.
2010/0052337 A1 3/2010 Arabia, Jr. et al.
2010/0235057 A1 * 9/2010 Papanikolaou ..... E05B 81/14 701/49
2010/0235058 A1 9/2010 Papanikolaou et al.
2010/0235059 A1 9/2010 Krishnan et al.
2010/0244466 A1 * 9/2010 Tomaszewski ..... E05B 77/26 292/201

* cited by examiner

UNIVERSAL GLOBAL LATCH SYSTEM

CROSS-REFERENCED TO RELATED APPLICATIONS

This application is a Continuation-In-Part of U.S. patent application Ser. No. 12/402,744, filed Mar. 12, 2009, and entitled "UNIVERSAL GLOBAL LATCH SYSTEM." This application is also a Continuation-In-Part of U.S. patent application Ser. No. 12/402,768, filed Mar. 12, 2009 and entitled "LATCH MECHANISM." This application is also a Continuation-In-Part of U.S. patent application Ser. No. 12/402,792, filed Mar. 12, 2009 and entitled "UNIVERSAL GLOBAL LATCH SYSTEM." All of the above-identified patent applications are hereby incorporated herein in their entireties.

FIELD OF THE INVENTION

The present invention concerns vehicles, and more particularly relates to a latch system for a door of a vehicle.

BACKGROUND OF THE INVENTION

Heretofore, as is known in the art, vehicle door latch assemblies generally include a latch mechanism operable by means of inner and outer door handles. Such latch assemblies can vary in design based on a variety of factors such as the type of vehicle (e.g., car, minivan, truck, etc.), as well as the location of the latch assembly on the specific vehicle. For example, a latch assembly located on a front door of a vehicle may be operable in a single or double pull mode of an inside handle, whereas a latch assembly located on a rear door may require additional child-lock related operability (e.g., no latch over-ride). In Europe, however, the same vehicle may include a rear door latch over-ride. Thus, for a single car, four unique latch assemblies (front/rear, left/right) may be required, with each latch assembly including uniquely designed mechanical features. Moreover, the same vehicle may include yet further latch operation variations when sold in different countries.

For automobiles produced by the millions, reduction of any such variations can result in significant cost savings from design, manufacturing and servicing perspectives. Yet further, streamlining of such functions in one or more latch assemblies can further provide greater flexibility in the ability to customize such functions, and thus greater customer satisfaction.

SUMMARY OF THE PRESENT INVENTION

An aspect of the present invention is to provide a latch system for a door of a vehicle comprising a latch assembly, an actuatable inside handle, an actuator and an emergency release lever. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The actuatable inside handle is not mechanically connected to the pawl. The actuator is engaged with the latch assembly, with the actuator being configured to be activated by actuation of the inside handle. The emergency release lever is movable between an on position and an off position, with the emergency release lever being configured to be engaged with the latch assembly. The catch is configured to be moved to the open position after actuation of the inside handle by activating the actuator to thereby move the pawl to stop the pawl from maintaining the catch in the closed position when the vehicle has power. The catch is configured to be moved to the open position by moving the emergency release lever to the on position to thereby move the pawl to stop the pawl from maintaining the catch in the closed position when the vehicle has power and when the vehicle does not have power.

Another aspect of the present invention is to provide a method of controlling a location of a door of a vehicle comprising providing a latch assembly for maintaining the door in a closed location, with the latch assembly including a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The method also includes providing an actuatable inside handle, with the actuatable inside handle not being mechanically connected to the pawl, engaging an actuator with the latch assembly, and providing an emergency release lever being movable between an on position and an off position, with the emergency release lever being engaged with the actuatable inside handle. The method further includes opening the door when the vehicle has power by moving the catch to the open position by actuating the inside handle to activate the actuator to thereby move the pawl to stop the pawl from maintaining the catch in the closed position. The method also includes opening the door when the vehicle does or does not have power by moving the emergency release lever to the on position to thereby stop the pawl from maintaining the catch in the closed position. Yet another aspect of the present invention is to provide a latch system for a door of a vehicle comprising a latch assembly, an actuatable inside handle, an actuatable outside handle, an actuator engaged with the latch assembly, and an emergency release lever. The latch assembly is for maintaining the door in a closed location, with the latch assembly including a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The latch assembly has a locked condition wherein the pawl is prevented from releasing the catch. The inside handle and the outside handle are not mechanically connected to the pawl. The actuator is configured to be activated by actuation of the inside handle and actuation of the outside handle. The emergency release lever is movable between an on position and an off position, the emergency release lever being configured to be engaged with the latch assembly. The catch is configured to be moved to the open position after actuation of the inside handle by activating the actuator to thereby move the pawl to stop the pawl from maintaining the catch in the closed position when the vehicle has power. The catch is configured to be moved to the open position by moving the emergency release lever to the on position to thereby move the pawl to stop the pawl from maintaining the catch in the closed position when the vehicle has power and when the vehicle does not have power. If the latch assembly is in the locked condition, the actuator prevents actuation of the inside handle from actuating the pawl to stop the pawl from maintaining the catch in the closed position. The catch is configured to be moved to the open position after actuation of the outside handle by activating the actuator to thereby move the pawl to stop the pawl from maintaining the catch in the closed position when the vehicle has power and when the latch assembly is in the locked condition.

An aspect of the present invention is to provide a latch system for a door of a vehicle comprising a latch assembly, an actuatable inside handle, a linkage assembly and an actuator. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The linkage assembly is mechanically linked between the inside handle and the latch assembly. The actuator is interconnected to the pawl. The actuator is configured to be activated by actuation of the inside handle. The catch is configured to be moved to the open position after actuation of the inside handle by activating the actuator to thereby move the pawl to stop the pawl from maintaining the catch in the closed position when the vehicle has power. The catch is also configured to be moved to the open position after actuation of the inside handle by having the inside handle mechanically move the linkage assembly to stop the pawl from maintaining the catch in the closed position when the vehicle has power. The catch is configured to be moved to the open position after actuation of the inside handle by having the inside handle mechanically move the linkage assembly to stop the pawl from maintaining the catch in the closed position when the vehicle does not have power.

Another aspect of the present invention is to provide a latch system for a door of a vehicle comprising a latch assembly, an inside handle, a linkage assembly and an actuator. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The latch assembly has a locked condition wherein the pawl is prevented from releasing the catch. The inside handle is configured to actuate the pawl to stop the pawl from maintaining the catch in the closed position to thereby allow the door to move to the open location. The linkage assembly is mechanically linked between the inside handle and the latch assembly whereby the inside handle can be used to move the pawl. The actuator is interconnected to the pawl. The actuator is configured to be activated by actuation of the inside handle. If the latch assembly is in the locked condition, the actuator prevents actuation of the inside handle from actuating the pawl to stop the pawl from maintaining the catch in the closed position until the vehicle does not have power.

Yet another aspect of the present invention is to provide a method of controlling a location of a door of a vehicle comprising providing a latch assembly including a catch and a pawl, with the catch having a closed position wherein the catch is configured to grasp a portion of the vehicle to maintain the door in a closed location and an open position wherein the catch is configured to release the portion of the vehicle to allow the door to move to an open location. The method also includes providing an actuatable inside handle, mechanically linking a linkage assembly between the inside handle and the latch assembly, and interconnecting an actuator with the pawl. When the vehicle has power, the method includes allowing the door to move to the open location by actuating the inside handle to activate the actuator to move the linkage assembly to thereby stop the pawl from maintaining the catch in the closed position. Additionally, when the vehicle has power, the method includes allowing the door to move to the open location by actuating the inside handle to directly mechanically move the linkage assembly to thereby stop the pawl from maintaining the catch in the closed position. When the vehicle does not have power, the method includes allowing the door to move to the open location by actuating the inside handle to directly mechanically move the linkage assembly to thereby stop the pawl from maintaining the catch in the closed position.

Another aspect of the present invention is to provide a method of controlling a location of a door of a vehicle comprising providing a latch assembly including a catch and a pawl, with the catch having a closed position wherein the catch is configured to grasp a portion of the vehicle to maintain the door in a closed location and an open position wherein the catch is configured to release the portion of the vehicle to allow the door to move to an open location. The latch assembly has a locked condition wherein the pawl is prevented from releasing the catch. The method also includes providing an inside handle configured to actuate the pawl to stop the pawl from maintaining the catch in the closed position to thereby allow the door to move to the open location, mechanically linking a linkage assembly between the inside handle and the latch assembly whereby the inside handle can be used to move the pawl, interconnecting an actuator with the pawl, providing the latch assembly with a locked condition wherein the pawl is prevented from releasing the catch, and preventing actuation of the inside handle from actuating the pawl to stop the pawl from maintaining the catch in the closed position with the actuator until the vehicle does not have power if the latch assembly is in the locked condition.

An aspect of the present invention is to provide a latch system for a door of a vehicle comprising a latch assembly, an actuatable inside handle, an actuator and an emergency release lever. The latch assembly is for maintaining the door in a closed location. The latch assembly includes a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The actuator is engaged with the latch assembly, with the actuator being configured to be activated by actuation of the inside handle. The emergency release lever is movable between an on position and an off position, with the emergency release lever being engaged with the actuatable inside handle. The catch is configured to be moved to the open position after actuation of the inside handle by activating the actuator to thereby move the pawl to stop the pawl from maintaining the catch in the closed position when the vehicle has power. The catch is configured to be moved to the open position after actuation of the inside handle by moving the emergency release lever to the on position to mechanically interconnect the inside handle with the pawl to stop the pawl from maintaining the catch in the closed position. The inside handle is not mechanically interconnected to the pawl when the emergency release lever is in the off position such that actuation of the inside handle will not mechanically move the pawl when the emergency release lever is in the off position.

Another aspect of the present invention is to provide a method of controlling a location of a door of a vehicle comprising providing a latch assembly for maintaining the door in a closed location, with the latch assembly including a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The method also includes providing an actuatable inside handle, engaging an actuator with the latch assembly, and providing an emergency release lever being movable between an on position and an off position, with the emergency release lever being engaged with the actuatable inside handle. The method further includes opening the door when the vehicle has power by moving the catch to the open position by actuating the inside handle to activate the actuator to thereby move the pawl to stop the pawl from maintaining the catch in the closed position. The method also includes opening the door by moving the catch to the open position after actuation of the inside handle by moving the emergency release lever to the on position and mechanically interconnecting the inside handle with the pawl to stop the pawl from maintaining the catch in the closed position. The inside handle is not mechanically interconnected to the pawl when the emergency release lever is in the off position such that actuation of the inside handle will not mechanically move the pawl when the emergency release lever is in the off position.

Yet another aspect of the present invention is to provide a latch system for a door of a vehicle comprising a latch assembly, an actuatable inside handle, an actuatable outside handle, an actuator engaged with the latch assembly, and an emergency release lever. The latch assembly is for maintaining the door in a closed location, with the latch assembly including a catch and a pawl. The catch has a closed position wherein the catch is configured to grasp a portion of the vehicle to maintain the door in the closed location and an open position wherein the catch is configured to release the portion of the vehicle to allow the door to move to an open location. The pawl is configured to maintain the catch in the closed position. The latch assembly has a locked condition wherein the pawl is prevented from releasing the catch. The actuator is configured to be activated by actuation of the inside handle and actuation of the outside handle. The emergency release lever is movable between an on position and an off position, the emergency release lever being engaged with the actuatable inside handle. The catch is configured to be moved to the open position after actuation of the inside handle by activating the actuator to thereby move the pawl to stop the pawl from maintaining the catch in the closed position when the vehicle has power. The catch is configured to be moved to the open position after actuation of the inside handle by moving the emergency release lever to the on position to mechanically interconnect the inside handle with the pawl to stop the pawl from maintaining the catch in the closed position. The inside handle is not mechanically interconnected to the pawl when the emergency release lever is in the off position such that actuation of the inside handle will not mechanically move the pawl when the emergency release lever is in the off position. If the latch assembly is in the locked condition, the actuator prevents actuation of the inside handle from actuating the pawl to stop the pawl from maintaining the catch in the closed position. The catch is configured to be moved to the open position after actuation of the outside handle by activating the actuator to thereby move the pawl to stop the pawl from maintaining the catch in the closed position when the vehicle has power and when the latch assembly is in the locked condition.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
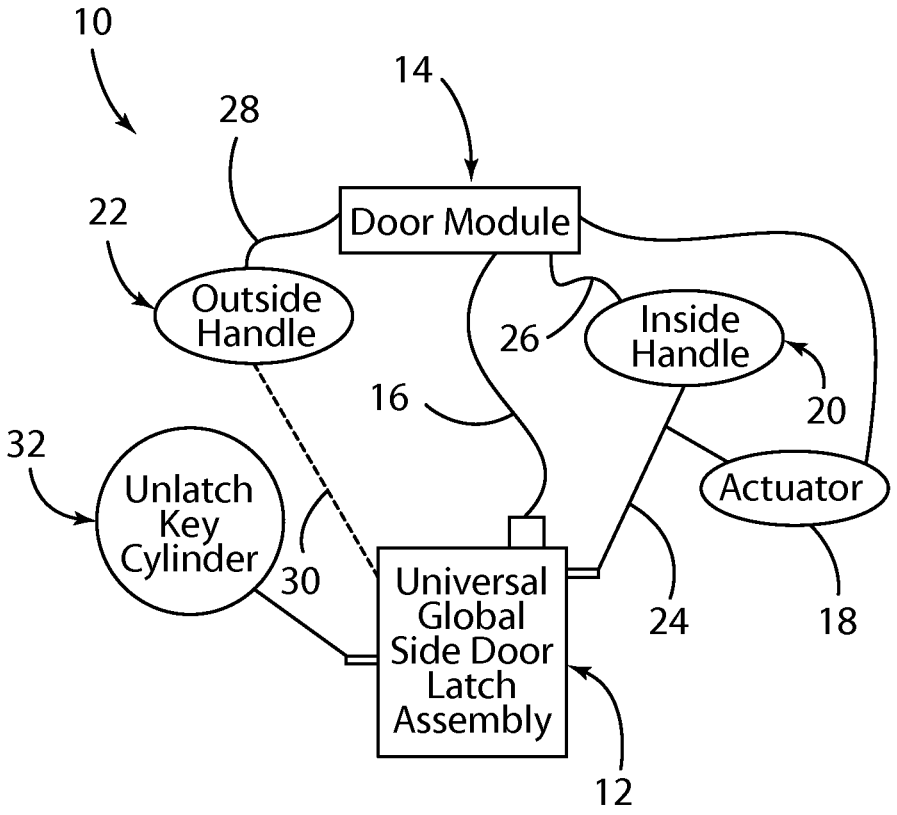
FIG. 1 is a schematic view of a latch system of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a latch system of the present invention. The latch system 10 can be used in any vehicle having doors and includes a latch assembly 12 for each door, with each latch assembly 12 being configured to keep their associated door closed or to allow their associated door to open. In a preferred embodiment, all of the latch assemblies 12 in the vehicle are substantially identical. However, it is contemplated that not all of the latch assemblies 12 need to be substantially identical (e.g., the front doors can have different latch assemblies 12 than the rear doors or all doors can have different latch assemblies 12).

In the illustrated example, the latch system 10 can be used in a vehicle having a centralized control system for controlling the latch assemblies 12 for all doors of the vehicle or a control system for controlling the latch assembly 12 for a single door. The centralized control system can be used to open a door, to keep the door closed or to provide certain functionality to the latch assembly (for example, locking, unlocking, child-locking, double locking, etc.) for a particular door or for each latch assembly 12. Accordingly, the structure of the latch assemblies 12 for each of the doors can be structurally identical, with the centralized control system individually and selectively altering the functionality for each door. As illustrated in FIG. 1, a door module 14 represents the control system for the latch assembly 12. The door module 14 can be connected to one latch assembly 12 for one door (as shown) or can be connected to multiple latch assemblies 12 for multiple doors. The door module 14 can include a microprocessor and a memory unit and communicates with the latch assembly 12 via an electrical control line 16 (either wired or wireless). For example, the electrical control line 16 can include a single-control bus with a return through a common chassis ground.

In the illustrated embodiment, each of the latch assemblies 12 can be associated with a respective control and driver circuit including a microprocessor which is, in turn, associated with an actuator 18 as discussed in more detail below. The actuator 18 may be connected to the driver circuit through a bistable relay. The circuits can include or can be programmed to be demultiplexers for receiving serial control signals transmitted over the electrical control line 16 and for converting them to control signals for the actuator 18. Correspondingly, the door module 14 can have its microprocessor programmed to constitute a multiplexer or can include a separate multiplexer. While the system as thus far described uses unidirectional information or control signal flow, a bidirectional signal transmission is also possible. For example, the processors of the circuits can dialogue with the door module 14 and can transmit signals indicating the state of the respective latch assembly 12 to the door module 14. Each of the processors of the control and driver circuits can be provided with a lock identity code word storage or memory. Correspondingly, the door module 14 can have a memory for storage connected to its central processor and serving as control system identity code word storage. Each of the identity code word memories or storage has a respective identity code word stored therein and can output this code word upon interrogation so that the code words can be compared with one another. Upon a failure of agreement between interrogated identity code words, the latch assemblies 12 are automatically brought into the "antitheft securing mode on" and "child-safety mode on" positions and deactivated to prevent opening of the door. Alternatively or simultaneously, the door module 14 can be deactivated.

The illustrated latch system 10 as illustrated in FIG. 1 includes the latch assembly 12 connected to the door module 14 via the electrical control line 16 as discussed above. The latch assembly 12 also includes an inside handle 20 located within an interior of the vehicle and an outside handle 22 located at an exterior of the vehicle. The inside handle 20 is mechanically connected to the latch assembly 12 via a linkage assembly 24 as discussed in more detail below. The inside handle 20 can also electrically communicate with the door module 14 via an inside handle electrical control line 26 (either wired or wireless). In the illustrated embodiment, the outside handle 22 electrically communicates with the door module 14 via an outside handle electrical control line 28 (either wired or wireless). However, it is contemplated that the outside handle 22 could be mechanically connected to latch assembly 12 via a mechanical linkage (shown as dashed line 30 in FIG. 1) in an manner typically used and known to those skilled in the art (with a powered or mechanically actuated lock). As discussed in more detail below, the latch system 10 can also include an unlatch key cylinder 32 mechanically connected to the latch assembly 12 for allowing the latch assembly 12 to allow its associated door to open from an exterior of the vehicle. It is contemplated that only the driver side door, the front doors or all the doors could include the unlatch key cylinder 32.

Figure 2:
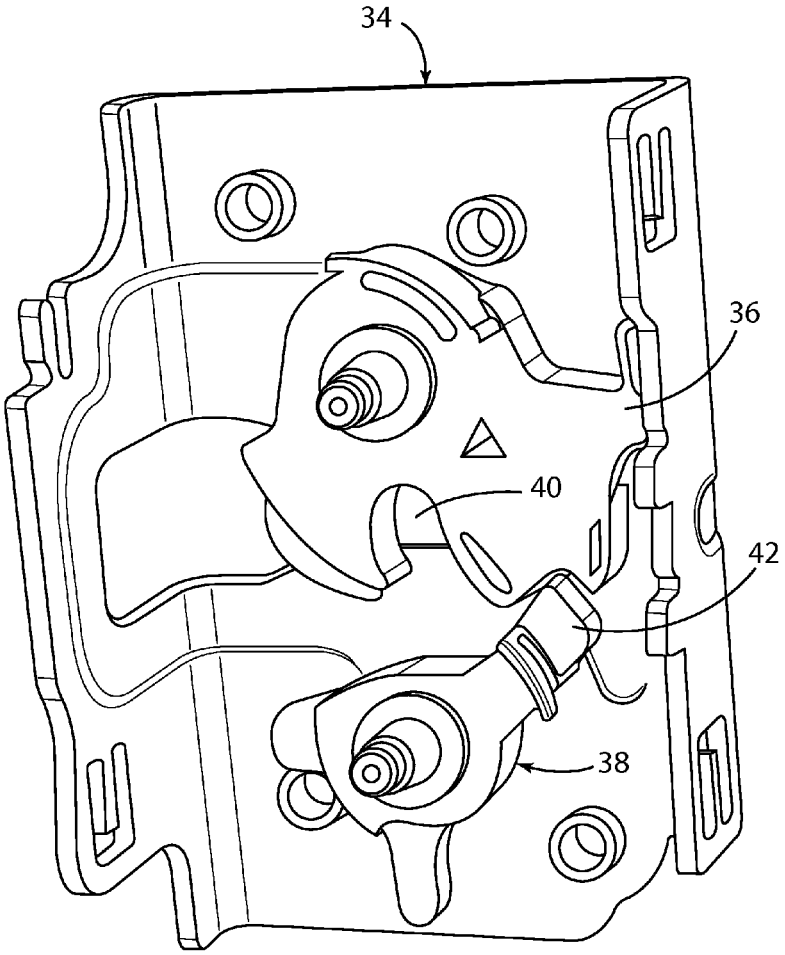
FIG. 2 is a partial perspective view of a typical latch for a door.

In the illustrated example, the latch assembly 12 (FIG. 2) is configured to maintain the door in a closed location and to allow the door to move to an open location. The latch assembly 12 includes a latch housing 34 having a catch 36 and a pawl 38. As is well known to those skilled in the art, the catch 36 includes a slot 40 configured to selectively accept a post (not shown) of a vehicle frame to maintain the door in the closed location. FIG. 2 illustrates the catch 36 in a closed position wherein the post of the vehicle would be trapped within the slot 40 such that the door is maintained in the closed location. The pawl 38 is configured to maintain the catch 36 in the closed position by having an extension 42 of the pawl 38 abut against the catch 36 to prevent rotation of the catch 36. The pawl 38 is configured to rotate clockwise as shown in FIG. 2 to allow the catch 36 to rotate. Once the pawl 38 moves out of engagement with the catch 36, the catch 36 is configured to rotate clockwise as shown in FIG. 2 to an open position to release the post of the vehicle frame, thereby allowing the door to move to an open location. The structure and function of the catch 36 and the pawl 38 as discussed directly above are well known to those skilled in the art. An aspect of the present invention is to include a linkage assembly 44 (see FIGS. 3-9) and to have the linkage assembly 44 interact with the latch assembly 12.

Figure 3:
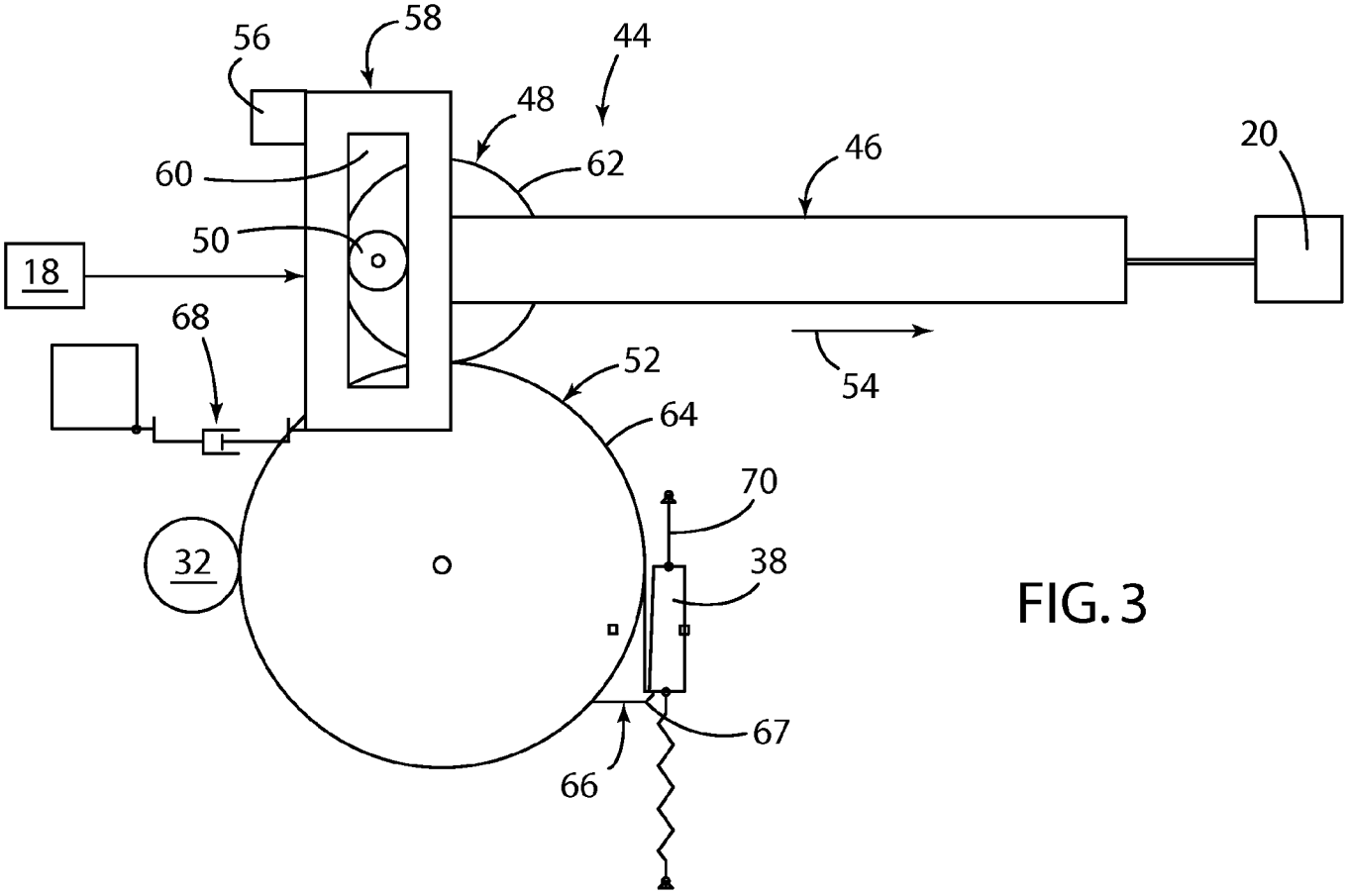
FIG. 3 is a schematic view of the present invention showing a linkage mechanism of the present invention in an initial position.

The illustrated linkage assembly 44 (FIGS. 3-9) is mechanically linked between the inside handle 20 and the latch assembly 12. The linkage assembly 44 includes an inside release lever 46, a first gear 48 having a gear post 50 and a second gear 52. The inside release lever 46 is connected to the inside handle 20. When the inside handle 20 is actuated (e.g., pulled), the inside release lever 46 is configured to move linearly along line 54 as illustrated in FIG. 3. As discussed in association with FIGS. 3-9, movement of the inside release handle 46 causes the first gear 48 and the second gear 52 to rotate.

In the illustrated example, FIG. 3 illustrates the linkage assembly 44 in an initial position. In the initial position, the inside release lever 46 is at an initial position and abuts a fixed anchor 56 in the vehicle. The inside release lever 46 includes a head 58 having a rectangular opening 60 therein. The gear post 50 of the first gear 48 is located within the rectangular opening 60 of the head 58 of the inside release lever 46. In the initial position, the gear post 50 is located at nine o'clock on the first gear 48. The first gear 48 includes first gear teeth 62 engaged with second gear teeth 64 on the second gear 52 such that rotation of the first gear 48 causes the second gear 52 to rotate and rotation of the second gear 52 causes the first gear 48 to rotate. The second gear 52 includes a pawl actuation member 66 configured to engage the pawl 38. FIGS. 3-9 include a cross-section of the pawl 38 in a direction substantially perpendicular to the pawl 38 as illustrated in FIG. 2 such that vertical motion of a portion of the pawl 38 in FIGS. 3-9 will translate to rotational movement of the pawl 38 when viewed from the front as in FIG. 2. The pawl actuation member 66 includes a prong 67 abutting the pawl 38 and preventing the pawl 38 from rotating (and thereby preventing the catch 36 from moving to the open position and the door from moving to the open location).

Figure 4:
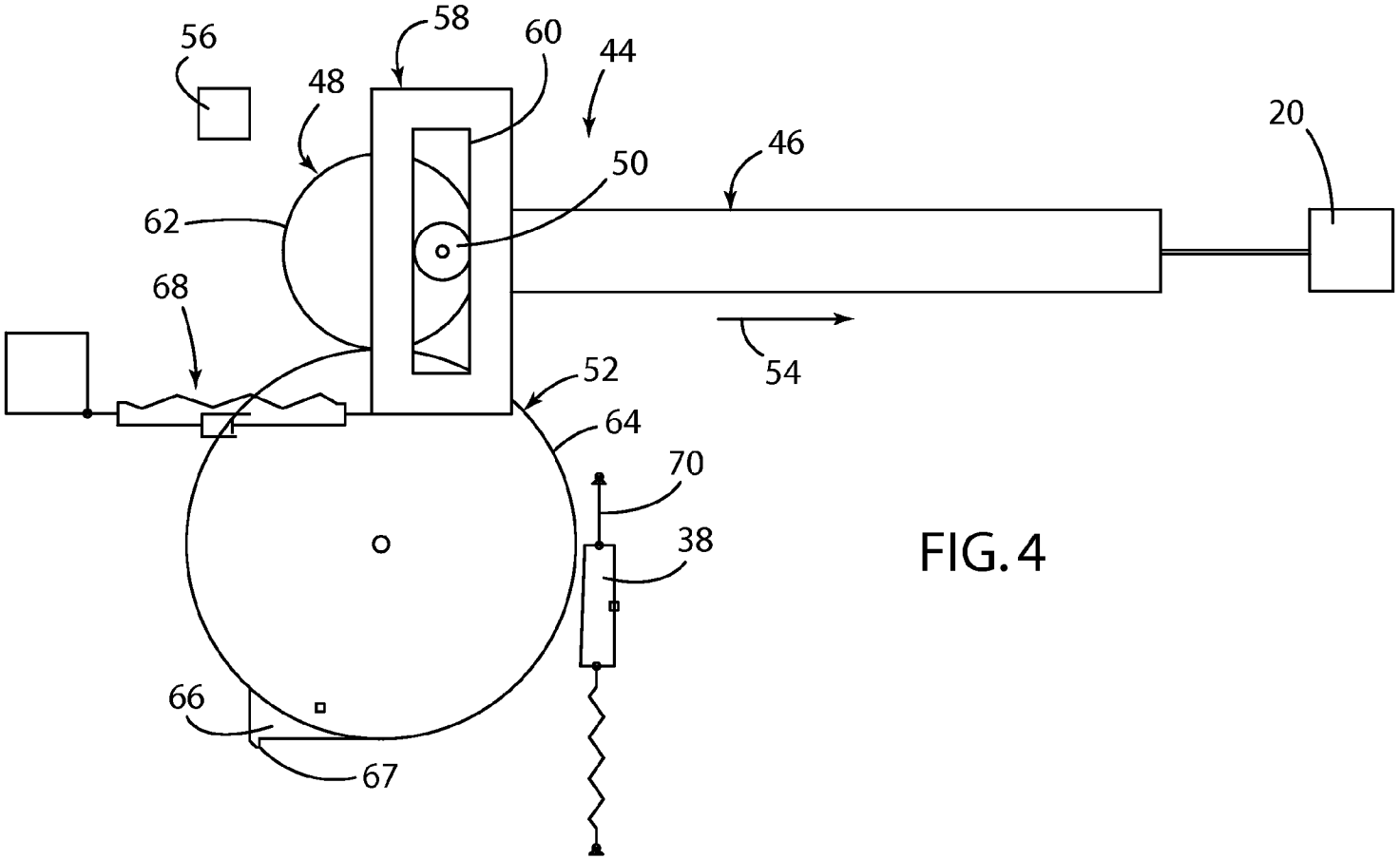
FIG. 4 is a schematic view of the present invention showing the linkage mechanism of the present invention in a first pulled position.

FIG. 4 illustrates the linkage assembly 44 after a first full actuation of the inside handle 20. Actuation of the inside handle 20 causes the inside release lever 46 to move along line 54 against the force of a spring damper 68. As the inside release lever 46 is moved along line 54, the gear post 50 will move first downward and then upward within the rectangular opening 60 of the head 58 of the inside release lever 46, thereby causing the first gear 48 to rotate counter-clockwise approximately 180°. Rotation of the first gear 48 will cause the second gear 52 to rotate. As illustrated in FIG. 4, the second gear 52 is larger than the first gear 48 such that 180° counter-clockwise rotation of the first gear 48 will cause the second gear 52 to rotate 90° clockwise. Furthermore, the pawl actuation member 66 will rotate with the second gear 52 such that the prong 67 on the pawl actuation member 66 no longer prevents the pawl 38 from rotating.

Figure 5:
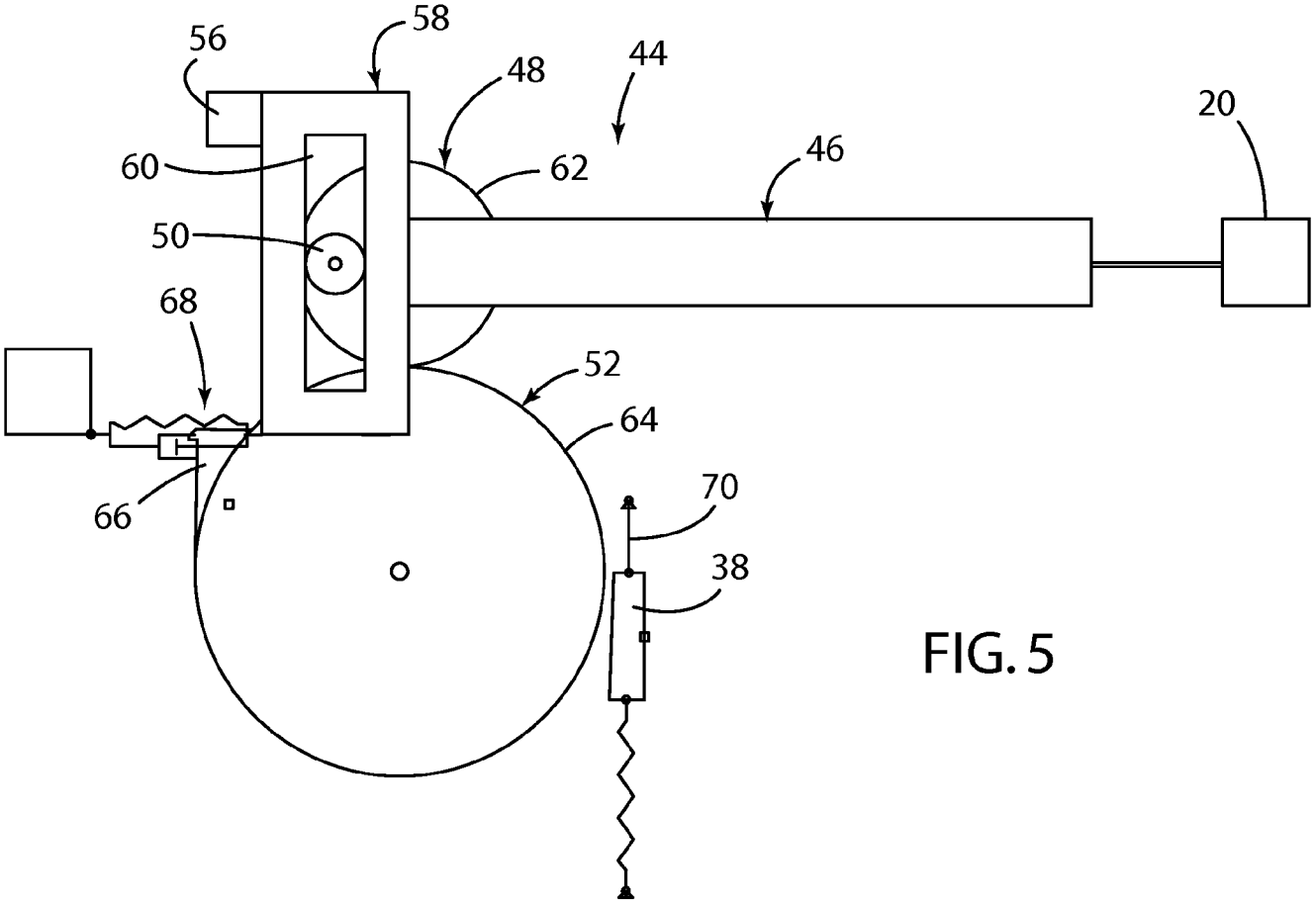
FIG. 5 is a schematic view of the present invention showing the linkage mechanism of the present invention in a first released position.

FIG. 5 illustrates the linkage assembly 44 after the inside handle 20 has been released after the first full actuation of the inside handle 20. After the inside handle 20 has been released after the first full actuation of the inside handle 20, the spring damper 68 pulls the inside release lever 46 in a direction opposite to line 54 and back to the initial position of the inside release lever 46. As the inside release lever 46 is moved back to its initial position, the gear post 50 will move first upward and then downward within the rectangular opening 60 of the head 58 of the inside release lever 46, thereby causing the first gear 48 to rotate counter-clockwise another approximately 180° (for a total of approximately 360° or one full rotation). Further rotation of the first gear 48 will cause the second gear 52 to further rotate. As illustrated in FIG. 5, the further 180° counter-clockwise rotation of the first gear 48 will cause the second gear 52 to rotate another 90° clockwise (for a total of 180° clockwise rotation). Furthermore, the pawl actuation member 66 is rotated with the second gear 52 another 90°.

Figure 6:
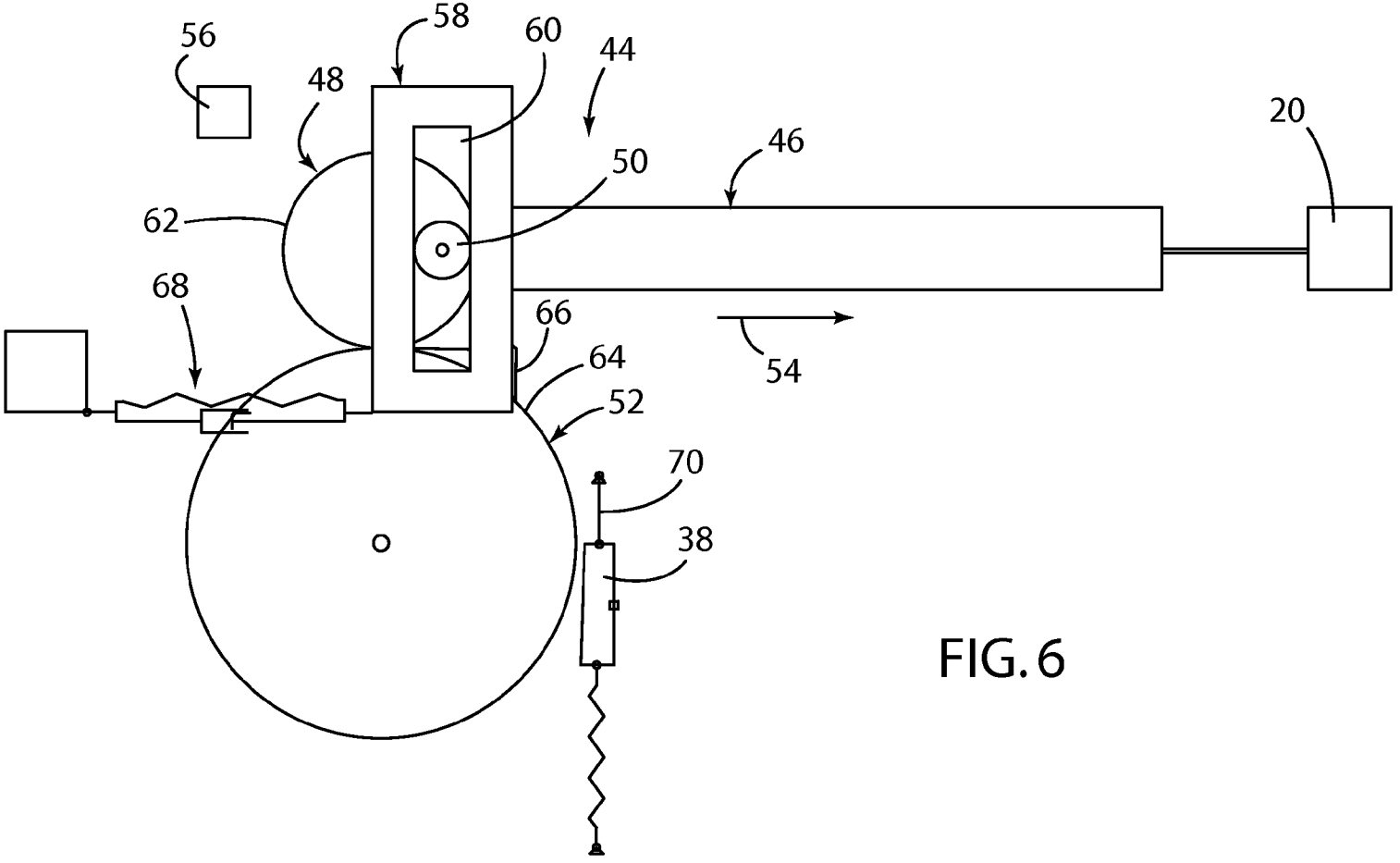
FIG. 6 is a schematic view of the present invention showing the linkage mechanism of the present invention in a second pulled position.

FIG. 6 illustrates the linkage assembly 44 after a second full actuation of the inside handle 20. As discussed above, actuation of the inside handle 20 causes the inside release lever 46 to move along line 54 against the force of a spring damper 68. As the inside release lever 46 is moved along line 54, the gear post 50 will move first downward and then upward within the rectangular opening 60 of the head 58 of the inside release lever 46, thereby causing the first gear 48 to rotate counter-clockwise another approximately 180°. This additional rotation of the first gear 48 will cause the second gear 52 to further rotate. As illustrated in FIG. 6, the further 180° counter-clockwise rotation of the first gear 48 will cause the second gear 52 to rotate another 90° clockwise (for a total of 270° clockwise rotation). Furthermore, the pawl actuation member 66 is rotated with the second gear 52 another 90°.

Figure 7:
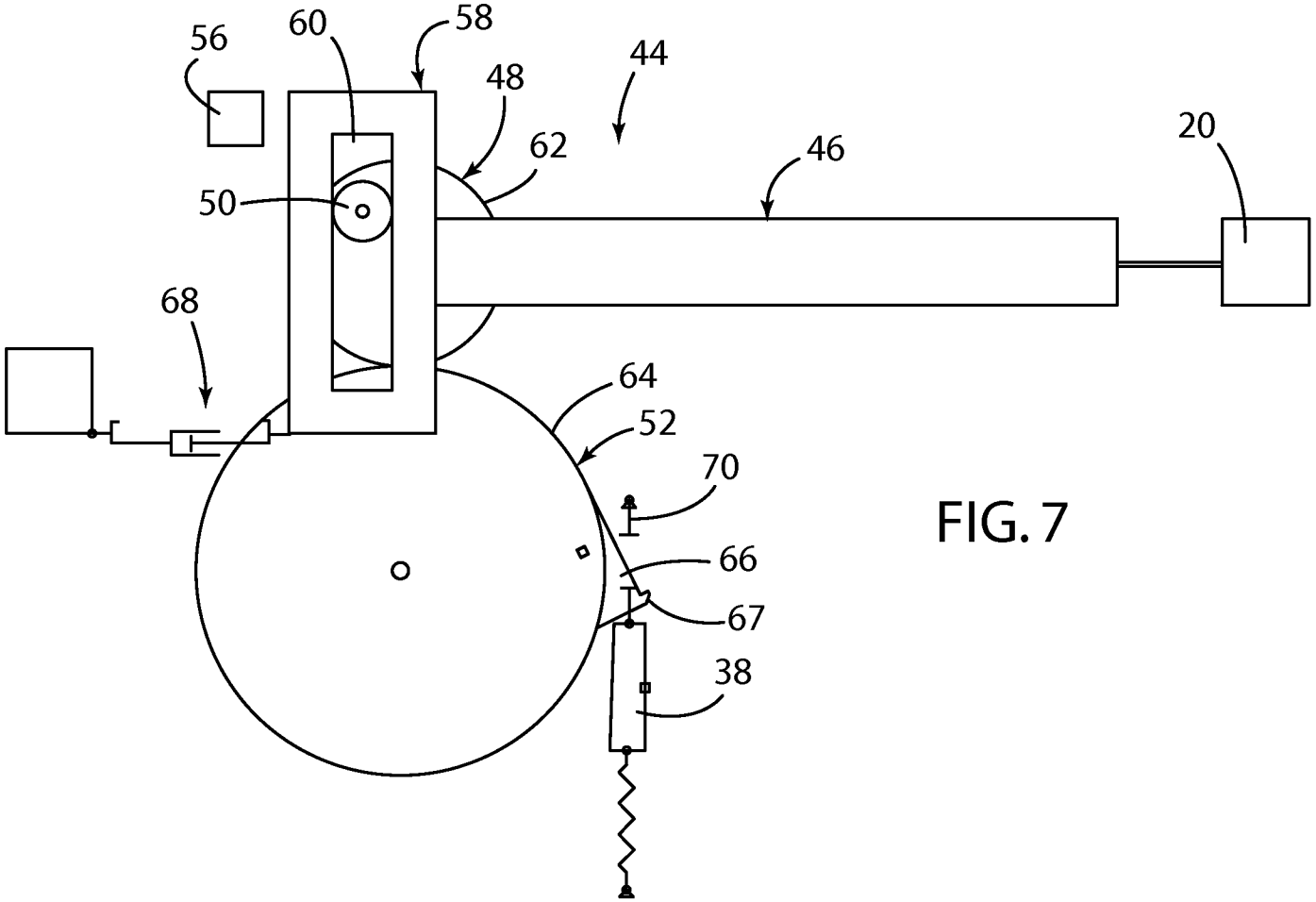
FIG. 7 is a schematic view of the present invention showing the linkage mechanism of the present invention in a second released position beginning actuation of a pawl actuation member.

FIG. 7 illustrates the linkage assembly 44 in a first released position after the inside handle 20 has been released after the second full actuation of the inside handle 20. After the inside handle 20 has been released after the second full actuation of the inside handle 20, the spring damper 68 pulls the inside release lever 46 in a direction opposite to line 54 and back to the initial position of the inside release lever 46. As the inside release lever 46 is moved back to its initial position, the gear post 50 will move first upward and then downward within the rectangular opening 60 of the head 58 of the inside release lever 46, thereby causing the first gear 48 to rotate counter-clockwise another approximately 180° (for a total of approximately 720° or two full rotations). Further rotation of the first gear 48 will cause the second gear 52 to further rotate. As illustrated in FIG. 7, as the spring damper 68 pulls the inside release lever in a direction opposite to line 54 and back to the initial position of the inside release lever 46, thereby causing the first gear 48 and the second gear 52 to rotate, the pawl actuation member 66 abuts a top of the pawl 38 to thereby move the pawl 38 against the force of a pawl spring 70. Such movement of the pawl 38 releases the catch 36 as discussed above to allow the catch 36 to move to the open position and to allow the door to move to the open location.

Figure 8:
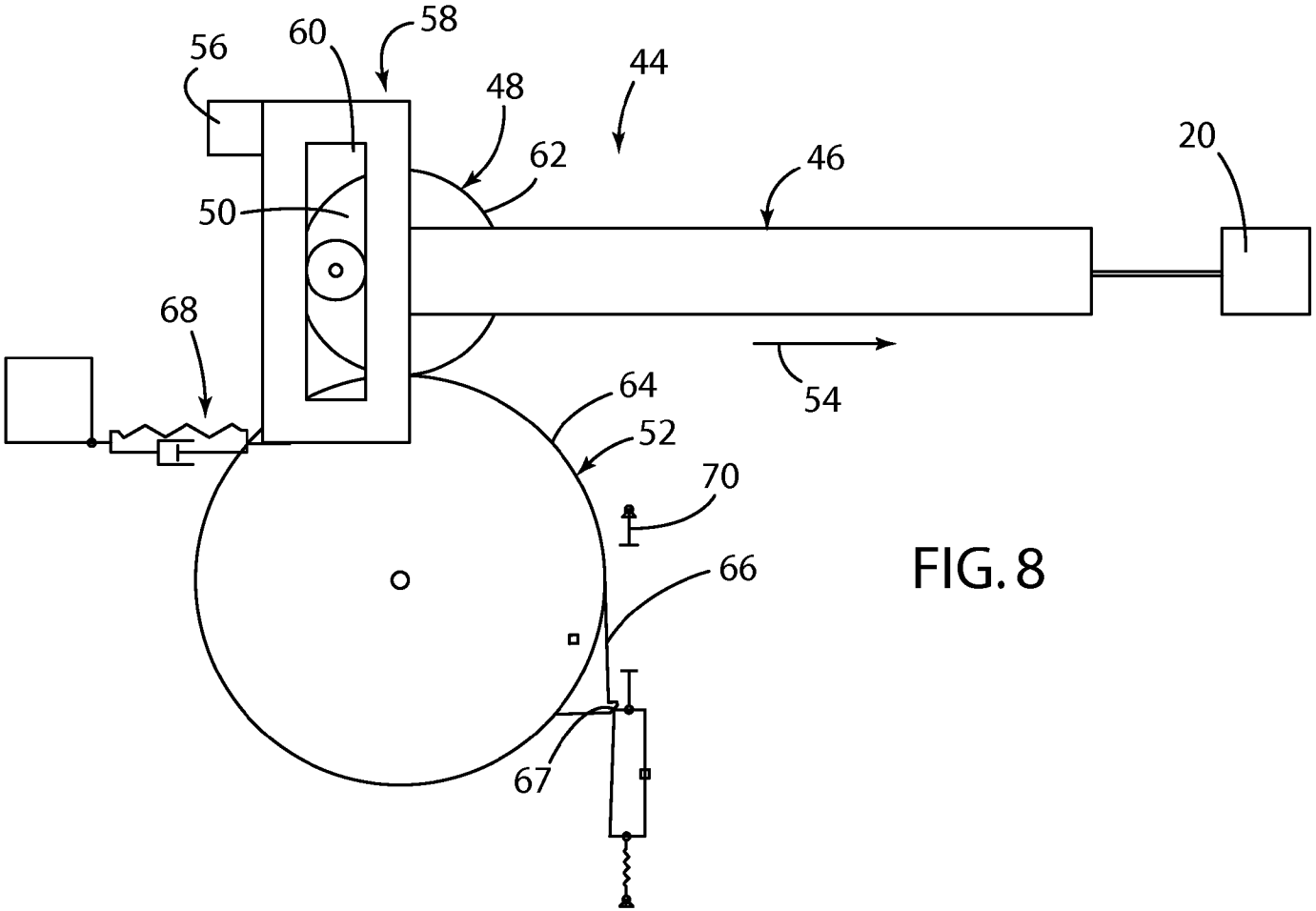
FIG. 8 is a schematic view of the present invention showing the linkage mechanism of the present invention in the second released position ending actuation of the pawl actuation member.
Figure 9:
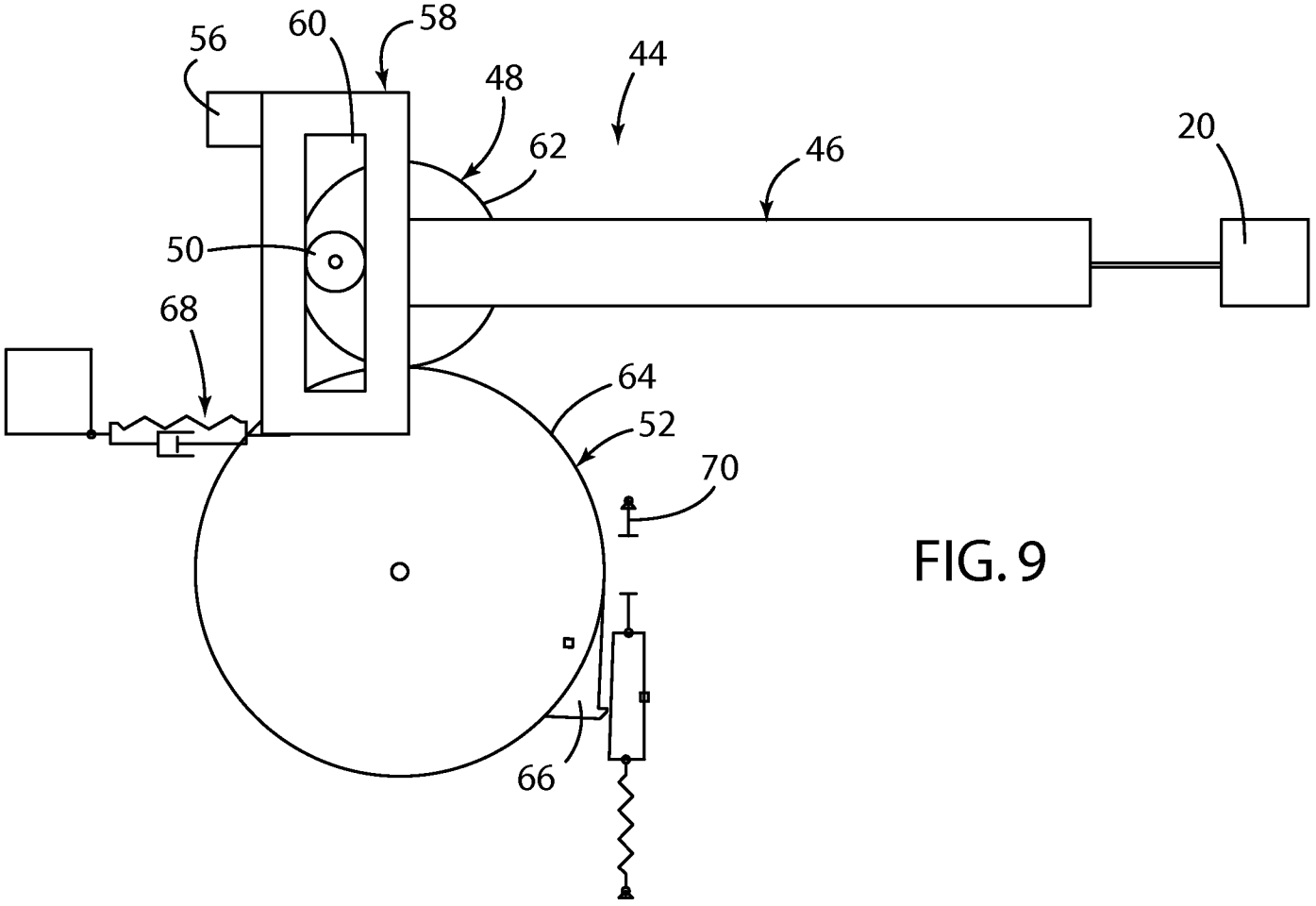
FIG. 9 is a schematic view of the present invention showing the linkage mechanism of the present invention in the second released position moving towards the initial position of FIG. 3.

FIG. 8 illustrates further movement of the inside release lever 46 back to the initial position, further rotation of the first gear 48 and the second gear 52, and further movement of the pawl 38 by movement of the pawl actuation member 66. FIG.

9 illustrates the linkage assembly 44 back in the initial position right before that shown in FIG. 3 and after the pawl actuation member 66 has passed by the pawl 38, thereby allowing the pawl 38 to go back to its initial position in FIG. 3.

Accordingly, the linkage assembly 44 allows a person inside the vehicle to open the door by pulling the inside handle 20 twice such that the pawl actuation member 66 forces the pawl 38 to move, thereby allowing the pawl 38 to release the catch 36 as discussed above to allow the catch 36 to move to the open position and to allow the door to move to the open location. Therefore, the latch system 10 can be configured to allow the latch assembly 12 to allow the door to open with every second pull of the inside handle 20.

It is also contemplated that the illustrated latch system 10 can have the actuator 18 mechanically engaged with the linkage assembly 44 and configured to move at least a portion of the linkage assembly 44. For example, the actuator 18 can comprise a linear actuator configured to move the inside release lever 46 along line 54, an actuator configured to move the gear post 50 of the first gear 48, an actuator configured to rotate the first gear 48 (e.g., a linear actuator having a rack engaged with the first gear teeth 62 of the first gear 48), or an actuator configured to rotate the second gear 52 (e.g., a linear actuator having a rack engaged with the second gear teeth 64 of the second gear 52). FIG. 3 includes one of the above example, with the actuator 18 engaged with the inside release lever 46 (it being understood that the actuator 18 could be engaged with the inside release lever 46 in FIGS. 4-9 or with any other portion of the linkage assembly 44). Therefore, the actuator 18 can be activated to open the door by moving the pawl 38 via movement of the pawl actuation member 66 by moving the inside release lever 46, the gear post 50 of the first gear 48, the first gear 48, or the second gear 52. Accordingly, the catch 36 would move to the open position, thereby allowing the door to move to the open location. The actuator 18 can also be employed to prevent the pawl 38 from moving by maintaining the pawl actuation member 66 in its initial position or moving the pawl actuation member 66 to its initial position as illustrated in FIG. 3 such that the prong 67 abuts the pawl 38 and prevents the pawl 38 from rotating. It is also contemplated that the actuator 18 could be integrated into the latch assembly 12 such that activation of the actuator 18 directly moves the pawl 38 or directly prevents the pawl 38 from moving.

The illustrated actuator 18 can be activated by a signal from the door module 14. For example, the actuator 18 can be activated to open the door by actuation of the inside handle 20 or the outside handle 22. It is also contemplated that the door module 14 could receive a remote signal such that the door automatically opens (for example, with a button on a key chain wirelessly sending a signal to the door module 14 telling the door module 14 to open the door). The actuator 18 can also be used to prevent the door from moving to the open location (e.g., when the door module 14 is set in a child-lock state) by continuously moving the pawl activation member 66 back to its initial position to prevent the pawl 38 from rotating. It is noted that the actuator 18 only works when the vehicle has power (or when the actuator 18 is powered). Therefore, when the vehicle (or actuator 18) does not have power, the door can only be moved to the open location from the inside by pulling the inside handle 20 twice. It is also noted that the inside release lever 46 is configured to move relative to the inside handle 20 such that the actuator 18 can move the inside release lever 46 as discussed above without moving the inside handle 20 (for example, the connection between the inside release lever 46 and the inside handle 20 could only be a tension connection such that compression of the connection will not move both of these parts).

In the illustrated example, the unlatch key cylinder 32 functions similar to the actuator 18. The unlatch key cylinder 32 allows a person outside the vehicle to open the door. The unlatch key cylinder 32 is mechanically engaged with the linkage assembly 44. The unlatch key cylinder 32 is configured to accept a key of a user of the vehicle. The unlatch key cylinder 32 can comprise a typical cylinder lock. The unlatch key cylinder 32 is configured to move the linkage assembly 44 in the same manner the actuator 18 moves the linkage assembly 44. For example, the unlatch key cylinder 32 can move the inside release lever 46 along line 54, move the gear post 50 of the first gear 48, rotate the first gear 48 (e.g., by moving a rack engaged with the first gear teeth 62 of the first gear 48 or by direct engagement), or rotate the second gear 52 (e.g., by moving a rack engaged with the second gear teeth 64 of the second gear 52 or by direct engagement). FIG. 3 includes one of the above example, with the unlatch key cylinder 32 being engaged with the second gear 32 (it being understood that the unlatch key cylinder 32 could be engaged with the second gear 32 in FIGS. 4-9 or with any other portion of the linkage assembly 44). Therefore, the unlatch key cylinder 32 can be used to open the door by moving the pawl 38 via movement of the pawl actuation member 66 by moving the inside release lever 46, the gear post 50 of the first gear 48, the first gear 48, or the second gear 52. Accordingly, the catch 36 would move to the open position, thereby allowing the door to move to the open location.

Referring next to FIGS. 10-13, flowcharts of a vehicle front/rear door inside/outside release operation are provided.

Figure 10:
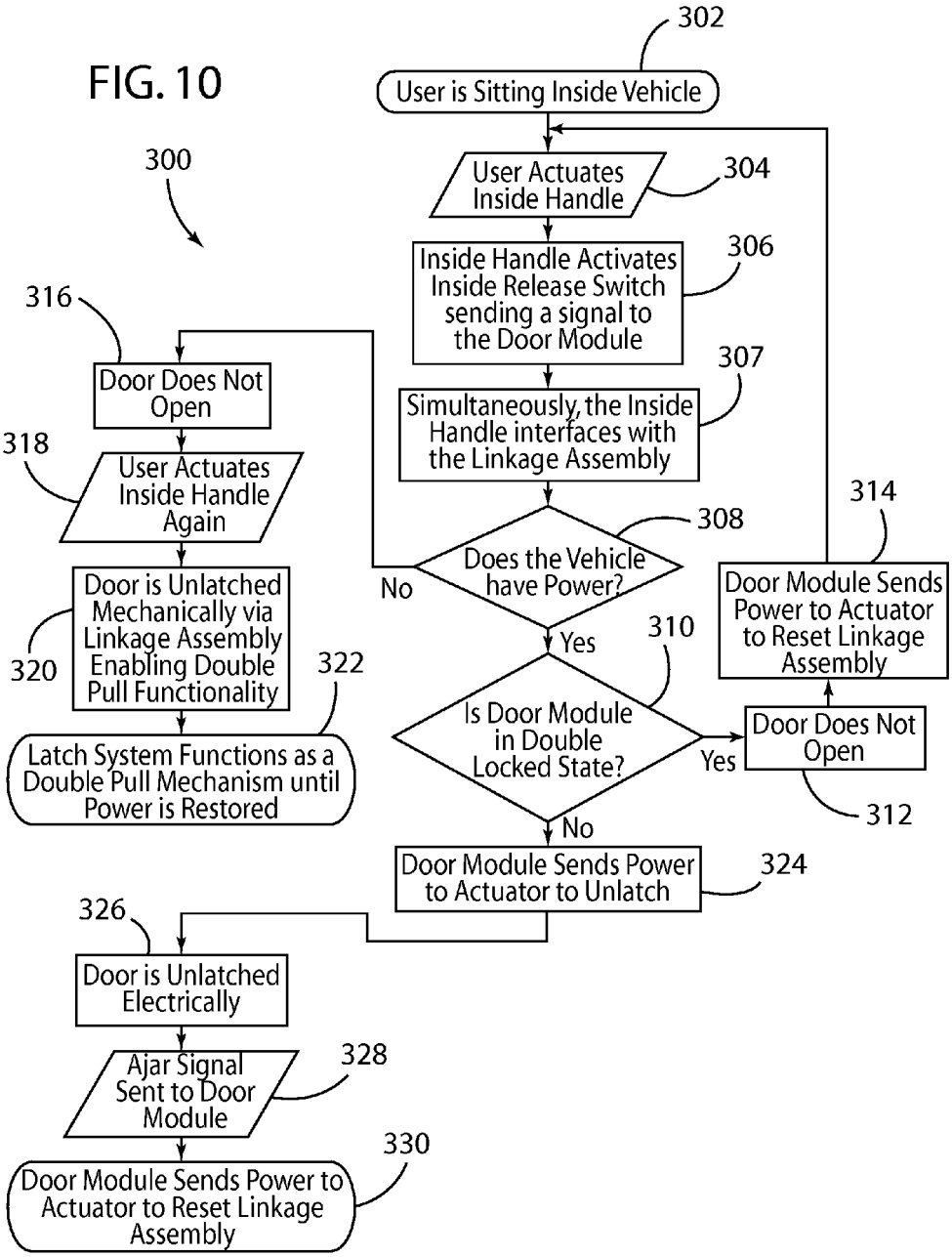
FIG. 10 is a flow chart illustrating a front door inside release operation.

Specifically, referring to FIG. 10, a front door inside release operation 300 will be described in detail. For front door inside release operation 300, at step 302, a user is seated inside the vehicle, and at step 304, the user actuates the inside handle 20. At step 306, when the user actuates the inside handle 20, an inside release switch is activated, thus sending a signal to the door module 14. Simultaneously, the inside handle 20 interfaces with the linkage assembly 44 at step 307. At step 308, if the vehicle has power, the method continues to step 310. At step 310, the door module 14 determines if the door module 14 is in a double locked state. If the determination at step 308 is yes, then at step 312, the vehicle door does not open. Thereafter, at step 314, the door module 14 sends a signal to the actuator 18 to reset the linkage assembly 44 moving the linkage assembly 44 to its initial position of FIG. 3 if it is not in its initial position. If the vehicle does not have power as determined at step 308, then at step 316, the vehicle door does not open until the user actuates the inside handle 20 again at step 318. Thereafter, at step 320, the door is unlatched mechanically via the linkage assembly 44 and the door is moved to the open location (thereby enabling a double pull functionality). Moreover, until the power is restored, the latch system 10 functions as a double pull mechanism at step 322. If the determination at step 310 is no (such that the door module 14 is not in a double locked state), the method 300 continues to step 324 where the door module 14 instructs the actuator 18 to move the linkage assembly 44 to allow the door to move to the open location at step 326 (by moving the pawl 38 as discussed above). Thereafter, at step 328, a signal is sent to the door module 14 telling the door module 14 that the door is ajar (or in the open location) such that the door module 14 can send a signal to the actuator 18 at step 330 to reset the linkage assembly 44 by moving the linkage assembly 44 to its initial position of FIG. 3 if it is not in its initial position. It is noted that if it is desired to have the door open only after every two pulls of the inside handle 20, the steps 324, 326, 328 and 330 can be replaced with steps 316, 318, 320 and 322, respectively.

Figure 11:
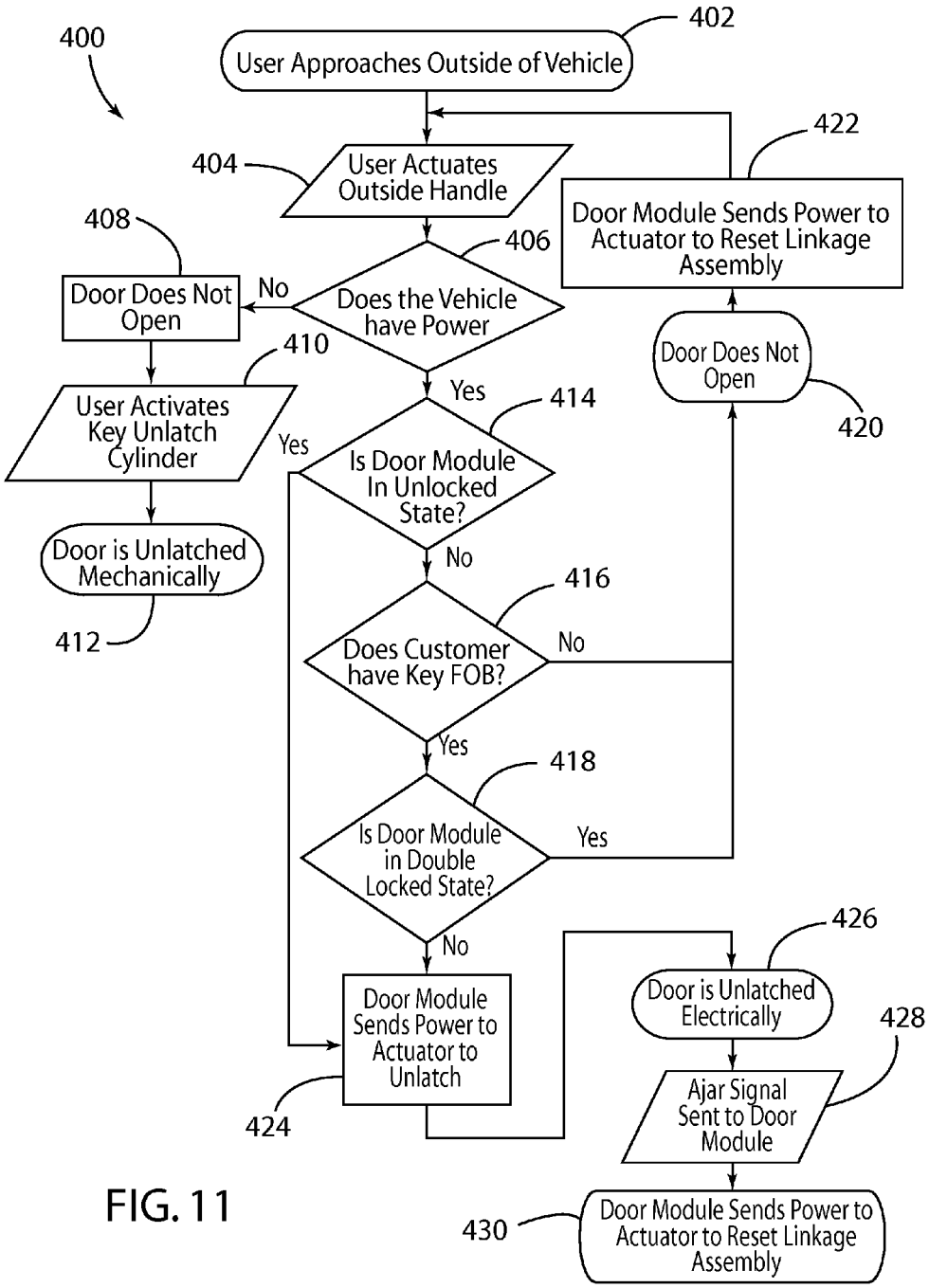
FIG. 11 is a flow chart illustrating a front door outside release operation.

Referring to FIG. 11, a front door outside release operation 400 will be described in detail. For front door outside release operation 400, at step 402, a user approaches an outside of the vehicle, and at step 404, the user actuates the outside handle 22. At step 406, if the vehicle has no power, the method continues to step 408. At step 408, the door does not open until the user actuates the key unlatch cylinder 32 at step 410 to mechanically move the door to the open location at step 412. If the vehicle does have power as determined at step 406, then at step 414, the door module 14 determines if the door module 14 is in an unlocked state. If the determination at step 414 is no, then at step 416, the door module 14 determines if the user has a key FOB for moving the door module 14 to the unlocked state. If the user does not have a key FOB at step 416, then at step 420, the vehicle door does not open. Thereafter, at step 422, the door module 14 sends a signal to the actuator 18 to reset the linkage assembly 44 by moving the linkage assembly 44 to its initial position of FIG. 3 if it is not in its initial position. If the user does have a key FOB at step 416, at step 418, the door module 14 determines if the door module 14 is a double locked state. If the door module 14 is in the double locked state, then at step 420, the vehicle door does not open and the actuator resets the linkage assembly 44 at step 422. If the determination at step 418 is no (such that the door module 14 is not in a double locked state) or if the determination at step 414 is yes (such that the door module 14 is in an unlocked state), the method 400 continues to step 424 where the door module 14 instructs the actuator 18 to move the linkage assembly 44 to allow the door to move to the open location at step 426 (by moving the pawl 38 as discussed above). Thereafter, at step 428, a signal is sent to the door module 14 telling the door module 14 that the door is ajar (or in the open location) such that the door module 14 can send a signal to the actuator 18 at step 430 to reset the linkage assembly 44 by moving the linkage assembly 44 to its initial position of FIG. 3 if it is not in its initial position.

Figure 12:
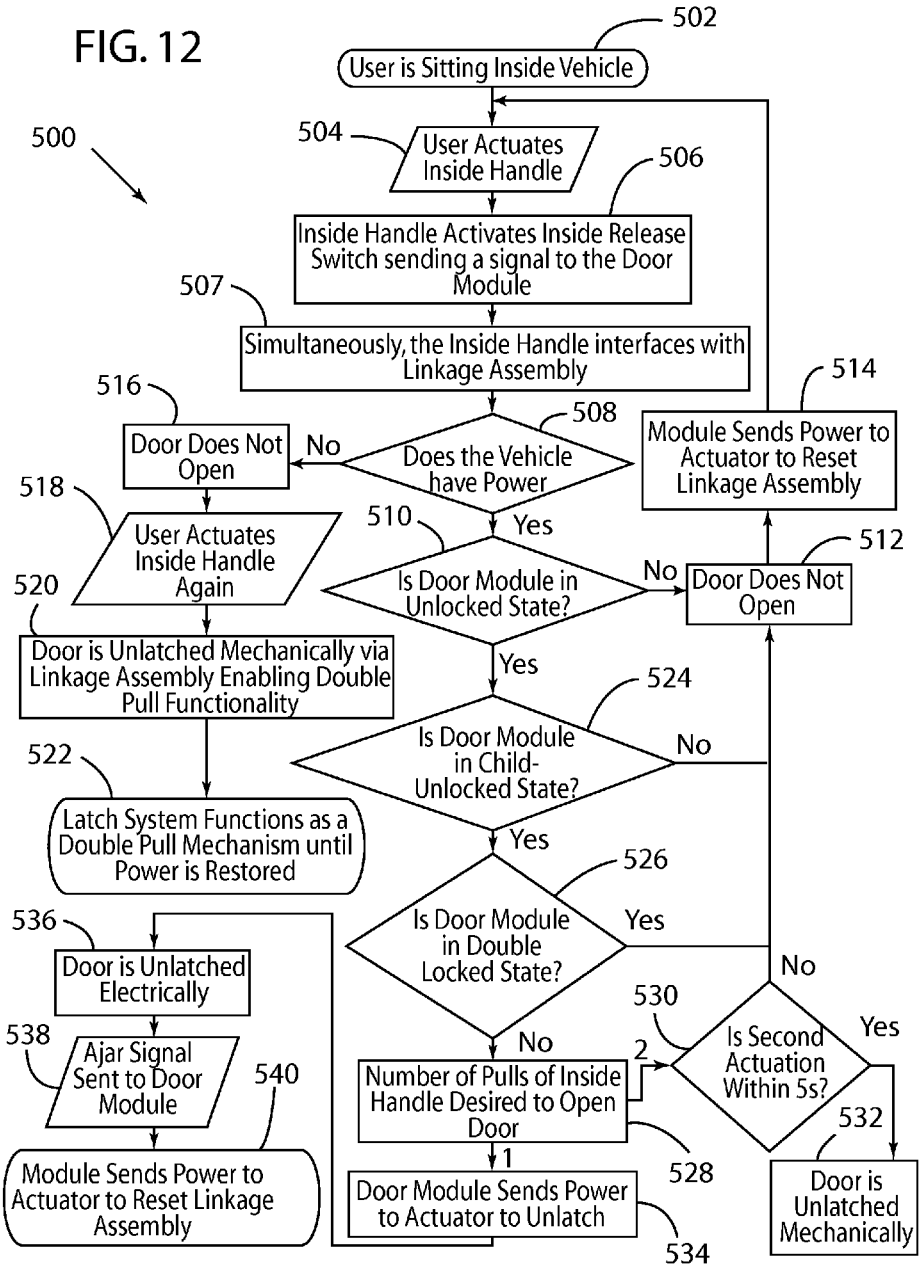
FIG. 12 is a flow chart illustrating a rear door inside release operation.

Referring to FIG. 12, a rear door inside release operation 500 will be described in detail. For rear door inside release operation 500, at step 502, a user is seated inside the vehicle, and at step 504, the user actuates the inside handle 20. At step 506, when the user actuates the inside handle 20, an inside release switch is activated, thus sending a signal to the door module 14. Simultaneously, the inside handle 20 interfaces with the linkage assembly 44 at step 507. At step 508, if the vehicle does not have power, the method continues to step 516. At step 516, the vehicle door does not open until the user actuates the inside handle 20 again at step 518. Thereafter, at step 520, the door is unlatched mechanically via the linkage assembly 44 and the door is moved to the open location (thereby enabling a double pull functionality). Moreover, until the power is restored, the latch system 10 functions as a double pull mechanism at step 522. If the vehicle does have power as determined at step 508, then at step 510, the door module 14 determines if the door module 14 is in an unlocked state. If the determination at step 510 is no, then at step 512, the vehicle door does not open. Thereafter, at step 514, the door module 14 sends a signal to the actuator 18 to reset the linkage assembly 44 by moving the linkage assembly 44 to its initial position of FIG. 3 if it is not in its initial position. If the door module 14 is in the unlocked state as determined at step 510, then at step 524, the door module 14 determines if the door module 14 is in a child-unlocked state. If the determination at step 524 is no, then at step 512, the vehicle door does not open and the actuator resets the linkage assembly 44 at step 514. If the door module 14 is in the child-unlocked state as determined at step 524, then at step 526, the door module 14 determines if the door module 14 is in a double locked state. If the determination at step 526 is yes, then at step 512, the vehicle door does not open and the actuator resets the linkage assembly 44 at step 514. If the determination at step 526 is no (such that the door module 14 is not in a double locked state), the method 500 continues to step 528 where the door module 14 determines the number of actuations of the inside handle 20 desired to open the door. If two actuations are desired as determined at step 528, then the door module 12 determines if the second actuation is within a certain time period (e.g., 5 seconds) at step 530. If the two actuations are within the certain time period, the door is unlatched mechanically (via the linkage assembly 44 as discussed above in regard to FIGS. 3-9) at step 532. However, if the two actuations are not within the certain time period, then at step 512, the vehicle door does not open and the actuator resets the linkage assembly 44 at step 514. If one actuation is desired as determined at step 528, the method 500 continues to step 534 where the door module 14 instructs the actuator 18 to move the linkage assembly 44 to allow the door to move to the open location at step 536 (by moving the pawl 38 as discussed above). Thereafter, at step 538, a signal is sent to the door module 14 telling the door module 14 that the door is ajar (or in the open location) such that the door module 14 can send a signal to the actuator 18 at step 540 to reset the linkage assembly 44 by moving the linkage assembly 44 to its initial position of FIG. 3 if it is not in its initial position.

Figure 13:
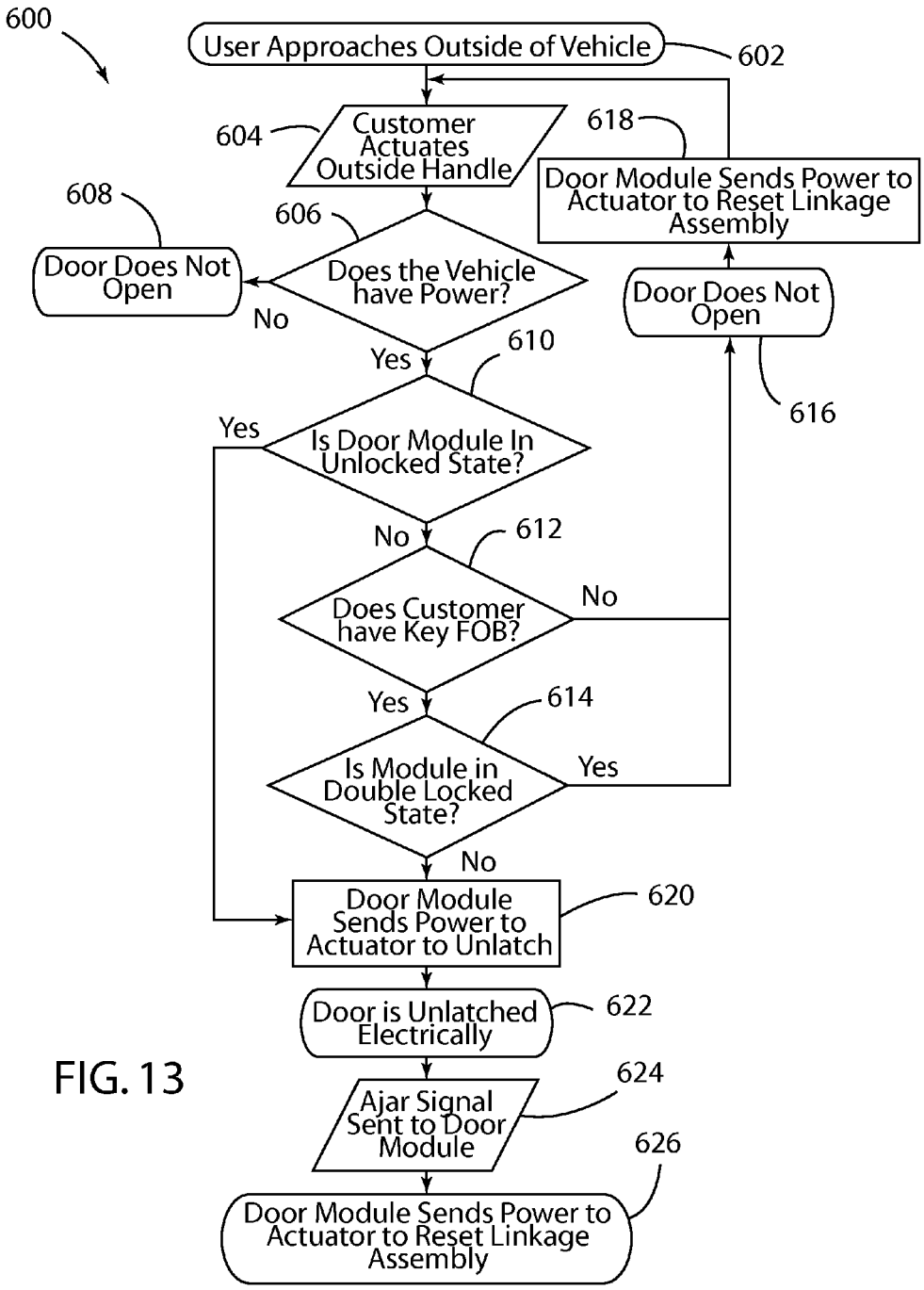
FIG. 13 is a flow chart illustrating a rear door outside release operation.

Referring to FIG. 13, a rear door outside release operation 600 will be described in detail. For rear door outside release operation 600, at step 602, a user approaches an outside of the vehicle, and at step 604, the user actuates the outside handle 22. At step 606, if the vehicle has no power, the method continues to step 608, where the door does not open. If the vehicle does have power as determined at step 606, then at step 610, the door module 14 determines if the door module 14 is an unlocked state. If the determination at step 610 is no, then at step 612, the door module 14 determines if the user has a key FOB for moving the door module 14 to the unlocked state. If the user does not have a key FOB at step 612, then at step 616, the vehicle door does not open. Thereafter, at step 618, the door module 14 sends a signal to the actuator 18 to reset the linkage assembly 44 by moving the linkage assembly 44 to its initial position of FIG. 3 if it is not in its initial position. If the user does have a key FOB at step 612, at step 614, the door module 14 determines if the door module 14 is in a double locked state. If the door module 14 is in the double locked state, then at step 616, the vehicle door does not open and the actuator resets the linkage assembly 44 at step 618. If the determination at step 614 is no (such that the door module 14 is not in a double locked state) or if the determination at step 610 is yes (such that the door module 14 is in an unlocked state), the method 600 continues to step 620 where the door module 14 instructs the actuator 18 to move the linkage assembly 44 to allow the door to move to the open location at step 622 (by moving the pawl 38 as discussed above). Thereafter, at step 624, a signal is sent to the door module 14 telling the door module 14 that the door is ajar (or in the open location) such that the door module 14 can send a signal to the actuator 18 at step 626 to reset the linkage assembly 44 by moving the linkage assembly 44 to its initial position of FIG. 3 if it is not in its initial position.

Figure 14:
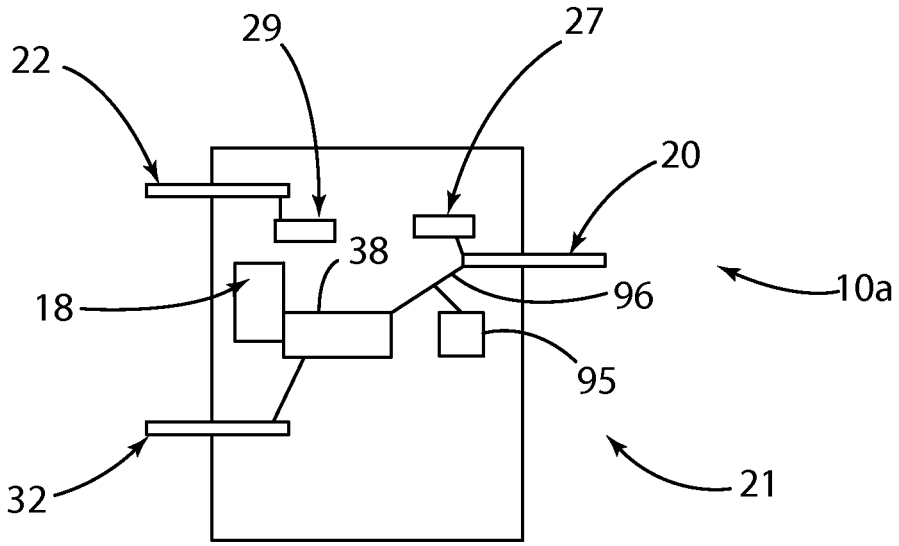
FIG. 14 is a schematic view of a latch system of a second embodiment of the present invention.

The reference numeral 10*a* (FIGS. 14-16) generally designates another embodiment of the present invention, having a second embodiment for the latch system. Since latch system 10*a* is similar to the previously described latch system 10, similar parts appearing in FIGS. 1-13 and FIGS. 14-16, respectively, are represented by the same, corresponding reference number. The second embodiment of the latch system 10*a* is substantially similar to the first embodiment of the latch system 10 except that a linkage assembly 96 between the inside handle 20 and the pawl 38 is a typical connection. As discussed in more detail below, instead of the linkage assembly 44 as discussed above, an electromagnetic lock 95 selectively interconnects the linkage assembly 96 with the pawl 38 and the inside handle 20, and the actuator 18 and the key unlatch cylinder 32 directly interact with the pawl 38 (e.g., by engaging an arm 98 of the pawl 38 to go against the bias of the pawl 38 along line 99 (see FIG. 16)).

Figure 15A:
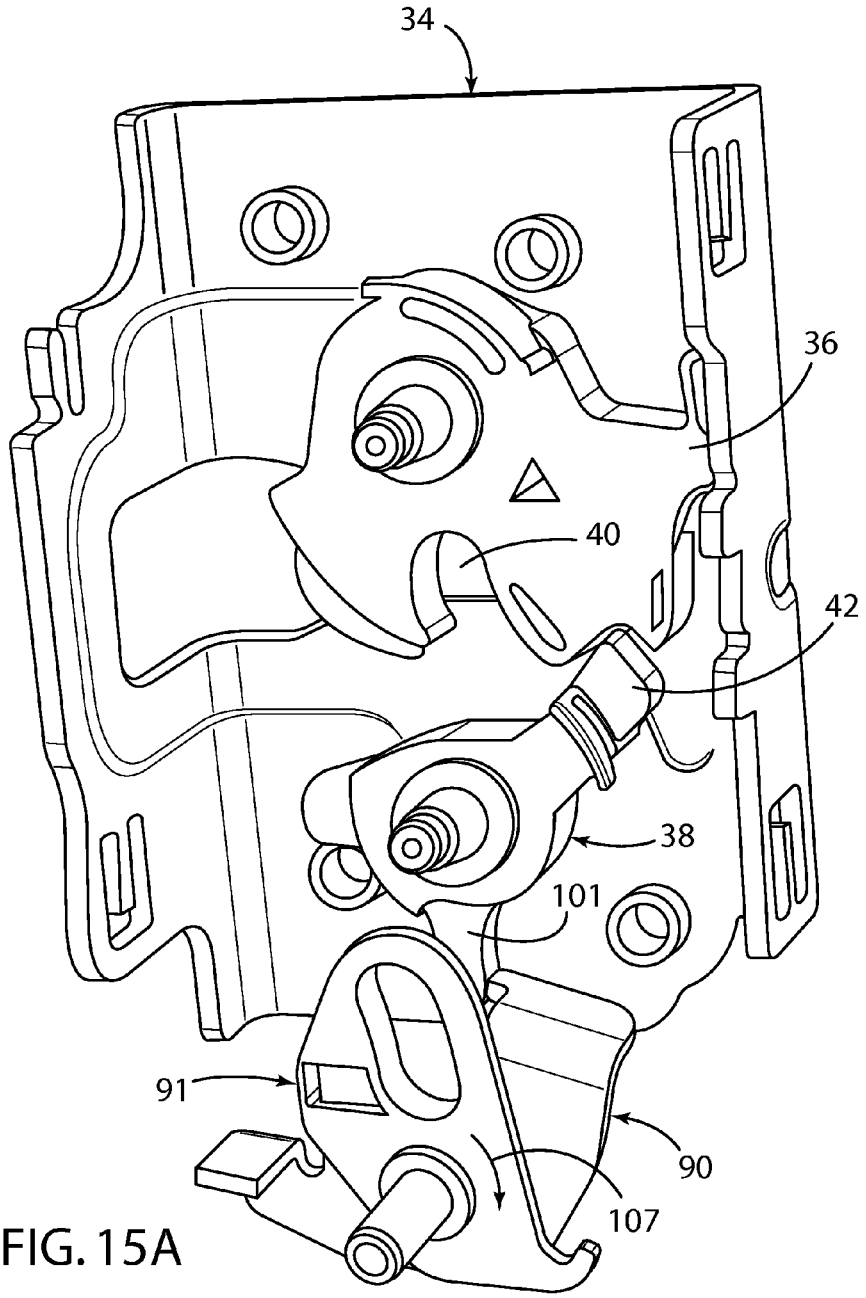
FIG. 15A is a partial perspective view of the typical latch for a door of FIG. 2 illustrating additional elements.
Figure 16:
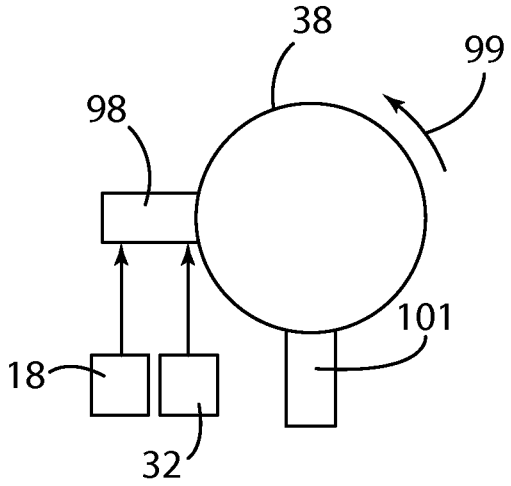
FIG. 16 is a schematic view of the second embodiment of the present invention showing movement of the pawl.

FIG. 15A illustrates the typical latch assembly 34 as discussed above in regard to FIG. 2 along with a release lever 90 and an intermediate release lever 91. The release lever 90 and the intermediate release lever 91 along with their structure and functions are well known to those skilled in the art. As illustrated in FIG. 15A, the release lever 90 and the intermediate release lever 91 are spring loaded away from the pawl 38 of the latch assembly 34 along line 107. The intermediate release lever 91 moves the release lever 90 to have the release lever 90 contact an arm 101 of the pawl 38 to release the catch 36 to thereby stop the pawl 38 from maintaining the catch 36 in the closed position.

Figure 15B:
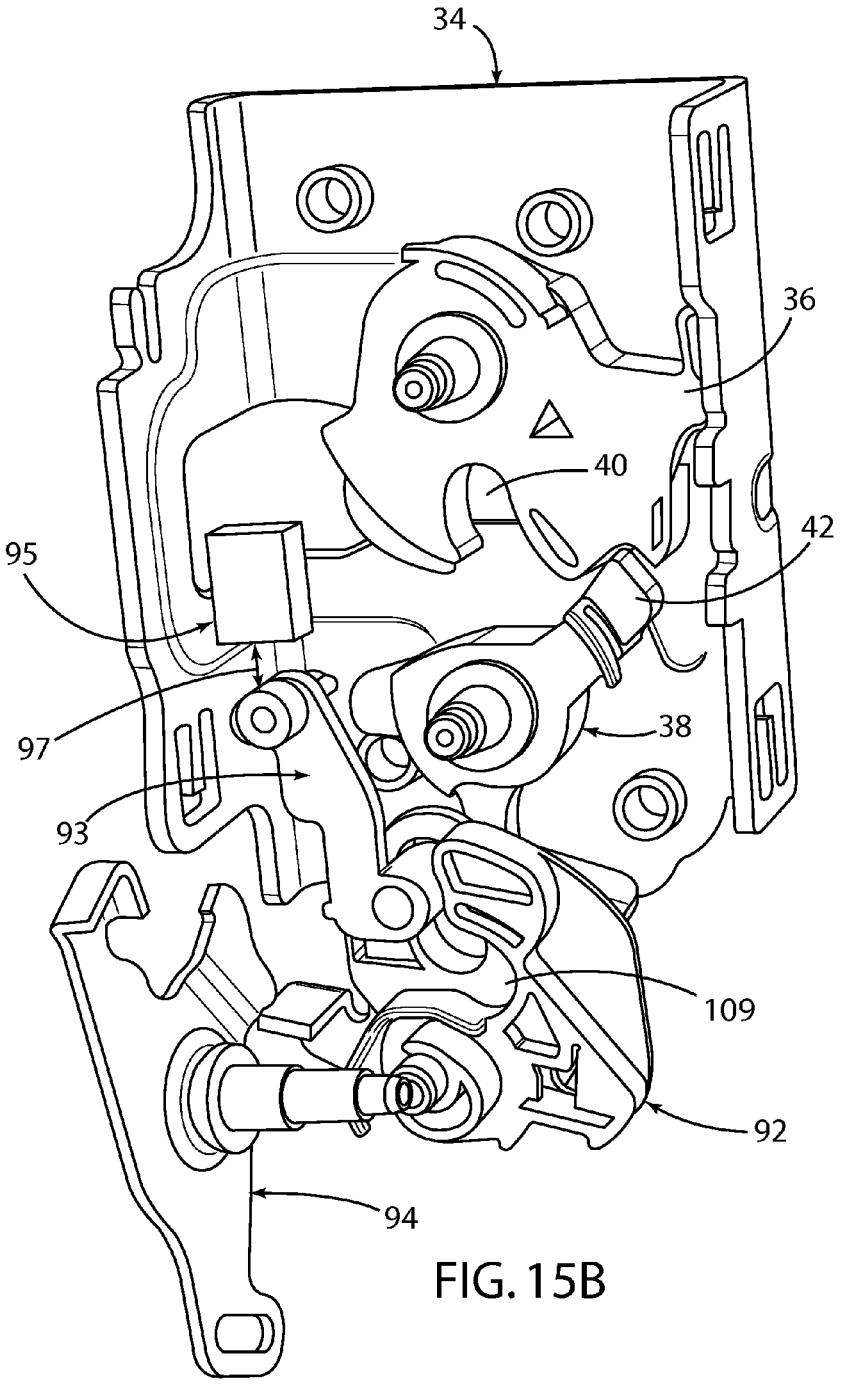
FIG. 15B is a partial perspective view of the typical latch for a door of FIG. 15A illustrating additional elements and an electromagnetic actuator of the second embodiment of the present invention.

FIG. 15B illustrates the typical latch assembly 34 as discussed above in regard to FIG. 15A along with a transition lever 92, a coupling lever 93 and an inside operating lever 94. The transition lever 92, the coupling lever 93 and the inside operating lever 94 along with their structure and functions are well known to those skilled in the art. As is well known to those skilled in the art, actuation of the inside handle 20 will cause the inside operating lever 94 to rotate. As illustrated in FIG. 15B, the coupling lever 93 is configured to move vertically. When the coupling lever 93 is in an unlocked position (up vertically as shown in FIG. 15B), rotation of the inside operating lever 94 will cause the coupling lever 93 to rotate the transition lever 92, thereby rotating the intermediate release lever 91 and the release lever 90 to thereby stop the pawl 38 from maintaining the catch 36 in the closed position. However, when the coupling lever 93 is in a locked position (down vertically as shown in FIG. 15B), rotation of the inside operating lever 94 will cause the coupling lever 93 to rotate, but the coupling lever 93 will move within a slot 109 in the transition lever 92, thereby not moving the transition lever 92 and not stopping the pawl 38 from maintaining the catch 36 in the closed position. As is well known to those skilled in the art, actuation of the inside handle 20 will cause the inside operating lever 94 to rotate. According to the present invention, the electromagnetic lock 95 will move the coupling lever 93 between the unlocked position and the locked position as shown by arrow 97. As used herein, the linkage assembly 96 includes any mechanical elements that can mechanically connect the inside handle 20 to the pawl 38. For example, the linkage mechanism 96 can include the release lever 90, the intermediate release lever 91, the transition lever 92, the coupling lever 93, the inside operating lever 94 and any interconnection between the inside operating lever 94 and the inside handle 20. However, it is contemplated that any of these items may be omitted or changed for the linkage assembly 96.

In the illustrated example, the electromagnetic lock 95 is configured to selectively hold the coupling lever 93 in the locked position such that only actuation of the actuator 18 will move to pawl 38 to unlock the latch. However, it is contemplated that the door module 14 could selectively allow the electromagnetic lock 95 to move the coupling lever 93 to the unlocked position to allow actuation of the inside handle 20 to mechanically move the pawl 38. Furthermore, the coupling lever 93 is biased to the unlocked position such that if the vehicle ever loses power, the electromagnetic lock 95 will no longer hold the coupling lever 93 in the locked position and the coupling lever 93 will move to the unlocked position, thereby allowing actuation of the inside handle 20 to mechanically move the pawl 38.

Referring next to FIGS. 17-20, flowcharts of a vehicle front/rear door inside/outside release operation of the second embodiment of the latch system 10*a* are provided.

Figure 17:
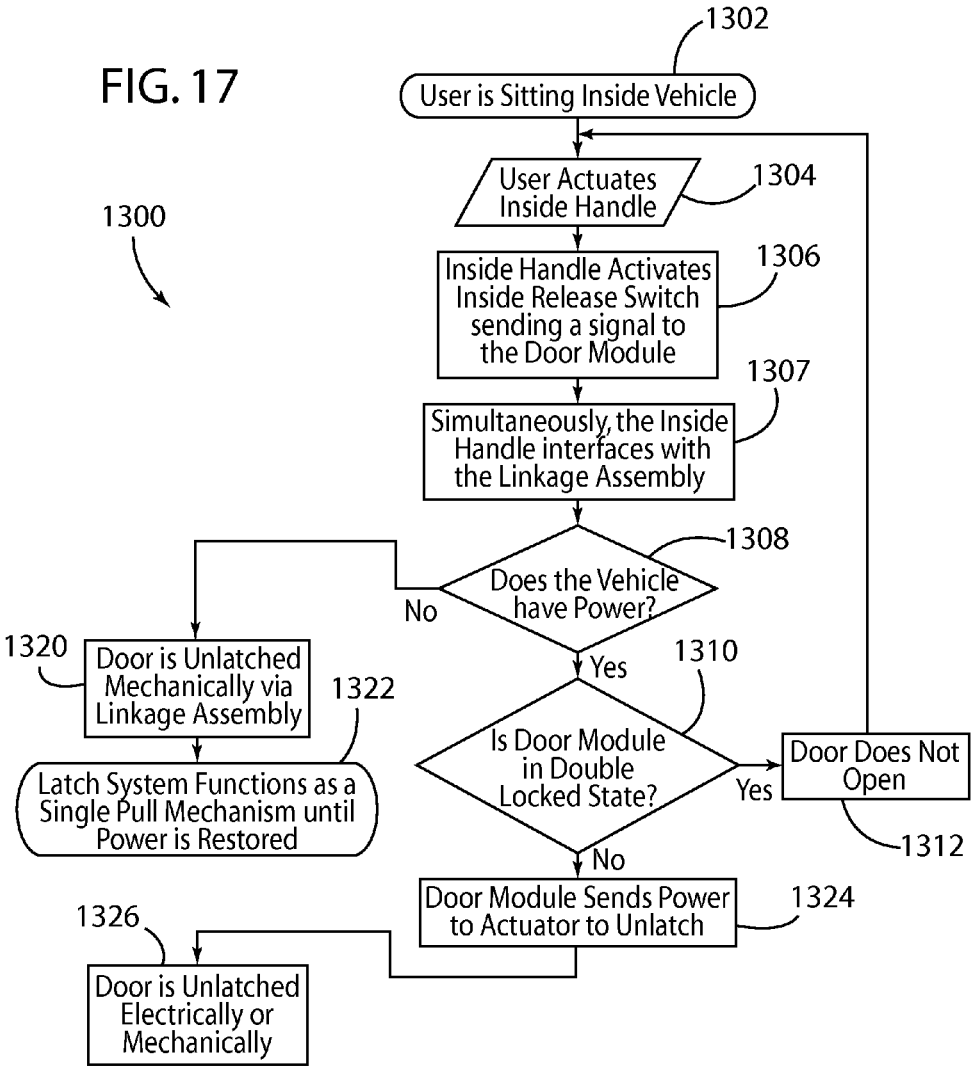
FIG. 17 is a flow chart illustrating a front door inside release operation of the second embodiment of the present invention.

Specifically, referring to FIG. 17, a front door inside release operation 1300 will be described in detail. For front door inside release operation 1300, at step 1302, a user is seated inside the vehicle, and at step 1304, the user actuates the inside handle 20. At step 1306, when the user actuates the inside handle 20, an inside release switch 27 is activated, thus sending a signal to the door module 14. Simultaneously, the inside handle 20 interfaces with the linkage assembly 96 at step 1307. At step 1308, if the vehicle has power, the method continues to step 1310. At step 1310, the door module 14 determines if the door module 14 is in a double locked state. If the determination at step 1308 is yes, then at step 1312, the vehicle door does not open. If the vehicle does not have power as determined at step 1308, then at step 1320, the door is unlatched mechanically via the linkage assembly 96 (as the electromagnetic lock 95 no longer maintains the door in a locked condition as discussed above) and the door is moved to the open location (thereby enabling a single pull functionality). Moreover, until the power is restored, the latch system 10*a* functions as a single pull mechanism at step 1322. If the determination at step 1310 is no (such that the door module 14 is not in a double locked state), the method 1300 continues to step 1324 where the door module 14 instructs the actuator 18 to move pawl 38 to allow the door to move to the open location at step 1326. It is noted that if it is desired to have the door open only after every two pulls of the inside handle 20, the door module 14 can be set to activate the actuator 18 only after every two pulls of the inside handle 20.

Figure 18:
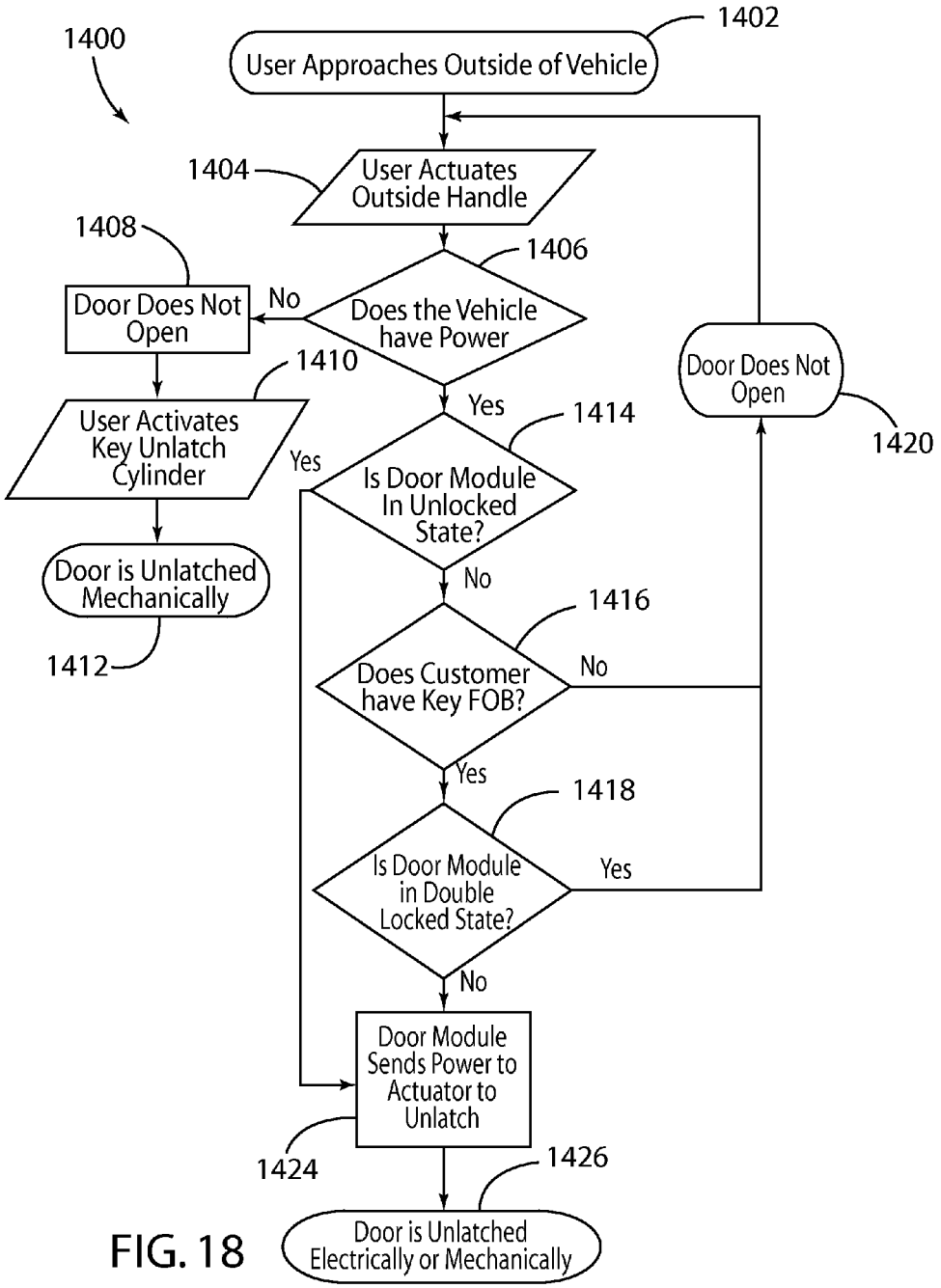
FIG. 18 is a flow chart illustrating a front door outside release operation of the second embodiment of the present invention.

Referring to FIG. 18, a front door outside release operation 1400 will be described in detail. For front door outside release operation 1400, at step 1402, a user approaches an outside of the vehicle, and at step 1404, the user actuates the outside handle 22. At step 1406, if the vehicle has no power, the method continues to step 1408. At step 1408, the door does not open until the user actuates the key unlatch cylinder 32 at step 1410 to mechanically move the door to the open location at step 1412. If the vehicle does have power as determined at step 1406, then at step 1414, the door module 14 determines if the door module 14 is in an unlocked state. If the determination at step 1414 is no, then at step 1416, the door module 14 determines if the user has a key FOB for moving the door module 14 to the unlocked state. If the user does not have a key FOB at step 1416, then at step 1420, the vehicle door does not open. If the user does have a key FOB at step 1416, at step 1418, the door module 14 determines if the door module 14 is a double locked state. If the door module 14 is in the double locked state, then at step 1420, the vehicle door does not open. If the determination at step 1418 is no (such that the door module 14 is not in a double locked state) or if the determination at step 1414 is yes (such that the door module 14 is in an unlocked state), the method 1400 continues to step 1424 where the door module 14 instructs the actuator 18 to move the pawl 38 to allow the door to move to the open location at step 1426.

Figure 19:
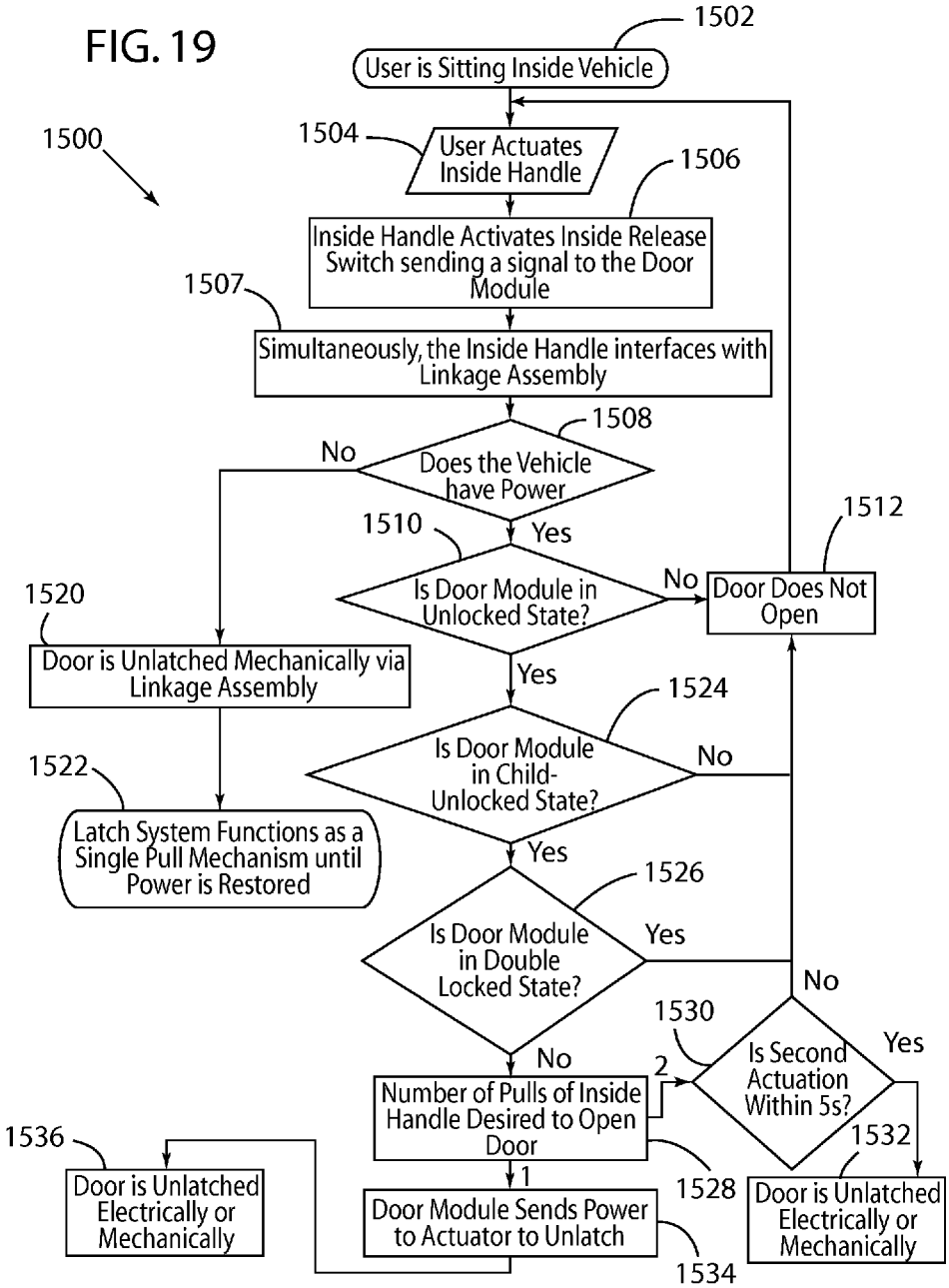
FIG. 19 is a flow chart illustrating a rear door inside release operation of the second embodiment of the present invention.

Referring to FIG. 19, a rear door inside release operation 1500 will be described in detail. For rear door inside release operation 1500, at step 1502, a user is seated inside the vehicle, and at step 1504, the user actuates the inside handle 20. At step 1506, when the user actuates the inside handle 20, an inside release switch is activated, thus sending a signal to the door module 14. Simultaneously, the inside handle 20 interfaces with the linkage assembly 96 at step 1507. At step 1508, if the vehicle does not have power, the method continues to step 1520. At step 1520, the door is unlatched mechanically via the linkage assembly 96 (as the electromagnetic lock 95 no longer maintains the door in a locked condition as discussed above) and the door is moved to the open location (thereby enabling a single pull functionality). Moreover, until the power is restored, the latch system 10 functions as a single pull mechanism at step 1522. If the vehicle does have power as determined at step 1508, then at step 1510, the door module 14 determines if the door module 14 is in an unlocked state. If the determination at step 1510 is no, then at step 1512, the vehicle door does not open. If the door module 14 is in the unlocked state as determined at step 1510, then at step 1524, the door module 14 determines if the door module 14 is in a child-unlocked state. If the determination at step 1524 is no, then at step 1512, the vehicle door does not open. If the door module 14 is in the child-unlocked state as determined at step 1524, then at step 1526, the door module 14 determines if the door module 14 is in a double locked state. If the determination at step 1526 is yes, then at step 1512, the vehicle door does not open. If the determination at step 1526 is no (such that the door module 14 is not in a double locked state), the method 1500 continues to step 1528 where the door module 14 determines the number of actuations of the inside handle 20 desired to open the door. If two actuations are desired as determined at step 1528, then the door module 14 determines if the second actuation is within a certain time period (e.g., 5 seconds) at step 1530. If the two actuations are within the certain time period, the door is unlatched mechanically (via the linkage assembly 96 as discussed above) or electrically using the actuator 18 at step 1532. However, if the two actuations are not within the certain time period, then at step 1512, the vehicle door does not open. If one actuation is desired as determined at step 1528, the method 1500 continues to step 1534 where the door module 14 instructs the actuator 18 to move the pawl 38 to allow the door to move to the open location at step 1536 or the inside handle 20 mechanically moves the pawl 38 using the linkage assembly 96 as discussed above (with the electromagnetic lock 95 being deactivated).

Figure 20:
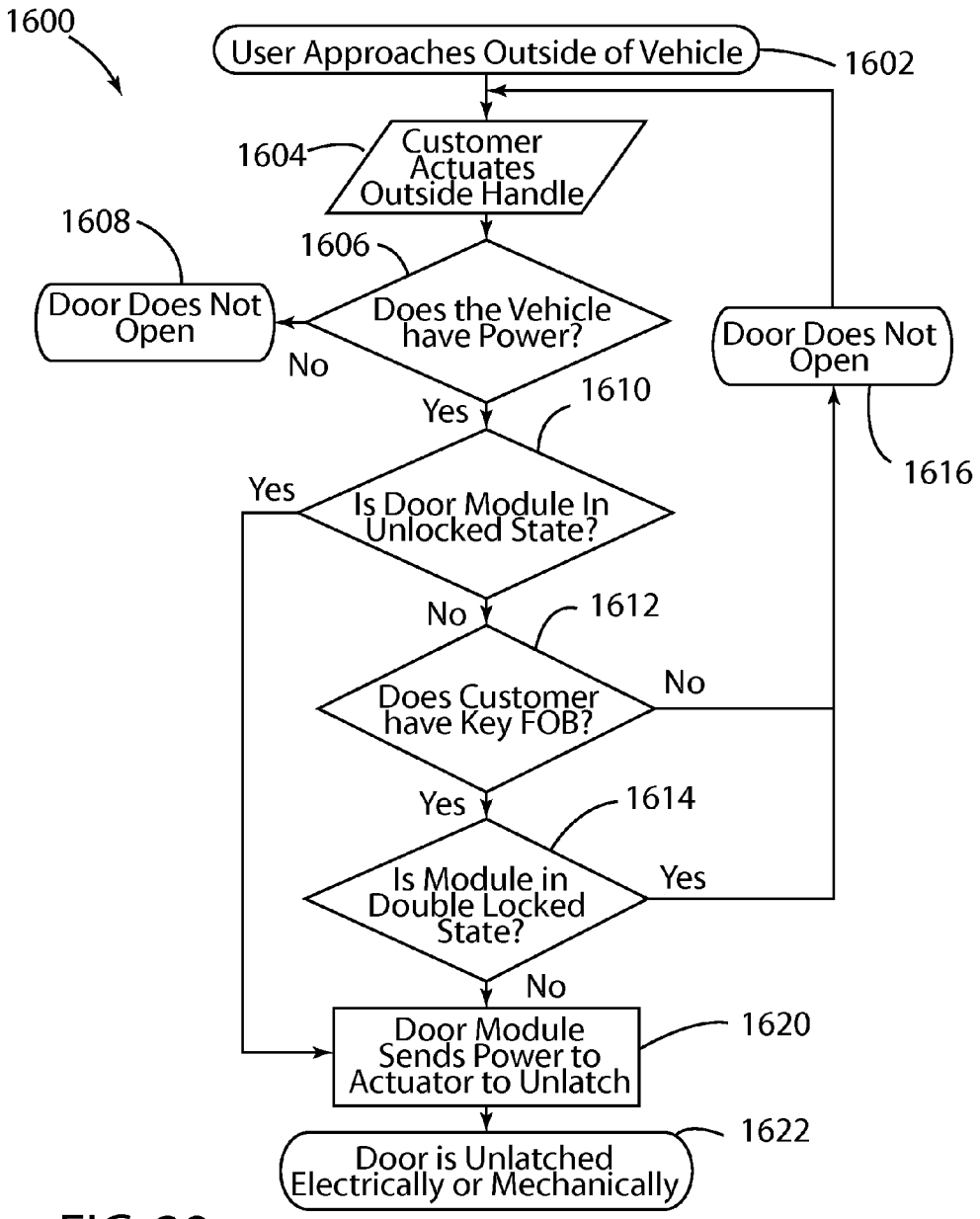
FIG. 20 is a flow chart illustrating a rear door outside release operation of the second embodiment of the present invention.

Referring to FIG. 20, a rear door outside release operation 1600 will be described in detail. For rear door outside release operation 1600, at step 1602, a user approaches an outside of the vehicle, and at step 1604, the user actuates the outside handle 22. At step 1606, if the vehicle has no power, the method continues to step 1608, where the door does not open. If the vehicle does have power as determined at step 1606, then at step 1610, the door module 14 determines if the door module 14 is in an unlocked state. If the determination at step 1610 is no, then at step 1612, the door module 14 determines if the user has a key FOB for moving the door module 14 to the unlocked state. If the user does not have a key FOB at step 1612, then at step 1616, the vehicle door does not open. If the user does have a key FOB at step 1612, at step 1614, the door module 14 determines if the door module 14 is in a double locked state. If the door module 14 is in the double locked state, then at step 1616, the vehicle door does not open. If the determination at step 1614 is no (such that the door module 14 is not in a double locked state) or if the determination at step 1610 is yes (such that the door module 14 is in an unlocked state), the method 1600 continues to step 1620 where the door module 14 instructs the actuator 18 to move the pawl 38 to allow the door to move to the open location or the inside handle 20 mechanically moves the pawl 38 using the linkage assembly 96 as discussed above (with the electromagnetic lock 95 being deactivated) at step 1622.

To summarize, latch systems 10 and **10*a* thus provide a universal door latching system which may be readily operable by electronic door module 14 for meeting different government regulations or customer requirements. For example, the latch systems 10 and 10*a* may be operable to include a rear door latch override as allowed in Europe, and maintain the rear door latch override function for the U.S. or similar markets. The latch systems 10 and 10*a* may also be readily adaptable for feature upgrades (e.g., power child locks, fast unlock, etc.), and require minimal modifications for design aspects involving mounting hole patterns, electrical connectors, rod versus handles, etc. Thus, the latch systems 10 and 10*a*** provide a common front and side door latch system on a global scale, while also reducing product development time, costs and tooling related to side door latches.

The latch systems may support both fixed and moving outside handle applications with no change to the latch. Yet further, as also discussed above, the door module 14 may provide multiple functionalities depending on the signal(s) received from the outside and inside release handles upon activation. In a particular embodiment, the outside handle may be a purely electrical release. Yet further, the latch assembly 12 may include no lock levers, and the latch system 10 may be purely within the memory of the door module 14. The power child lock function may be provided by the logic of the door module 14, with no additional motors or child-lock levers in the latch assembly 12.

The reference number (FIG. 21) generally designates another latch system of the present invention. The latch system 2010 can be used in any vehicle having doors and includes a latch assembly 2012 for each door, with each latch assembly 2012 being configured to keep their associated door closed or to allow their associated door to open. In a preferred embodiment, all of the latch assemblies 2012 in the vehicle are substantially identical. However, it is contemplated that not all of the latch assemblies 2012 need to be substantially identical (e.g., the front doors can have different latch assemblies 2012 than the rear doors or all doors can have different latch assemblies 2012).

Figure 21:
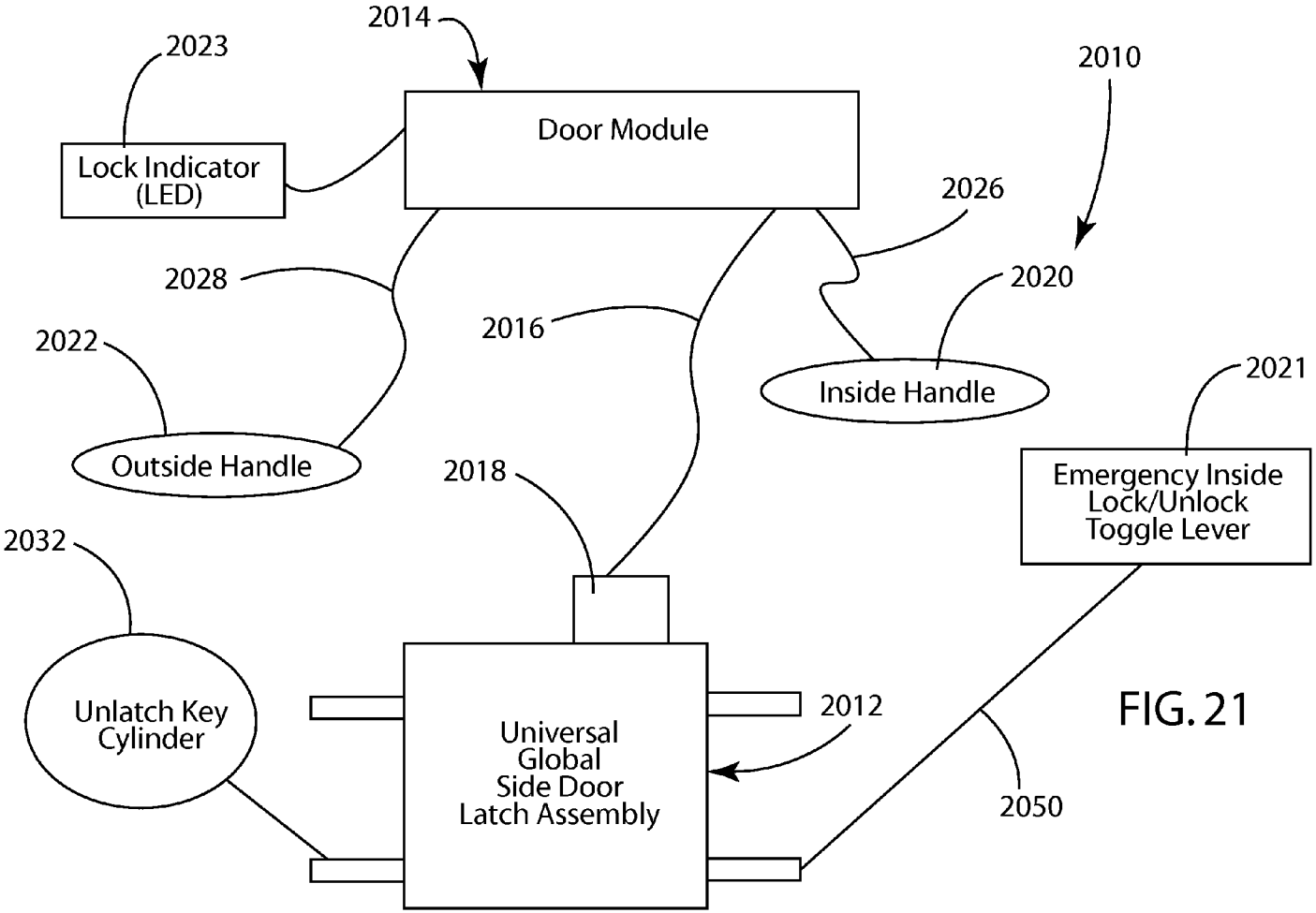
FIG. 21 is a schematic view of a latch system of the present invention.

In the illustrated example, the latch system 2010 can be used in a vehicle having a centralized control system for controlling the latch assemblies 2012 for all doors of the vehicle or a control system for controlling the latch assembly 2012 for a single door. The centralized control system can be used to open a door, to keep the door closed or to provide certain functionality to the latch assembly (for example, locking, unlocking, child-locking, double locking, etc.) for a particular door or for each latch assembly 2012. Accordingly, the structure of the latch assemblies 2012 for each of the doors can be structurally identical, with the centralized control system individually and selectively altering the functionality for each door. As illustrated in FIG. 21, a door module 14 represents the control system for the latch assembly 2012. The door module 2014 can be connected to one latch assembly 2012 for one door (as shown) or can be connected to multiple latch assemblies 2012 for multiple doors. The door module 2014 can include a microprocessor and a memory unit and communicates with the latch assembly 2012 via an electrical control line 2016 (either wired or wireless). For example, the electrical control line 16 can include a single-control bus with a return through a common chassis ground.

In the illustrated embodiment, each of the latch assemblies 2012 can be associated with a respective control and driver circuit including a microprocessor which is, in turn, associated with an actuator 2018 as discussed in more detail below. The actuator 2018 may be connected to the driver circuit through a bistable relay. The circuits can include or can be programmed to be demultiplexers for receiving serial control signals transmitted over the electrical control line 2016 and for converting them to control signals for the actuator 2018. Correspondingly, the door module 2014 can have its microprocessor programmed to constitute a multiplexer or can include a separate multiplexer. While the system as thus far described uses unidirectional information or control signal flow, a bidirectional signal transmission is also possible. For example, the processors of the circuits can dialogue with the door module 2014 and can transmit signals indicating the state of the respective latch assembly 2012 to the door module 2014. Each of the processors of the control and driver circuits can be provided with a lock identity code word storage or memory. Correspondingly, the door module 2014 can have a memory for storage connected to its central processor and serving as control system identity code word storage. Each of the identity code word memories or storage has a respective identity code word stored therein and can output this code word upon interrogation so that the code words can be compared with one another. Upon a failure of agreement between interrogated identity code words, the latch assemblies 2012 are automatically brought into the "antitheft securing mode on" and "child-safety mode on" positions and deactivated to prevent opening of the door. Alternatively or simultaneously, the door module 2014 can be deactivated.

The illustrated latch system 2010 as illustrated in FIG. 21 includes the latch assembly 2012 connected to the door module 2014 via the electrical control line 16 as discussed above. The latch assembly 2012 also includes an inside handle 2020 located within an interior of the vehicle and an outside handle 2022 located at an exterior of the vehicle. The inside handle 2020 electrically communicates with the door module 2014 via an inside handle electrical control line 2026 (either wired or wireless). In the illustrated embodiment, the outside handle 2022 also electrically communicates with the door module 2014 via an outside handle electrical control line 2028 (either wired or wireless). The door module 2014 receives signals from the inside handle 2020 or the outside handle 2022 and can send a signal to the actuator 2018 instructing the actuator 2018 to actuate the latch assembly 2012 to allow the door of the vehicle to open. Accordingly, all features of the latch assembly 2012 can be maintained in the programming of the door module 2014. For example, the door module 2014 can determine that the latch assembly 2012 is locked such that the latch assembly 2012 will not open on only actuation of the inside handle 2020 or the outside handle 2022. Therefore, the latch assembly 2012 will not need structure for keeping the latch assembly 2012 in a locked condition—the door module 2014 keeps the latch assembly 2012 in the locked condition. Other features of the latch assembly 2012 (e.g., child locks) can also be controlled by the door module 2014 such that the structure of every latch assembly 2012 in a vehicle can be identical. An emergency inside lock/unlock toggle lever 2021 can be actuated to open the door as discussed in more detail below. Moreover, the latch system 2010 can also include an unlatch key cylinder 2032 mechanically connected to the latch assembly 2012 for allowing the latch assembly 2012 to allow its associated door to open from an exterior of the vehicle. It is contemplated that only the driver side door, the front doors or all the doors could include the unlatch key cylinder 2032.

Figure 22:
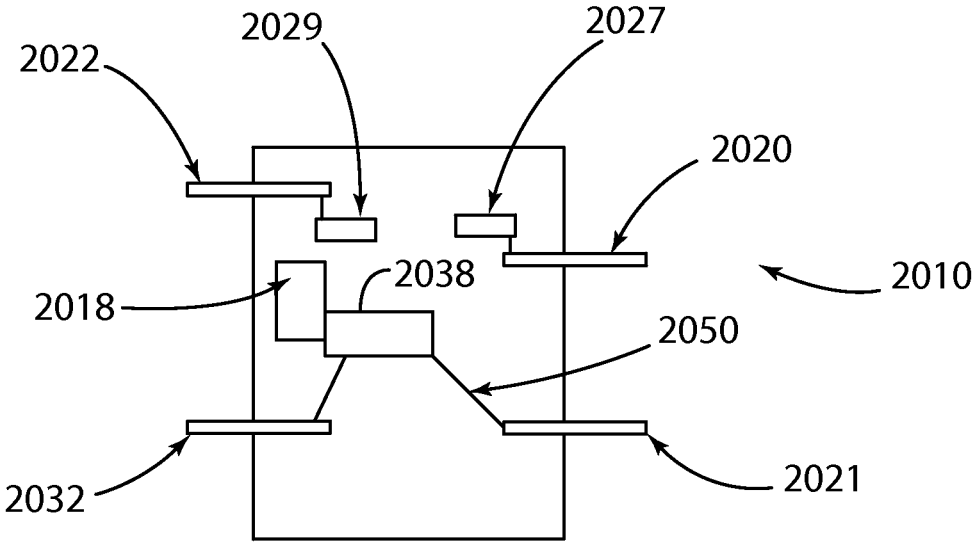
FIG. 22 is another schematic view of the latch system of the present invention.
Figure 23:
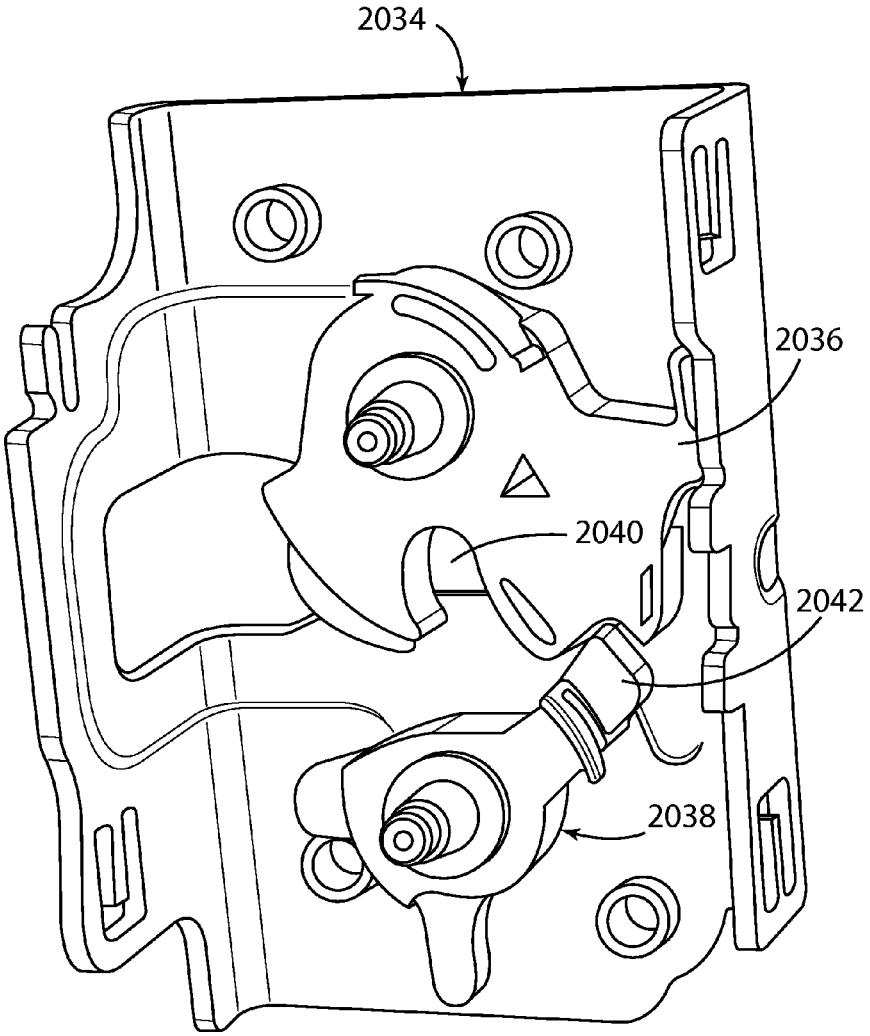
FIG. 23 is a partial perspective view of a typical latch for a door.

In the illustrated example, the latch assembly 2012 (FIG. 23) is configured to maintain the door in a closed location and to allow the door to move to an open location. The latch assembly 2012 includes a latch housing 2034 having a catch 2036 and a pawl 2038. As is well known to those skilled in the art, the catch 2036 includes a slot 2040 configured to selectively accept a post (not shown) of a vehicle frame to maintain the door in the closed location. FIG. 22 illustrates the catch 2036 in a closed position wherein the post of the vehicle would be trapped within the slot 2040 such that the door is maintained in the closed location. The pawl 2038 is configured to maintain the catch 2036 in the closed position by having an extension 2042 of the pawl 2038 abut against the catch 2036 to prevent rotation of the catch 2036. The pawl 2038 is configured to rotate clockwise as shown in FIG. 22 to allow the catch 2036 to rotate. Once the pawl 2038 moves out of engagement with the catch 2036, the catch 2036 is configured to rotate clockwise as shown in FIG. 22 to an open position to release the post of the vehicle frame, thereby allowing the door to move to an open location. The structure and function of the catch 2036 and the pawl 2038 as discussed directly above are well known to those skilled in the art. An aspect of the present invention is to include the emergency inside lock/unlock toggle lever 2021 for allowing the inside handle 2020 to selectively and mechanically interact with the latch assembly 2012.

FIG. 22 illustrates a schematic drawing of the latch system 2010 of the present invention. As illustrated in FIG. 22, the inside handle 2020 is configured to actuate an inside switch 2027 that sends a signal to the door module 2014 (via the inside handle electrical control line 2026) telling the door module 2014 that someone inside the vehicle desires the door to move to the open location. Under the correct conditions as discussed below, the door would then move to the open location. Likewise, the outside handle 2022 is configured to actuate an outside switch 2029 that sends a signal to the door module 2014 (via the outside handle electrical control line 2028) telling the door module 2014 that someone outside the vehicle desires the door to move to the open location. Under the correct conditions as discussed below, the door would then move to the open location. After actuation of the inside handle 2020 or the outside handle 2022, the door module 2014 will send a signal to the actuator 2018 via the electrical control line 2016 telling the actuator 2018 to activate to thereby move the pawl 2038 to stop the pawl 2038 from maintaining the catch 2036 in the closed position, thereby allowing the door to move to the open location. Moreover, the pawl 2038 can be moved mechanically to thereby stop maintaining the catch 2036 in the closed position by actuation of the emergency inside lock/unlock toggle lever 2021 or by actuation of the unlatch key cylinder 2032.

Figure 24:
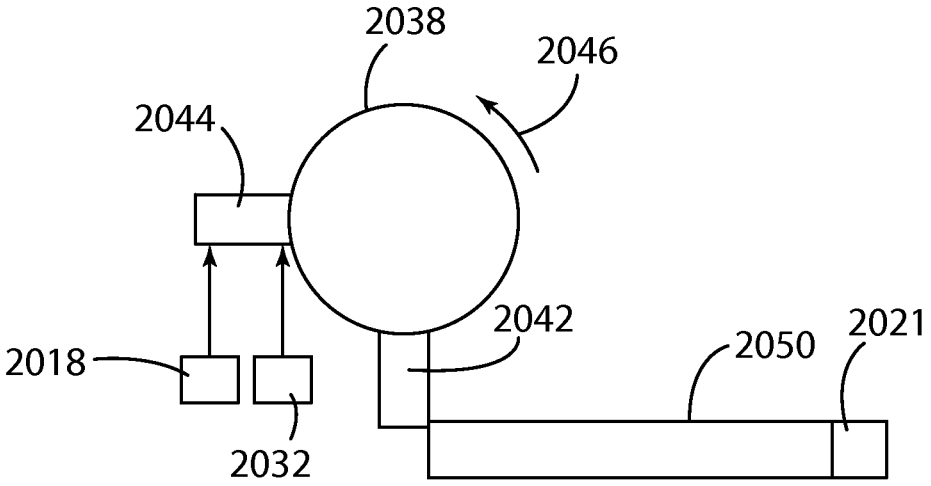
FIG. 24 is a schematic view of the present invention showing movement of a pawl of the present invention.

It is also contemplated that the illustrated latch system 2010 can have the actuator 2018 mechanically engaged with the pawl 2038 and configured to move the pawl 2038 to stop the pawl 2038 from maintaining the catch 2036 in the closed position, thereby allowing the door to move to the open location. It is contemplated that the actuator 2018 could include any element for moving the pawl 2038 (e.g., a rotary actuator or a linear actuator). FIG. 24 illustrates an example of the actuator moving the pawl 2038. In FIG. 24, the actuator 2038 is a linear actuator configured to move a prong 2044 on the pawl 2038 such that the pawl 2038 moves in a clock-wise direction to overcome a biasing force 2046 applied to the pawl 2038. Therefore, the actuator 2018 can be activated to open the door by moving the pawl 2038 via movement of the prong 2044 on the pawl 2038. Accordingly, the catch 2036 would move to the open position, thereby allowing the door to move to the open location. The actuator 2018 can also be employed to prevent the pawl 2038 from moving by maintaining the prong 2044 of the pawl 2038 in its initial position as illustrated in FIG. 24.

The illustrated actuator 2018 can be activated by a signal from the door module 2014. For example, the actuator 2018 can be activated to open the door by actuation of the inside handle 2020 or the outside handle 2022. It is also contemplated that the door module 2014 could receive a remote signal such that the door automatically opens (for example, with a button on a key chain wirelessly sending a signal to the door module 2014 telling the door module 2014 to open the door). The actuator 2018 can also be used to prevent the door from moving to the open location (e.g., when the door module 2014 is set in a child-lock state) by continuously moving the prong 2044 of the pawl 2038 back to its initial position to prevent the pawl 2038 from rotating. It is noted that the actuator 2018 only works when the vehicle has power (or when the actuator 2018 is powered). Therefore, when the vehicle (or actuator 2018) does not have power, the door can only be moved to the open location from the inside using the emergency inside lock/unlock toggle lever 2021.

In the illustrated example, the emergency inside lock/unlock toggle lever 2021 comprises a member that is actuated to mechanically move the pawl 2038. The emergency inside lock/unlock toggle lever 2021 is located within the interior of the vehicle and can be manually actuated. It is contemplated that the emergency inside lock/unlock toggle lever 2021 could include any element for moving the pawl 2038. FIG. 24 illustrates an example of the emergency inside lock/unlock toggle lever 2021 for moving the pawl 2038. In FIG. 24, the emergency inside lock/unlock toggle lever 2021 comprises an elongated member 2050 connected to the pawl 2038. When the emergency inside lock/unlock toggle lever 2021 is activated, the emergency inside lock/unlock toggle lever 2021 is moved along a line to move an extension 2042 on the pawl 2038 such that the pawl 2038 moves in a clock-wise direction to overcome the biasing force 2046 applied to the pawl 2038. Therefore, the emergency inside lock/unlock toggle lever 2021 can be activated to open the door by moving the pawl 2038 via movement of the extension 2042 on the pawl 2038. Accordingly, the catch 2036 would move to the open position, thereby allowing the door to move to the open location.

In the illustrated example, the unlatch key cylinder 2032 functions similar to the actuator 2018. The unlatch key cylinder 2032 allows a person outside the vehicle to open the door. The unlatch key cylinder 2032 is mechanically engaged with the pawl 2038. The unlatch key cylinder 2032 is configured to accept a key of a user of the vehicle. The unlatch key cylinder 2032 can comprise a typical cylinder lock. The unlatch key cylinder 2032 is configured to move the pawl 2038 in the same manner the actuator 2018 moves the pawl 2038. For example, the unlatch key cylinder 2032 can move the prong 2044 or the extension 2042 of the pawl 2038. Therefore, the unlatch key cylinder 2032 can be used to open the door by moving the pawl 2038. Accordingly, the catch 2036 would move to the open position, thereby allowing the door to move to the open location.

Referring next to FIGS. 25-28, flowcharts of a vehicle front/rear door inside/outside release operation are provided.

Figure 25:
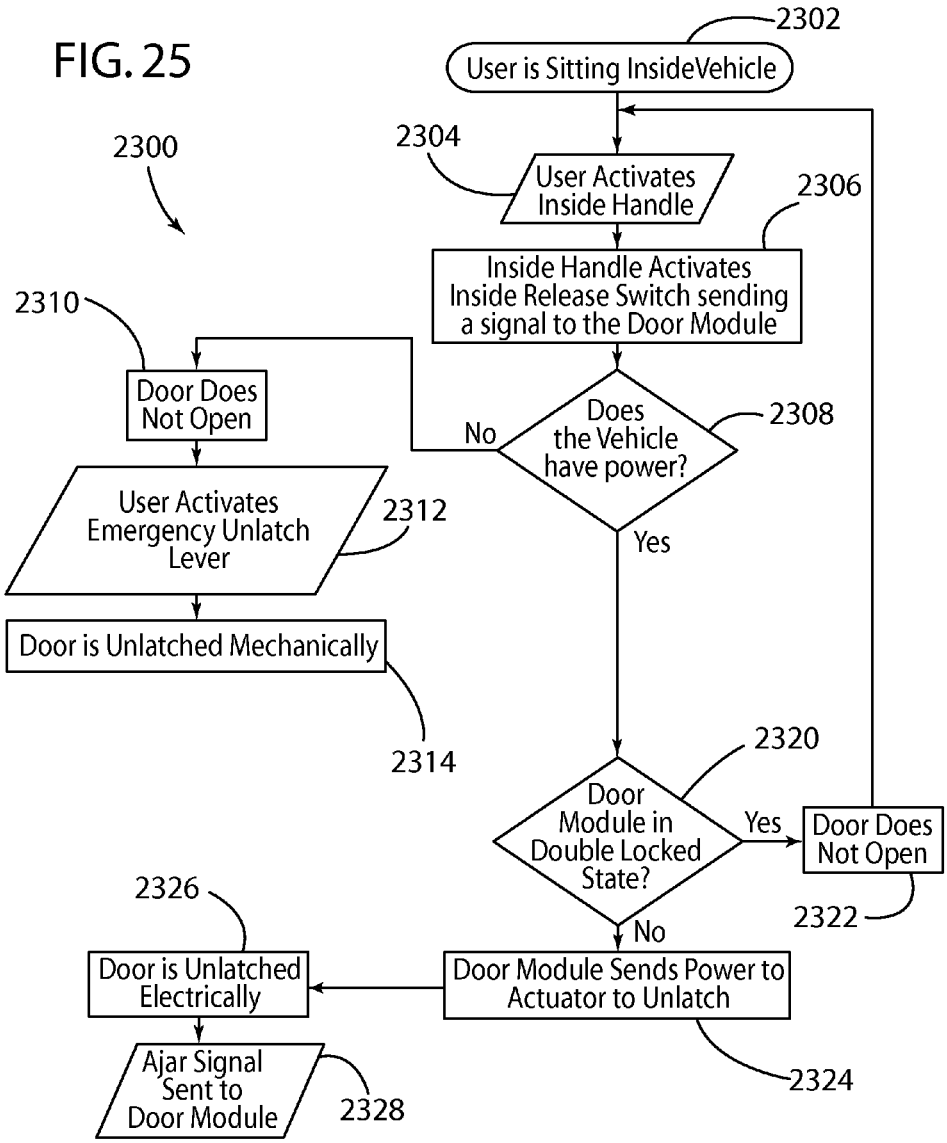
FIG. 25 is a flow chart illustrating a front door inside release operation.

Specifically, referring to FIG. 25, a front door inside release operation 2300 will be described in detail. For front door inside release operation 2300, at step 2302, a user is seated inside the vehicle, and at step 2304, the user actuates the inside handle 2020. At step 2306, when the user actuates the inside handle 2020, the inside release switch 2027 is activated, thus sending a signal to the door module 2014. At step 2308, if the vehicle has power, the method continues to step 2320. At step 320, the door module 2014 determines if the door module 2014 is in a double locked state. If the determination at step 2320 is yes, then at step 2322, the vehicle door does not open. If the vehicle does not have power as determined at step 2308, then at step 2310, the vehicle door does not open until the user activates the emergency inside lock/unlock toggle lever 2021 at step 2312. Thereafter, at step 2314, the door is unlatched mechanically. It is noted that the emergency inside lock/unlock toggle lever 21 can reset when the door is closed. If the determination at step 2318 is yes (such that the emergency inside lock/unlock toggle lever 2021 is activated, the method continues to step 2314 wherein the door is unlatched mechanically and then to step 2316 wherein the emergency inside lock/unlock toggle lever 2021 resets. If the determination at step 2320 is no (such that the door module 2014 is not in a double locked state), the method 2300 continues to step 2324 where the door module 2014 instructs the actuator 2018 to allow the door to move to the open location at step 2326 (by moving the pawl 2038 as discussed above). Thereafter, at step 2328, a signal is sent to the door module 2014 telling the door module 2014 that the door is ajar (or in the open location) such that the door module 2014 can send a signal to the actuator 2018 to reset the pawl 2038 once the door is closed.

Figure 26:
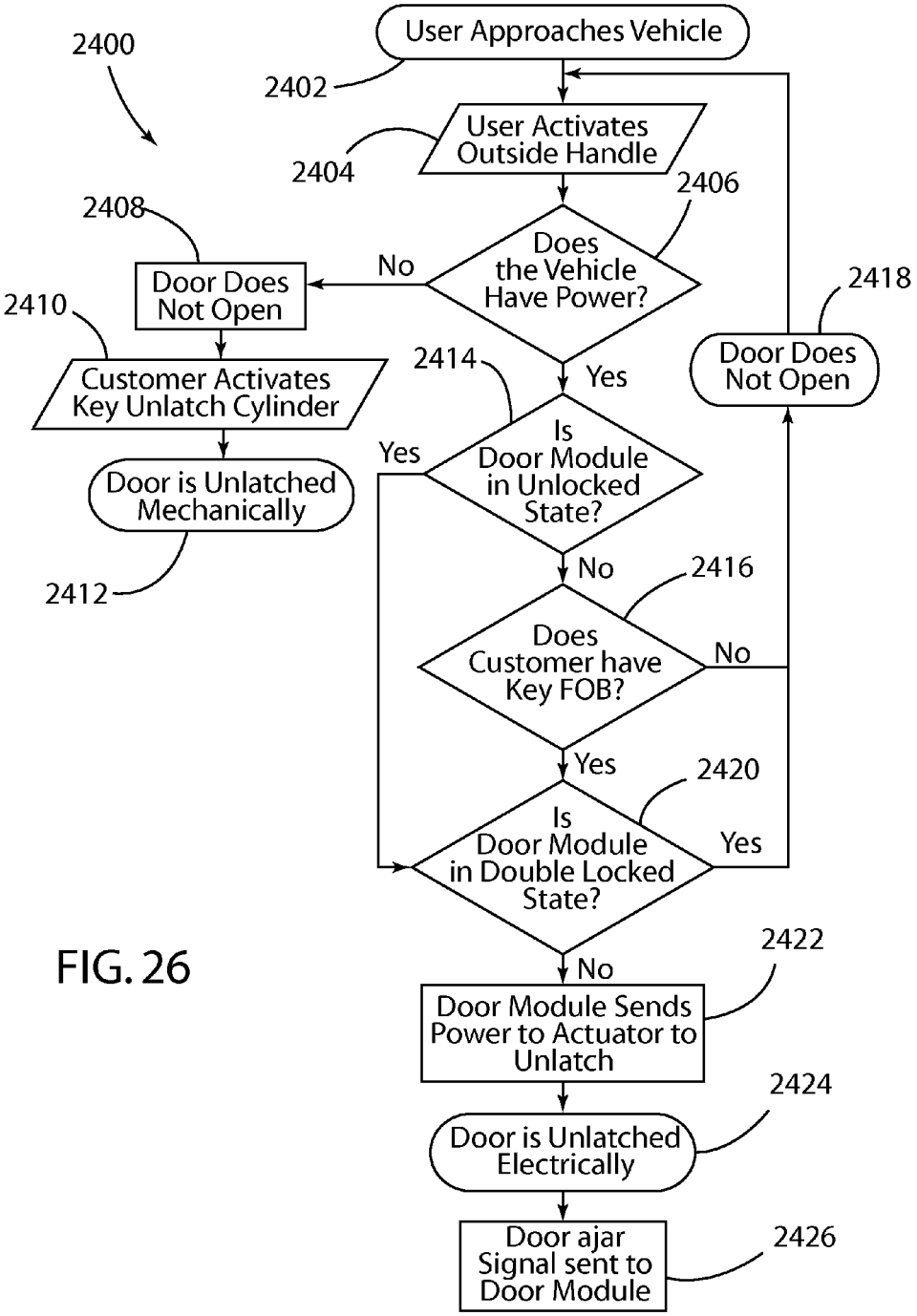
FIG. 26 is a flow chart illustrating a front door outside release operation.

Referring to FIG. 26, a front door outside release operation 2400 will be described in detail. For front door outside release operation 2400, at step 2402, a user approaches an outside of the vehicle, and at step 2404, the user actuates the outside handle 2022. At step 2406, if the vehicle has no power, the method continues to step 2408. At step 2408, the door does not open until the user actuates the key unlatch cylinder 2032 at step 2410 to mechanically move the door to the open location at step 2412. If the vehicle does have power as determined at step 2406, then at step 2414, the door module 2014 determines if the door module 2014 is in an unlocked state. If the determination at step 2414 is no, then at step 2416, the door module 2014 determines if the user has a key FOB for moving the door module 2014 to the unlocked state. If the user does not have a key FOB at step 2416, then at step 2418, the vehicle door does not open. If the user does have a key FOB at step 2416, at step 2418, the door module 2014 determines if the door module 2014 is a double locked state. If the door module 2014 is in the double locked state, then at step 2418, the vehicle door does not open. If the determination at step 2420 is no (such that the door module 2014 is not in a double locked state) or if the determination at step 2414 is yes (such that the door module 2014 is in an unlocked state), the method 2400 continues to step 2422 where the door module 2014 instructs the actuator 2018 to allow the door to move to the open location at step 2424 (by moving the pawl 2038 as discussed above). Thereafter, at step 2426, a signal is sent to the door module 2014 telling the door module 14 that the door is ajar (or in the open location) such that the door module 2014 can send a signal to the actuator 2018 to reset the pawl 2038 once the door is closed.

Figure 27:
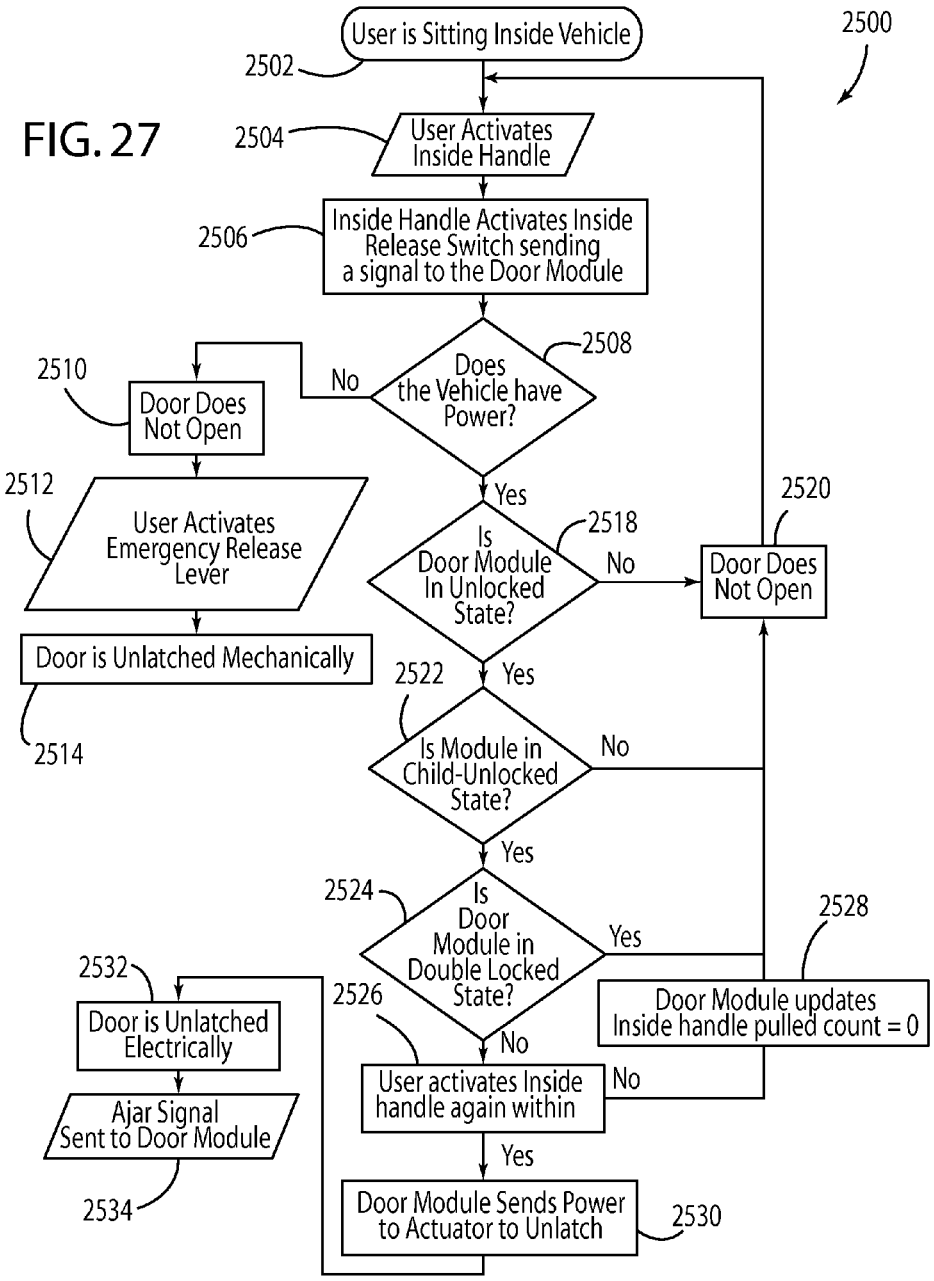
FIG. 27 is a flow chart illustrating a rear door inside release operation.

Referring to FIG. 27, a rear door inside release operation 2500 will be described in detail. For rear door inside release operation 2500, at step 2502, a user is seated inside the vehicle, and at step 2504, the user actuates the inside handle 2020. At step 2506, when the user actuates the inside handle 2020, an inside release switch 2027 is activated, thus sending a signal to the door module 2014. At step 2508, if the vehicle does not have power, the method continues to step 2510. At step 2510, the vehicle door does not open until the user activates the emergency inside lock/unlock toggle lever 2021 at step 2512. Thereafter, at step 2514, the door is unlatched mechanically. It is noted that the emergency inside lock/ unlock toggle lever 2021 can reset when the door is closed. If the vehicle does have power as determined at step 2508, then at step 2518, the door module 2014 determines if the door module 2014 is in an unlocked state. If the determination at step 2510 is no, then at step 2520, the vehicle door does not open. If the door module 2014 is in the unlocked state as determined at step 20518, then at step 2522, the door module 2014 determines if the door module 2014 is in a child-unlocked state. If the determination at step 2522 is no, then at step 2520, the vehicle door does not open. If the door module 2014 is in the child-unlocked state as determined at step 2522, then at step 2524, the door module 2014 determines if the door module 2014 is in a double locked state. If the determination at step 2524 is yes, then at step 2520, the vehicle door does not open. If the determination at step 2524 is no (such that the door module 2014 is not in a double locked state), the method 2500 continues to step 2526 where the door module 2014 determines the user has actuated the inside handle 2020 again within a certain time period (e.g., 5 seconds) of the first actuation of the inside handle 2020. If the inside handle 2020 has not been actuated a second time within the certain time period, the method continues first to step 2528 wherein the door module 2014 updates an inside handle actuation count (within its memory) to zero (such that the next actuation of the inside handle will be considered the first actuation of the inside handle 2020) and then to step 2520 wherein the door does not open. If the determination at step 2526 determines that the inside handle 2020 was actuated a second time within the certain time period, the method 2500 continues to step 2530 where the door module 2014 instructs the actuator 2018 to allow the door to move to the open location at step 2532 (by moving the pawl 2038 as discussed above). Thereafter, at step 2534, a signal is sent to the door module 2014 telling the door module 2014 that the door is ajar (or in the open location) such that the door module 2014 can send a signal to the actuator 2018 to reset the pawl 2038 once the door is closed. It is noted that if it is desired to have the door open with only one actuation of the inside handle 2020, the method 2500 can proceed from step 2524 directly to step 2530 if the vehicle is not in the double locked state.

Figure 28:
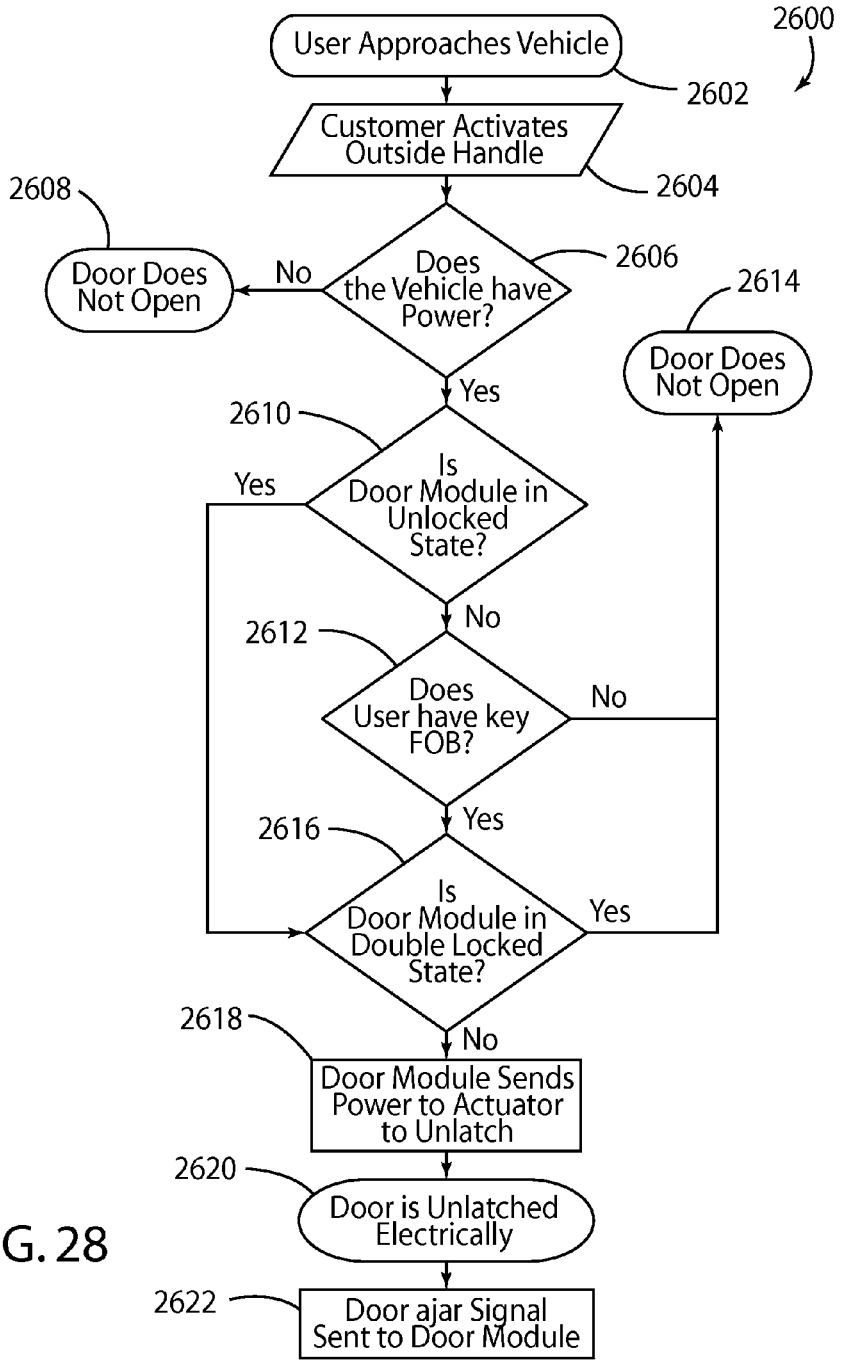
FIG. 28 is a flow chart illustrating a rear door outside release operation.

Referring to FIG. 28, a rear door outside release operation 2600 will be described in detail. For rear door outside release operation 2600, at step 2602, a user approaches an outside of the vehicle, and at step 2604, the user actuates the outside handle 2022. At step 2606, if the vehicle has no power, the method continues to step 2608, where the door does not open. If the vehicle does have power as determined at step 2606, then at step 2610, the door module 2014 determines if the door module 2014 is an unlocked state. If the determination at step 2610 is no, then at step 2612, the door module 2014 determines if the user has a key FOB for moving the door module 2014 to the unlocked state. If the user does not have a key FOB at step 2612, then at step 2614, the vehicle door does not open. If the user does have a key FOB at step 2612, then at step 2616, the door module 2014 determines if the door module 2014 is in a double locked state. If the door module 2014 is in the double locked state, then at step 2614, the vehicle door does not open. If the determination at step 2616 is no (such that the door module 2014 is not in a double locked state) or if the determination at step 2610 is yes (such that the door module 2014 is in an unlocked state), the method 2600 continues to step 2618 where the door module 2014 instructs the actuator 2018 to allow the door to move to the open location at step 2620 (by moving the pawl 2038 as discussed above). Thereafter, at step 2622, a signal is sent to the door module 2014 telling the door module 2014 that the door is ajar (or in the open location) such that the door module 2014 can send a signal to the actuator 2018 reset the pawl 2038 once the door is closed.

To summarize, latch system 2010 thus provides a universal door latching system which may be readily operable by electronic door module 2014 for meeting different government regulations or customer requirements. For example, the latch system 2010 may be operable to include a rear door latch override as allowed in Europe, and maintain the rear door latch override function for the U.S. or similar markets. The latch system 2010 may also be readily adaptable for feature upgrades (e.g., power child locks, fast unlock, etc.), and require minimal modifications for design aspects involving mounting hole patterns, electrical connectors, rod versus handles, etc. Thus, the latch system 2010 provides a common front and side door latch system on a global scale, while also reducing product development time, costs and tooling related to side door latches.

The latch system may support both fixed and moving outside handle applications with no change to the latch. Yet further, as also discussed above, the door module 2014 may provide multiple functionalities depending on the signal(s) received from the outside and inside release handles upon activation. In a particular embodiment, the outside handle may be a purely electrical release. Yet further, the latch assembly 2012 may include no lock levers, and the latch system 2010 may be purely within the memory of the door module 2014. The power child lock function may be provided by the logic of the door module 2014, with no additional motors or child-lock levers in the latch assembly 2012.

The reference number 3010 (FIG. 29) generally designates a latch system of the present invention. The latch system 3010 can be used in any vehicle having doors and includes a latch assembly 3012 for each door, with each latch assembly 3012 being configured to keep their associated door closed or to allow their associated door to open. In a preferred embodiment, all of the latch assemblies 3012 in the vehicle are substantially identical. However, it is contemplated that not all of the latch assemblies 3012 need to be substantially identical (e.g., the front doors can have different latch assemblies 3012 than the rear doors or all doors can have different latch assemblies 3012).

Figure 29:
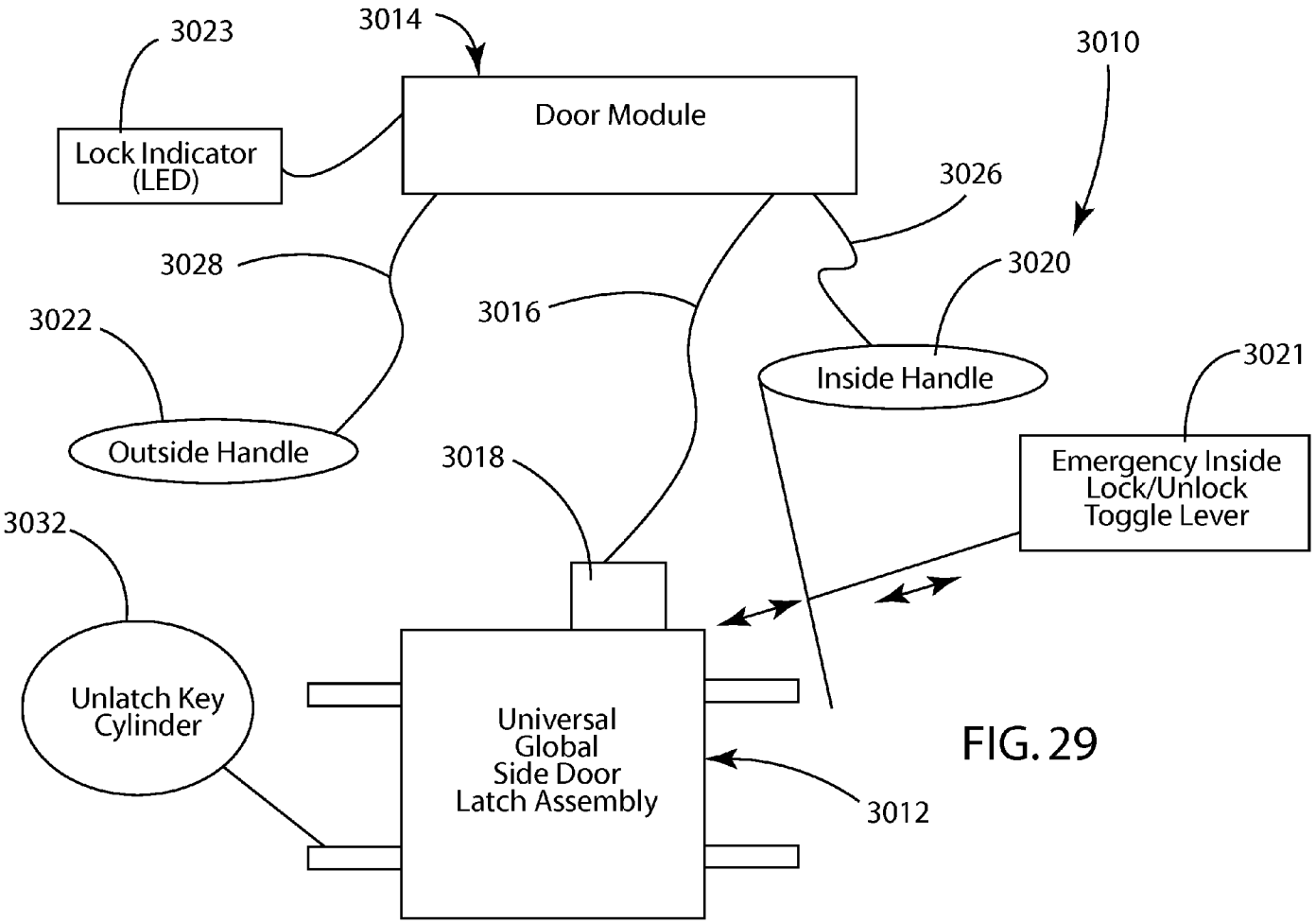
FIG. 29 is a schematic view of a latch system of the present invention.

In the illustrated example, the latch system 3010 can be used in a vehicle having a centralized control system for controlling the latch assemblies 3012 for all doors of the vehicle or a control system for controlling the latch assembly 3012 for a single door. The centralized control system can be used to open a door, to keep the door closed or to provide certain functionality to the latch assembly (for example, locking, unlocking, child-locking, double locking, etc.) for a particular door or for each latch assembly 3012. Accordingly, the structure of the latch assemblies 3012 for each of the doors can be structurally identical, with the centralized control system individually and selectively altering the functionality for each door. As illustrated in FIG. 29, a door module 3014 represents the control system for the latch assembly 3012. The door module 3014 can be connected to one latch assembly 3012 for one door (as shown) or can be connected to multiple latch assemblies 3012 for multiple doors. The door module 3014 can include a microprocessor and a memory unit and communicates with the latch assembly 3012 via an electrical control line 3016 (either wired or wireless). For example, the electrical control line 3016 can include a single-control bus with a return through a common chassis ground.

In the illustrated embodiment, each of the latch assemblies 3012 can be associated with a respective control and driver circuit including a microprocessor which is, in turn, associated with an actuator 3018 as discussed in more detail below. The actuator 3018 may be connected to the driver circuit through a bistable relay. The circuits can include or can be programmed to be demultiplexers for receiving serial control signals transmitted over the electrical control line 3016 and for converting them to control signals for the actuator 3018. Correspondingly, the door module 3014 can have its microprocessor programmed to constitute a multiplexer or can include a separate multiplexer. While the system as thus far described uses unidirectional information or control signal flow, a bidirectional signal transmission is also possible. For example, the processors of the circuits can dialogue with the door module 3014 and can transmit signals indicating the state of the respective latch assembly 3012 to the door module 3014. Each of the processors of the control and driver circuits can be provided with a lock identity code word storage or memory. Correspondingly, the door module 3014 can have a memory for storage connected to its central processor and serving as control system identity code word storage. Each of the identity code word memories or storage has a respective identity code word stored therein and can output this code word upon interrogation so that the code words can be compared with one another. Upon a failure of agreement between interrogated identity code words, the latch assemblies 3012 are automatically brought into the "antitheft securing mode on" and "child-safety mode on" positions and deactivated to prevent opening of the door. Alternatively or simultaneously, the door module 14 can be deactivated.

The illustrated latch system 3010 as illustrated in FIG. 29 includes the latch assembly 3012 connected to the door module 3014 via the electrical control line 3016 as discussed above. The latch assembly 3012 also includes an inside handle 3020 located within an interior of the vehicle and an outside handle 3022 located at an exterior of the vehicle. The inside handle 3020 electrically communicates with the door module 3014 via an inside handle electrical control line 3026 (either wired or wireless). In the illustrated embodiment, the outside handle 3022 also electrically communicates with the door module 3014 via an outside handle electrical control line 3028 (either wired or wireless). The door module 3014 receives signals from the inside handle 3020 or the outside handle 3022 and can send a signal to the actuator 3018 instructing the actuator 3018 to actuate the latch assembly 3012 to allow the door of the vehicle to open. Accordingly, all features of the latch assembly 3012 can be maintained in the programming of the door module 3014. For example, the door module 3014 can determine that the latch assembly 3012 is locked such that the latch assembly 3012 will not open on only actuation of the inside handle 3020 or the outside handle 3022. Therefore, the latch assembly 3012 will not need structure for keeping the latch assembly 3012 in a locked condition—the door module 3014 keeps the latch assembly 3012 in the locked condition. Other features of the latch assembly 3012 (e.g., child locks) can also be controlled by the door module 3014 such that the structure of every latch assembly 3012 in a vehicle can be identical. The inside handle 3020 can be mechanically connected to the latch assembly 3012 via an emergency inside lock/unlock toggle lever 3021 as discussed in more detail below. Moreover, the latch system 3010 can also include an unlatch key cylinder 3032 mechanically connected to the latch assembly 3012 for allowing the latch assembly 3012 to allow its associated door to open from an exterior of the vehicle. It is contemplated that only the driver side door, the front doors or all the doors could include the unlatch key cylinder 3032.

Figure 31:
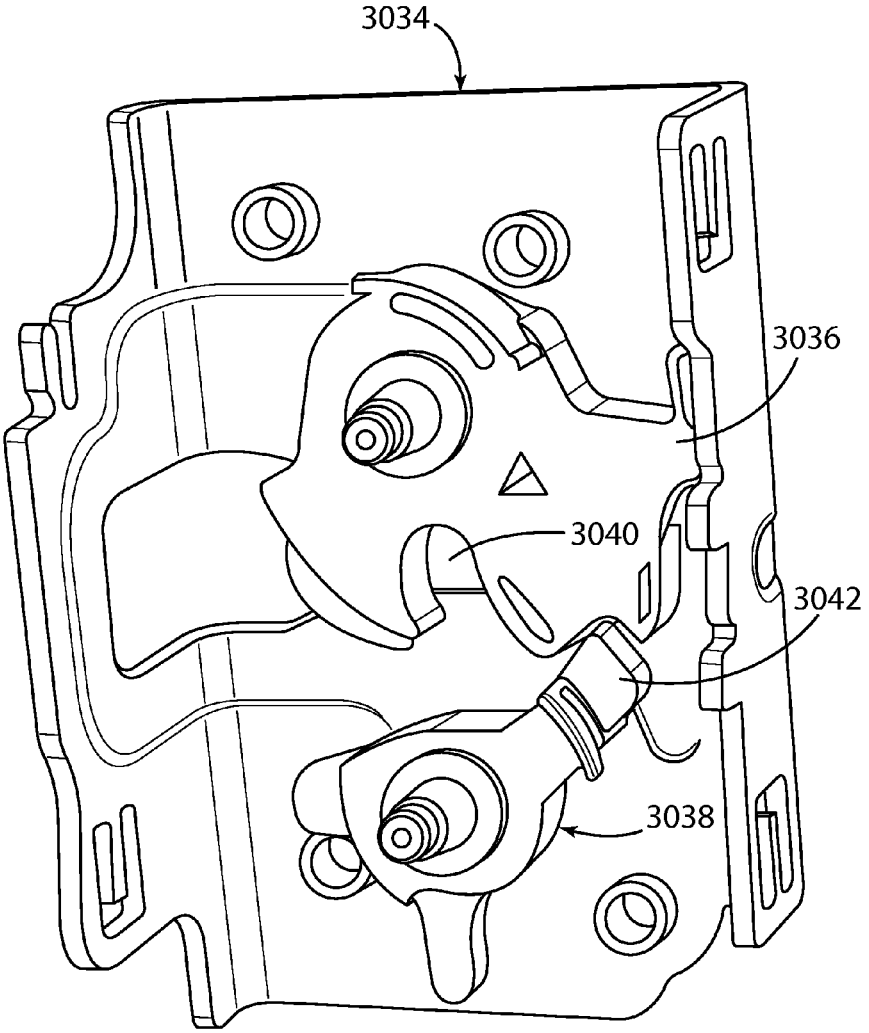
FIG. 31 is a partial perspective view of a typical latch for a door.

In the illustrated example, the latch assembly 3012 (FIG. 31) is configured to maintain the door in a closed location and to allow the door to move to an open location. The latch assembly 3012 includes a latch housing 3034 having a catch 3036 and a pawl 3038. As is well known to those skilled in the art, the catch 3036 includes a slot 3040 configured to selectively accept a post (not shown) of a vehicle frame to maintain the door in the closed location. FIG. 31 illustrates the catch 3036 in a closed position wherein the post of the vehicle would be trapped within the slot 3040 such that the door is maintained in the closed location. The pawl 3038 is configured to maintain the catch 3036 in the closed position by having an extension 3042 of the pawl 3038 abut against the catch 3036 to prevent rotation of the catch 3036. The pawl 3038 is configured to rotate clockwise as shown in FIG. 31 to allow the catch 3036 to rotate. Once the pawl 3038 moves out of engagement with the catch 3036, the catch 3036 is configured to rotate clockwise as shown in FIG. 31 to an open position to release the post of the vehicle frame, thereby allowing the door to move to an open location. The structure and function of the catch 3036 and the pawl 3038 as discussed directly above are well known to those skilled in the art. An aspect of the present invention is to include the emergency inside lock/unlock toggle lever 3021 for allowing the inside handle 3020 to selectively and mechanically interact with the latch assembly 3012.

Figure 30:
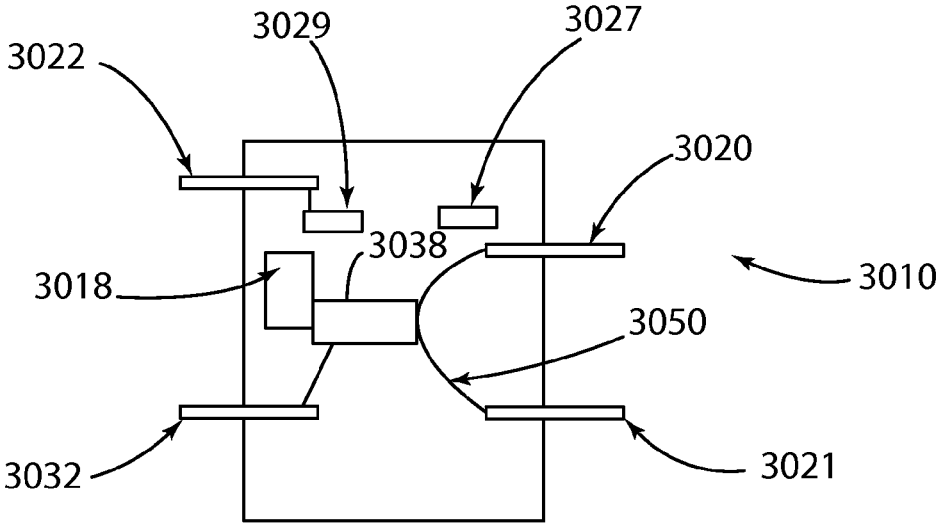
FIG. 30 is another schematic view of the latch system of the present invention.

FIG. 30 illustrates a schematic drawing of the latch system 3010 of the present invention. As illustrated in FIG. 30, the inside handle 3020 is configured to actuate an inside switch 3027 that sends a signal to the door module 3014 (via the inside handle electrical control line 3026) telling the door module 3014 that someone inside the vehicle desires the door to move to the open location. Under the correct conditions as discussed below, the door would then move to the open location. Likewise, the outside handle 3022 is configured to actuate an outside switch 3029 that sends a signal to the door module 3014 (via the outside handle electrical control line 3028) telling the door module 3014 that someone outside the vehicle desires the door to move to the open location. Under the correct conditions as discussed below, the door would then move to the open location. After actuation of the inside handle 3020 or the outside handle 3022, the door module 3014 will send a signal to the actuator 3018 via the electrical control line 3016 telling the actuator 3018 to activate to thereby move the pawl 3038 to stop the pawl 3038 from maintaining the catch 3036 in the closed position, thereby allowing the door to move to the open location. Moreover, the pawl 3038 can be moved mechanically to thereby stop maintaining the catch 3036 in the closed position by the inside handle 3020 after actuation of the emergency inside lock/unlock toggle lever 3021 or by actuation of the unlatch key cylinder 3032.

Figure 32:
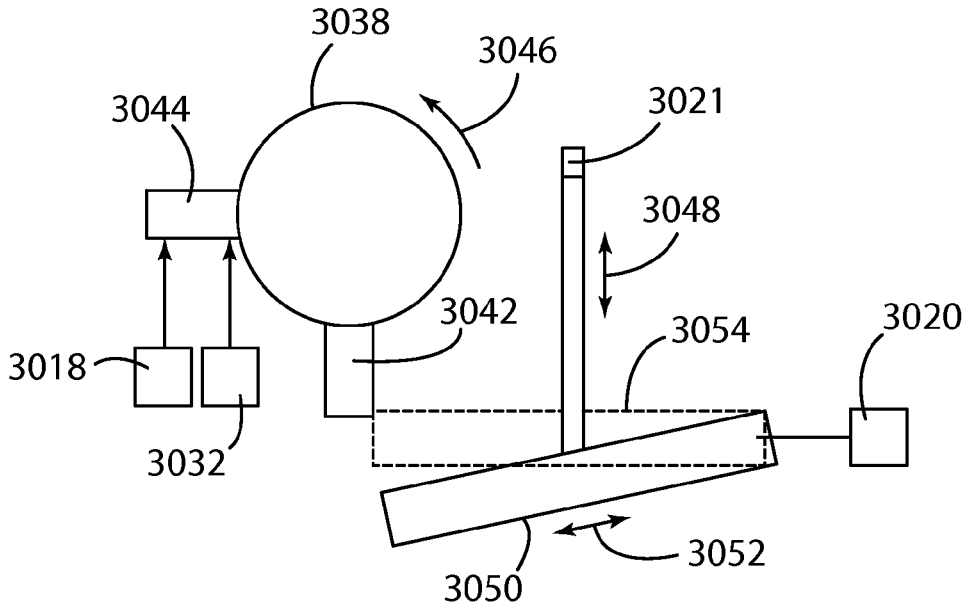
FIG. 32 is a schematic view of the present invention showing movement of a pawl of the present invention.

It is also contemplated that the illustrated latch system 3010 can have the actuator 3018 mechanically engaged with the pawl 3038 and configured to move the pawl 3038 to stop the pawl 3038 from maintaining the catch 3036 in the closed position, thereby allowing the door to move to the open location. It is contemplated that the actuator 3018 could include any element for moving the pawl 3038 (e.g., a rotary actuator or a linear actuator). FIG. 32 illustrates an example of the actuator moving the pawl 3038. In FIG. 32, the actuator 3038 is a linear actuator configured to move a prong 3044 on the pawl 3038 such that the pawl 3038 moves in a clock-wise direction to overcome a biasing force 3046 applied to the pawl 3038. Therefore, the actuator 3018 can be activated to open the door by moving the pawl 3038 via movement of the prong 3044 on the pawl 3038. Accordingly, the catch 3036 would move to the open position, thereby allowing the door to move to the open location. The actuator 3018 can also be employed to prevent the pawl 3038 from moving by maintaining the prong 3044 of the pawl 3038 in its initial position as illustrated in FIG. 32.

The illustrated actuator 3018 can be activated by a signal from the door module 3014. For example, the actuator 3018 can be activated to open the door by actuation of the inside handle 3020 or the outside handle 3022. It is also contemplated that the door module 3014 could receive a remote signal such that the door automatically opens (for example, with a button on a key chain wirelessly sending a signal to the door module 3014 telling the door module 3014 to open the door). The actuator 3018 can also be used to prevent the door from moving to the open location (e.g., when the door module 3014 is set in a child-lock state) by continuously moving the prong 3044 of the pawl 3038 back to its initial position to prevent the pawl 3038 from rotating. It is noted that the actuator 3018 only works when the vehicle has power (or when the actuator 3018 is powered). Therefore, when the vehicle (or actuator 3018) does not have power, the door can only be moved to the open location from the inside using the emergency inside lock/unlock toggle lever 3021.

In the illustrated example, the emergency inside lock/unlock toggle lever 3021 comprises a member that is actuated to mechanically connect the inside handle 3020 to the pawl 3038. The emergency inside lock/unlock toggle lever 3021 is located within the interior of the vehicle and can be manually actuated. It is contemplated that the emergency inside lock/unlock toggle lever 3021 could include any element for mechanically connecting the inside handle 3020 with the pawl 3038. FIG. 32 illustrates an example of the emergency inside lock/unlock toggle lever 3021 for moving the pawl 3038. In FIG. 32, the emergency inside lock/unlock toggle lever 3021 comprises an elongated member connected to a second member 3050 connected to the inside handle 3020. When the emergency inside lock/unlock toggle lever 3021 is not activated, the second member 3050 moves along line 3052 without abutting any element within the door. However, when the emergency inside lock/unlock toggle lever 3021 is activated, the emergency inside lock/unlock toggle lever 3021 is moved along line 3048 to pull the second member 3050 into alignment with a projection on the pawl 3038. The second member 3050 is shown in phantom as element 3054 in FIG. 32. Once the second member 3050 is in alignment with the projection on the pawl 3038, actuation of the inside handle 3020 will move the extension 3042 on the pawl 3038 such that the pawl 3038 moves in a clock-wise direction to overcome the biasing force 3046 applied to the pawl 3038. Therefore, the emergency inside lock/unlock toggle lever 3021 can be activated and used in combination with the inside handle 3020 to open the door by moving the pawl 3038 via movement of the extension 3042 on the pawl 3038. Accordingly, the catch 3036 would move to the open position, thereby allowing the door to move to the open location.

In the illustrated example, the unlatch key cylinder 3032 functions similar to the actuator 3018. The unlatch key cylinder 3032 allows a person outside the vehicle to open the door. The unlatch key cylinder 3032 is mechanically engaged with the pawl 3038. The unlatch key cylinder 3032 is configured to accept a key of a user of the vehicle. The unlatch key cylinder 3032 can comprise a typical cylinder lock. The unlatch key cylinder 3032 is configured to move the pawl 3038 in the same manner the actuator 3018 moves the pawl 3038. For example, the unlatch key cylinder 3032 can move the prong 3044 or the extension 3042 of the pawl 3038. Therefore, the unlatch key cylinder 3032 can be used to open the door by moving the pawl 3038. Accordingly, the catch 3036 would move to the open position, thereby allowing the door to move to the open location.

Referring next to FIGS. 33-36, flowcharts of a vehicle front/rear door inside/outside release operation are provided.

Figure 33:
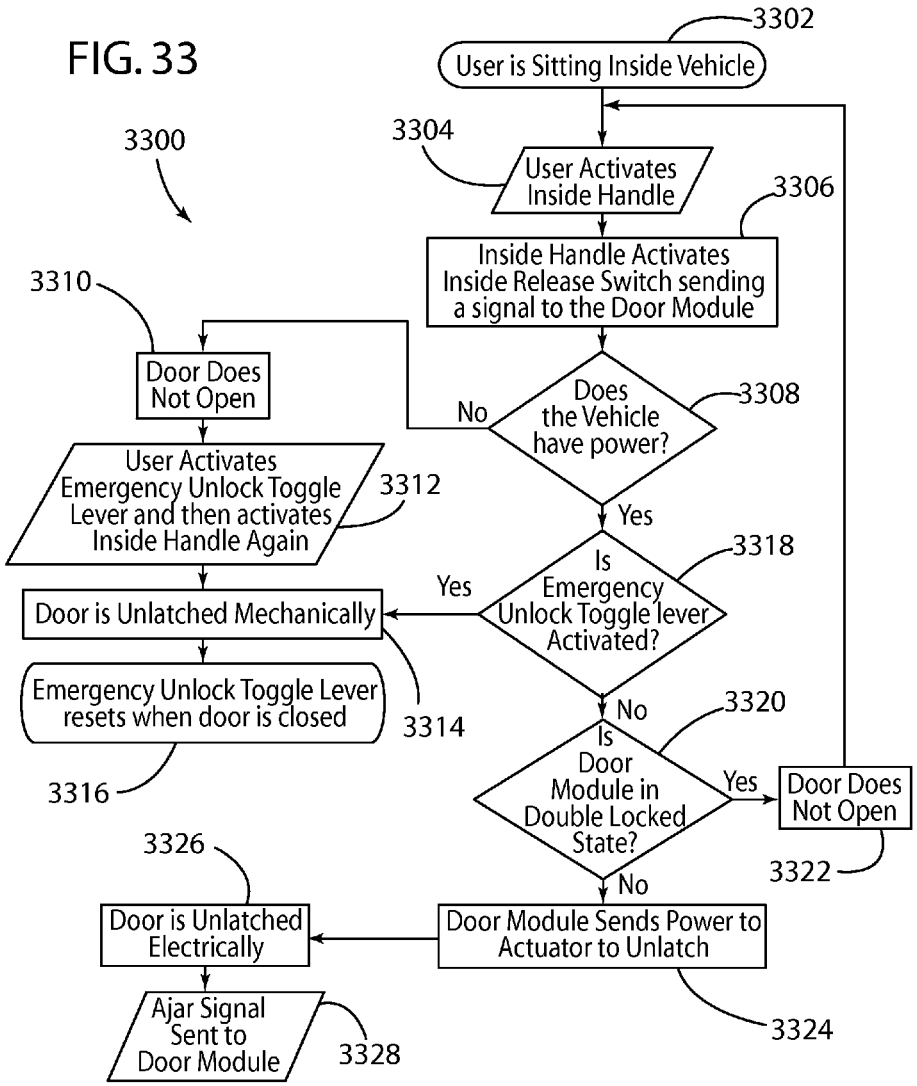
FIG. 33 is a flow chart illustrating a front door inside release operation.

Specifically, referring to FIG. 33, a front door inside release operation 3300 will be described in detail. For front door inside release operation 3300, at step 3302, a user is seated inside the vehicle, and at step 3304, the user actuates the inside handle 3020. At step 3306, when the user actuates the inside handle 3020, the inside release switch 3027 is activated, thus sending a signal to the door module 3014. At step 3308, if the vehicle has power, the method continues to step 3318. At step 3318, if the vehicle does not have the emergency inside lock/unlock toggle lever 3021 activated, the method continues to step 3320. At step 3320, the door module 3014 determines if the door module 3014 is in a double locked state. If the determination at step 3320 is yes, then at step 3322, the vehicle door does not open. If the vehicle does not have power as determined at step 3308, then at step 3310, the vehicle door does not open until the user activates the emergency inside lock/unlock toggle lever 3021 and actuates the inside handle 3020 again at step 3312. Thereafter, at step 3314, the door is unlatched mechanically. Moreover, the emergency inside lock/unlock toggle lever 3021 resets when the door is closed at step 3316. If the determination at step 3318 is yes (such that the emergency inside lock/unlock toggle lever 3021 is activated, the method continues to step 3314 wherein the door is unlatched mechanically and then to step 3316 wherein the emergency inside lock/unlock toggle lever 3021 resets. If the determination at step 3320 is no (such that the door module 3014 is not in a double locked state), the method 3300 continues to step 3324 where the door module 3014 instructs the actuator 3018 to allow the door to move to the open location at step 3326 (by moving the pawl 3038 as discussed above). Thereafter, at step 3328, a signal is sent to the door module 3014 telling the door module 3014 that the door is ajar (or in the open location) such that the door module 3014 can send a signal to the actuator 3018 to reset the pawl 3038 once the door is closed.

Figure 34:
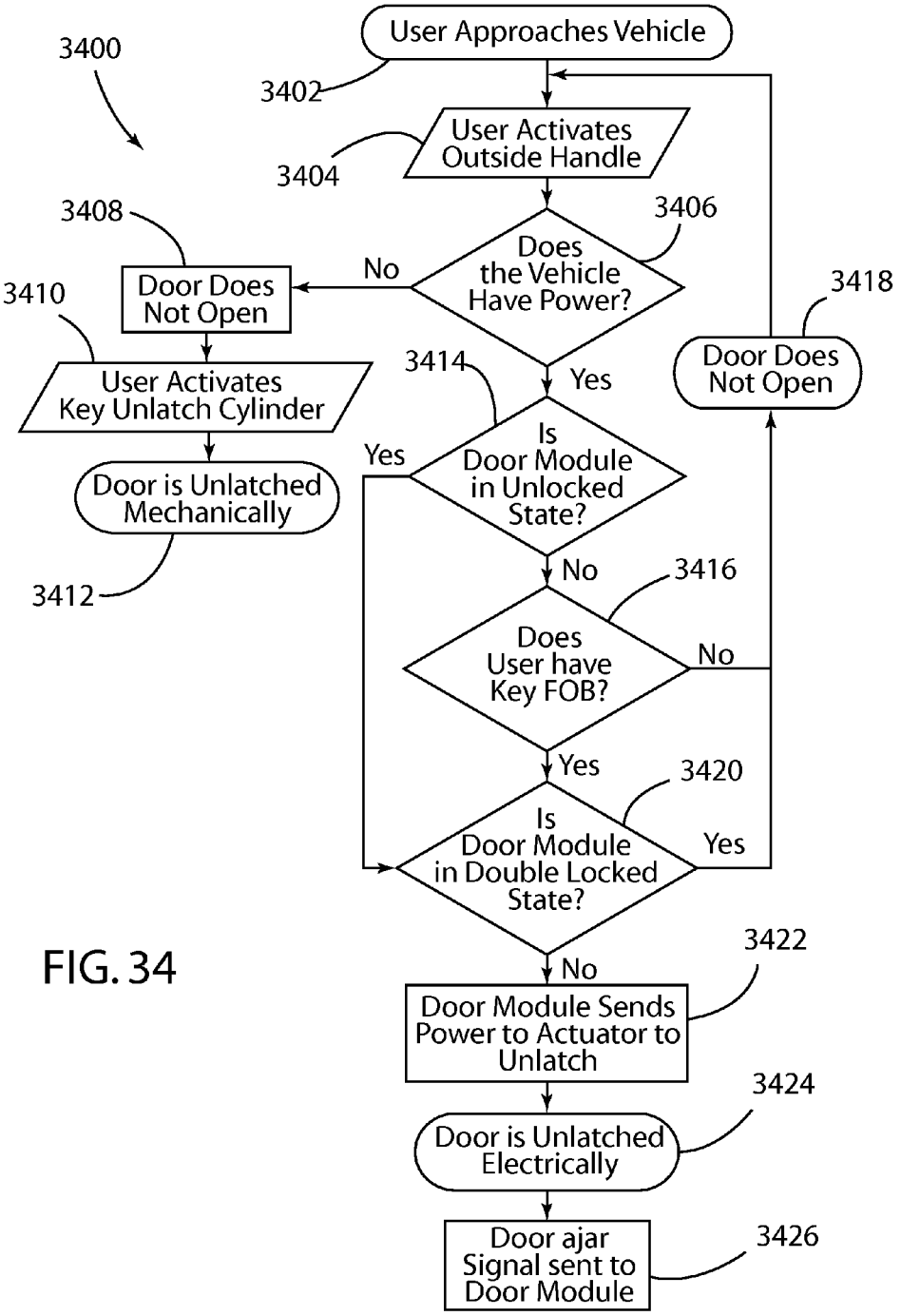
FIG. 34 is a flow chart illustrating a front door outside release operation.

Referring to FIG. 34, a front door outside release operation 3400 will be described in detail. For front door outside release operation 3400, at step 3402, a user approaches an outside of the vehicle, and at step 3404, the user actuates the outside handle 3022. At step 3406, if the vehicle has no power, the method continues to step 3408. At step 3408, the door does not open until the user actuates the key unlatch cylinder 3032 at step 3410 to mechanically move the door to the open location at step 3412. If the vehicle does have power as determined at step 3406, then at step 3414, the door module 3014 determines if the door module 3014 is in an unlocked state. If the determination at step 3414 is no, then at step 3416, the door module 3014 determines if the user has a key FOB for moving the door module 3014 to the unlocked state. If the user does not have a key FOB at step 3416, then at step 3418, the vehicle door does not open. If the user does have a key FOB at step 3416, at step 3418, the door module 3014 determines if the door module 3014 is a double locked state. If the door module 3014 is in the double locked state, then at step 3418, the vehicle door does not open. If the determination at step 30420 is no (such that the door module 3014 is not in a double locked state) or if the determination at step 3414 is yes (such that the door module 3014 is in an unlocked state), the method 3400 continues to step 3422 where the door module 3014 instructs the actuator 3018 to allow the door to move to the open location at step 3424 (by moving the pawl 3038 as discussed above). Thereafter, at step 3426, a signal is sent to the door module 3014 telling the door module 3014 that the door is ajar (or in the open location) such that the door module 3014 can send a signal to the actuator 3018 to reset the pawl 3038 once the door is closed.

Figure 35:
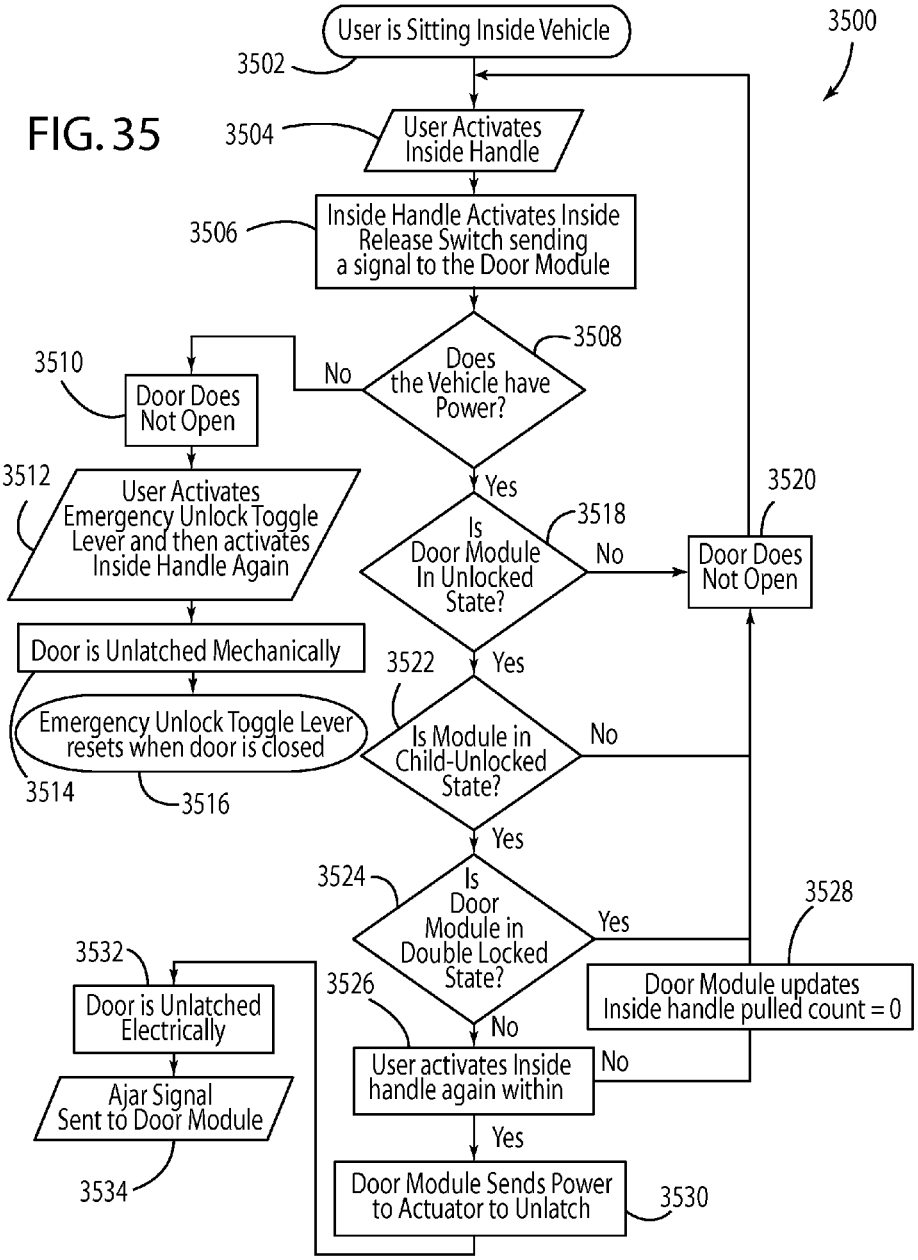
FIG. 35 is a flow chart illustrating a rear door inside release operation.

Referring to FIG. 35, a rear door inside release operation 3500 will be described in detail. For rear door inside release operation 3500, at step 3502, a user is seated inside the vehicle, and at step 3504, the user actuates the inside handle 3020. At step 3506, when the user actuates the inside handle 3020, an inside release switch 3027 is activated, thus sending a signal to the door module 3014. At step 3508, if the vehicle does not have power, the method continues to step 3510. At step 3510, the vehicle door does not open until the user activates the emergency inside lock/unlock toggle lever 3021 and actuates the inside handle 3020 again at step 3512. Thereafter, at step 3514, the door is unlatched mechanically. Moreover, the emergency inside lock/unlock toggle lever 3021 resets when the door is closed at step 3516. If the vehicle does have power as determined at step 3508, then at step 3518, the door module 3014 determines if the door module 3014 is in an unlocked state. If the determination at step 3510 is no, then at step 3520, the vehicle door does not open. If the door module 3014 is in the unlocked state as determined at step 3518, then at step 3522, the door module 3014 determines if the door module 3014 is in a child-unlocked state. If the determination at step 3522 is no, then at step 3520, the vehicle door does not open. If the door module 3014 is in the child-unlocked state as determined at step 3522, then at step 3524, the door module 3014 determines if the door module 3014 is in a double locked state. If the determination at step 3524 is yes, then at step 3520, the vehicle door does not open. If the determination at step 3524 is no (such that the door module 3014 is not in a double locked state), the method 3500 continues to step 3526 where the door module 3014 determines the user has actuated the inside handle 3020 again within a certain time period (e.g., 5 seconds) of the first actuation of the inside handle 3020. If the inside handle 3020 has not been actuated a second time within the certain time period, the method continues first to step 3528 wherein the door module 3014 updates an inside handle actuation count (within its memory) to zero (such that the next actuation of the inside handle will be considered the first actuation of the inside handle 3020) and then to step 3520 wherein the door does not open. If the determination at step 3526 determines that the inside handle 3020 was actuated a second time within the certain time period, the method 3500 continues to step 3530 where the door module 3014 instructs the actuator 3018 to allow the door to move to the open location at step 3532 (by moving the pawl 3038 as discussed above). Thereafter, at step 3534, a signal is sent to the door module 3014 telling the door module 3014 that the door is ajar (or in the open location) such that the door module 3014 can send a signal to the actuator 3018 to reset the pawl 3038 once the door is closed. It is noted that if it is desired to have the door open with only one actuation of the inside handle 3020, the method 3500 can proceed from step 3524 directly to step 3530 if the vehicle is not in the double locked state.

Figure 36:
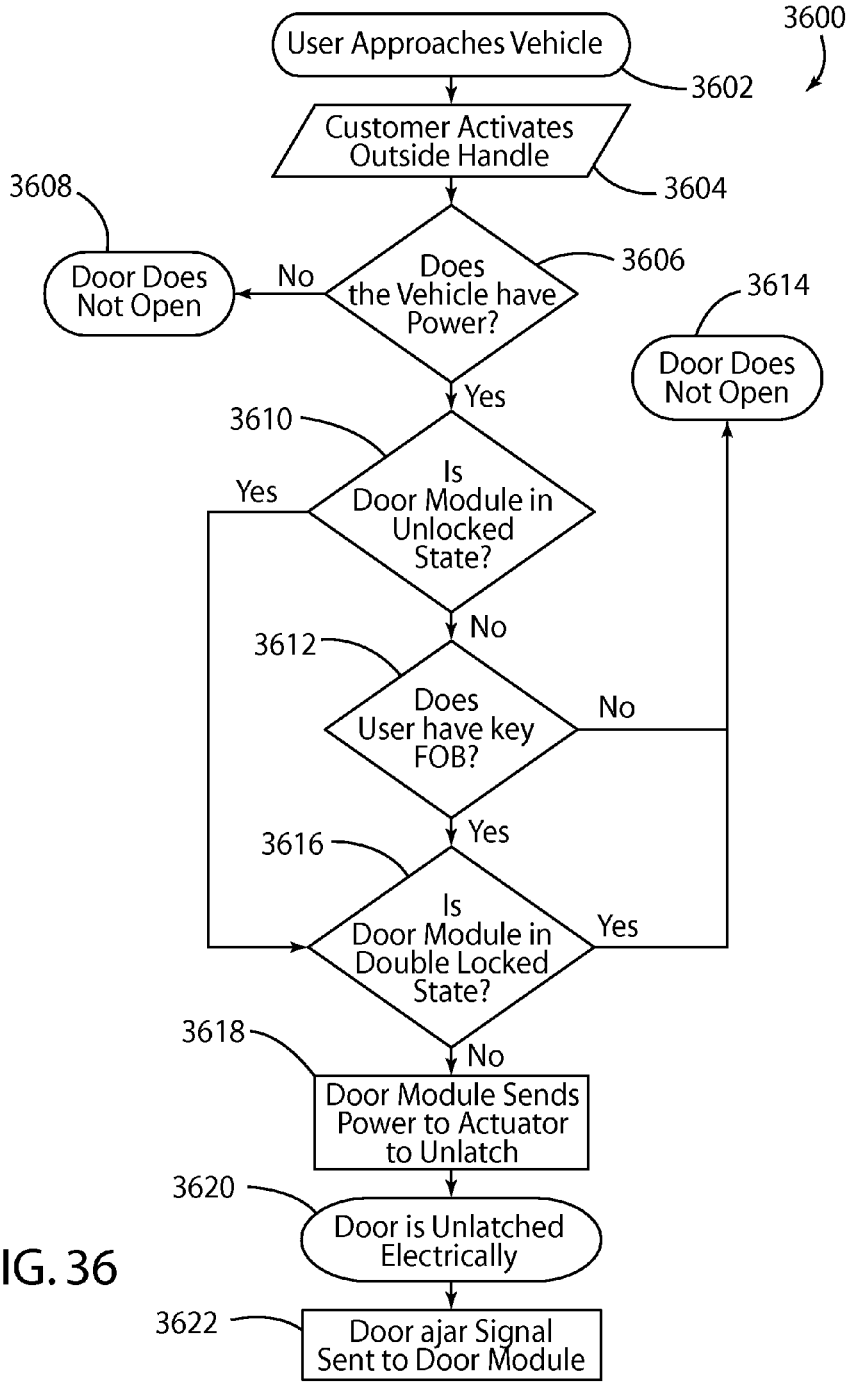
FIG. 36 is a flow chart illustrating a rear door outside release operation.

Referring to FIG. 36, a rear door outside release operation 3600 will be described in detail. For rear door outside release operation 3600, at step 3602, a user approaches an outside of the vehicle, and at step 3604, the user actuates the outside handle 3022. At step 3606, if the vehicle has no power, the method continues to step 3608, where the door does not open. If the vehicle does have power as determined at step 3606, then at step 3610, the door module 3014 determines if the door module 3014 is an unlocked state. If the determination at step 3610 is no, then at step 3612, the door module 3014 determines if the user has a key FOB for moving the door module 3014 to the unlocked state. If the user does not have a key FOB at step 3612, then at step 3614, the vehicle door does not open. If the user does have a key FOB at step 3612, then at step 3616, the door module 3014 determines if the door module 3014 is in a double locked state. If the door module 3014 is in the double locked state, then at step 3614, the vehicle door does not open. If the determination at step 616 is no (such that the door module 3014 is not in a double locked state) or if the determination at step 3610 is yes (such that the door module 3014 is in an unlocked state), the method 3600 continues to step 3618 where the door module 3014 instructs the actuator 3018 to allow the door to move to the open location at step 3620 (by moving the pawl 3038 as discussed above). Thereafter, at step 3622, a signal is sent to the door module 3014 telling the door module 3014 that the door is ajar (or in the open location) such that the door module 3014 can send a signal to the actuator 3018 reset the pawl 3038 once the door is closed.

To summarize, latch system 3010 thus provides a universal door latching system which may be readily operable by electronic door module 3014 for meeting different government regulations or customer requirements. For example, the latch system 3010 may be operable to include a rear door latch override as allowed in Europe, and maintain the rear door latch override function for the U.S. or similar markets. The latch system 3010 may also be readily adaptable for feature upgrades (e.g., power child locks, fast unlock, etc.), and require minimal modifications for design aspects involving mounting hole patterns, electrical connectors, rod versus handles, etc. Thus, the latch system 3010 provides a common front and side door latch system on a global scale, while also reducing product development time, costs and tooling related to side door latches.

The latch system may support both fixed and moving outside handle applications with no change to the latch. Yet further, as also discussed above, the door module 3014 may provide multiple functionalities depending on the signal(s) received from the outside and inside release handles upon activation. In a particular embodiment, the outside handle may be a purely electrical release. Yet further, the latch assembly 3012 may include no lock levers, and the latch system 3010 may be purely within the memory of the door module 3014. The power child lock function may be provided by the logic of the door module 3014, with no additional motors or child-lock levers in the latch assembly 3012.

It is to be understood that variations and modifications can be made on the aforementioned structure without departing from the concepts of the present invention. For example, it is contemplated that the door module 3014 could be configured to only allow the door to move to the open location if the vehicle is traveling below a certain speed (e.g., 3 miles per hour) and/or if no crash is detected. Moreover, it is contemplated that the door module 3014 could include a visual indication if any or all of the doors are in a locked state (e.g., an LED indicator 3223). Furthermore, it is noted that actuation of the inside handle does not require any movement of a mechanical element. Further, it is to be understood that such concepts are intended to be covered by the following claims unless these claims by their language expressly state otherwise.

What is claimed is:

1. A method of configuring vehicle side door latch assemblies, the method comprising:

providing front and rear latch assemblies having substantially identical construction, wherein each latch assembly is configured to retain vehicle front and rear side doors in fully closed positions when latched, and permits a vehicle side door to open when unlatched, and wherein each latch assembly includes a powered actuator that selectively unlatches the latch assembly;

providing a control system;

providing a front inside door handle;

providing a rear inside door handle;

providing a first mechanical linkage that provides for mechanical unlatching of the front latch assembly by a user within a vehicle interior when the front door of the vehicle is fully closed without actuation of the powered actuator of the front latch assembly;

providing a second mechanical linkage that provides for unlatching of the rear latch assembly by a user within a vehicle interior when the rear door of the vehicle is fully closed without actuation of the powered actuator of the rear latch assembly;

operably connecting the front and rear inside door handles to the control system;

operably connecting the powered actuators of the front and rear latch assemblies to the control system; and wherein:

the control system includes a lock state for the front and rear latch assemblies, the lock states comprising at least one of an unlocked state and a double locked state, wherein the control system further includes a child lock state for the rear latch assembly; and wherein, if the vehicle has sufficient electrical power, the control system unlatches the front latch assembly if the front inside handle is actuated unless the front latch assembly is in a double locked state; and wherein, if the vehicle has sufficient electrical power, the control system unlatches the rear latch assembly if the rear inside handle is actuated and the lock state of the rear latch assembly is unlocked, the child lock state is off, and the rear latch assembly is not in a double locked state.

2. The method of configuring vehicle side door latches of claim 1, including:

providing front and rear outside door handles;

operably connecting the front and rear outside door handles to the control system; and wherein:

the control system unlatches the front latch assembly if a user actuates the front outside handle and the vehicle has electrical power if the control system receives an authorization signal meeting predefined security criteria and if the front latch assembly is not in a double locked state, and wherein the control system unlatches the rear latch assembly if a user actuates the rear outside handle and the vehicle has electrical power if the control system receives an authorization signal meeting predefined security criteria and if the rear latch assembly is not in a double locked state.

3. The method of configuring vehicle side door latches of claim 1, including:

operably interconnecting the front latch assembly to the front inside door handle utilizing the first mechanical linkage.

4. The method of configuring vehicle side door latches of claim 3, wherein:

the front inside door handle mechanically unlatches the front latch assembly if the front inside door handle is actuated twice.

5. The method of configuring vehicle side door latches of claim 4, including:

operably interconnecting the rear latch assembly to the rear inside door handle utilizing the second mechanical linkage.

6. The method of configuring vehicle side door latches of claim 5, wherein:

the rear inside door handle mechanically unlatches the rear latch assembly if the rear inside door handle is actuated twice.

7. The method of configuring vehicle side door latches of claim 1, including:

operably interconnecting the front latch assembly to the front inside door handle utilizing the first mechanical linkage;

providing a front emergency inside toggle that can be manually actuated by a user within a vehicle interior; and operably interconnecting the front emergency inside toggle to the first mechanical linkage whereby actuation of the front emergency inside toggle followed by actuation of the front inside door handle mechanically unlatches the front latch assembly even if the powered actuator of the front latch assembly is not actuated.

8. The method of configuring vehicle side door latches of claim 7, including:

operably interconnecting the rear latch assembly to the rear inside door handle utilizing the second mechanical linkage;

providing a rear emergency inside toggle that can be manually actuated by a user within a vehicle interior; and operably interconnecting the rear emergency inside toggle to the second mechanical linkage whereby actuation of the rear emergency inside toggle followed by actuation of the rear inside door handle unlatches the rear latch assembly even if the powered actuator of the rear latch assembly is not actuated.

9. The method of configuring vehicle side door latches of claim 1, including:

providing an emergency front inside lever that can be actuated by a user within a vehicle interior; and operably interconnecting the emergency front inside lever to the front latch assembly utilizing the first mechanical linkage such that actuation of the emergency front inside lever mechanically unlatches the front latch assembly even if the powered actuator of the front latch assembly is not actuated.

10. The method of configuring vehicle side door latches of claim 9, including:

providing an emergency rear inside lever that can be actuated by a user within a vehicle interior; and operably interconnecting the emergency rear inside lever to the rear latch assembly utilizing the second mechanical linkage such that actuation of the emergency rear inside lever mechanically unlatches the rear latch assembly even if the powered actuator of the rear latch assembly is not actuated.

* * * * *